US006431107B1

(12) United States Patent
Byle

(10) Patent No.: US 6,431,107 B1
(45) Date of Patent: Aug. 13, 2002

(54) TENDON-BASED FLOATING STRUCTURE

(75) Inventor: Steven M. Byle, Houston, TX (US)

(73) Assignee: Novellant Technologies, L.L.C., Houston, TX (US)

( * ) Notice: Subject to any disclaimer, the term of this patent is extended or adjusted under 35 U.S.C. 154(b) by 0 days.

(21) Appl. No.: 09/292,649

(22) Filed: Apr. 15, 1999

Related U.S. Application Data

(60) Provisional application No. 60/082,107, filed on Apr. 17, 1998.

(51) Int. Cl.[7] ..... B63B 35/44; E02D 5/54; E02D 5/74

(52) U.S. Cl. ..... 114/264; 405/224

(58) Field of Search ..... 114/264, 265, 114/266; 405/224, 202, 204, 223

(56) References Cited

U.S. PATENT DOCUMENTS

| | | | | | |
|---|---|---|---|---|---|
| 3,778,854 | A | | 12/1973 | Chow | 9/8 P |
| 4,606,673 | A | | 8/1986 | Daniell | 405/210 |
| 4,626,137 | A | | 12/1986 | Willemsz | 405/224 |
| 4,702,321 | A | | 10/1987 | Horton | 166/350 |
| 4,723,875 | A | | 2/1988 | Sutton | 405/204 |
| 4,740,109 | A | | 4/1988 | Horton | 405/224 |
| 4,829,928 | A | * | 5/1989 | Bergman | 114/125 |
| 4,850,744 | A | | 7/1989 | Petty et al. | 405/224 |
| 4,906,139 | A | | 3/1990 | Chiu et al. | 405/224 |
| 4,913,238 | A | | 4/1990 | Danazcko et al. | 166/350 |
| 5,012,756 | A | | 5/1991 | Kristensen | 114/265 |
| 5,117,914 | A | | 6/1992 | Blandford | 166/344 |
| 5,421,676 | A | | 6/1995 | Wybro et al. | 405/223.1 |
| 5,551,802 | A | | 9/1996 | Wybro | 405/223.1 |
| 5,558,467 | A | | 9/1996 | Horton | 405/195.1 |
| 5,567,086 | A | | 10/1996 | Huete | 405/223.1 |
| 5,609,442 | A | | 3/1997 | Horton | 405/205 |
| 5,722,797 | A | | 3/1998 | Horton, III | 405/224 |
| 6,106,198 | A | * | 8/2000 | Borseth | 405/223.1 |

FOREIGN PATENT DOCUMENTS

| | | |
|---|---|---|
| FR | 527.435 | 10/1921 |
| FR | 2 400 086 | 3/1979 |
| GB | 2310407 A | 8/1997 |
| WO | WO 96/14473 | 5/1996 |

OTHER PUBLICATIONS

S.R. Perryman, Amoco Corp.; E.E. Horton and J.E. Halkyard, Deep Oil Technologies Inc. and P.A. Beynet, Amoco Corp., "Tension Buoyant Tower f or Small Fields in Deepwaters", May 1995, Offshore Technology Conference 7805, pp. 13–22.

Jack Y.K. Lou, Florian Racine, Fred Y.F. Xu and Peimin Cao Ocean Engineering Program, Texas A&M University, "Floating Jacket—A New Concept for the Design of a Floating Production, Storage and Offloading Platform in Deepwater", May 1995, Offshore Technology Conference, 7768, pp. 649–655.

Aker Omega, Joint Industry Project, Tension Raft Jacket (TRJ) Concept, 1 page.

International Search Report, Aug. 6, 1999, 7 pages.

* cited by examiner

*Primary Examiner*—S. Joseph Morano
*Assistant Examiner*—Andrew D. Wright
(74) *Attorney, Agent, or Firm*—Rosenthal & Osha L.L.P.

(57) ABSTRACT

A floating offshore structure has a buoyant hull with sufficient fixed ballast to place the center of gravity of the floating structure below the center of buoyancy of the hull. A support structure coupled to an upper end of the hull supports and elevates a superstructure above the water surface. A soft tendon is attached between the hull and the seafloor. A vertical stiffness of the soft tendon results in the floating structure having a heave natural period of at least twenty seconds.

23 Claims, 36 Drawing Sheets

TENDON-BASED FLOATING STRUCTURE

CROSS-REFERENCE TO RELATED APPLICATIONS

This application claims priority from U.S. provisional application 60/082,107, filed Apr. 17, 1998.

BACKGROUND

The invention relates generally to floating structures. More specifically, the invention is directed to a floating structure for supporting a deck structure or other superstructure above a water surface.

Offshore petroleum operations, such as exploration, drilling production, and storage, generally require a deck structure or other superstructure supported above the water surface with sufficient air gap to remain clear of the waves. A superstructure may comprise a diverse array of equipment and structures depending upon the type of offshore operation to be performed. For example, a superstructure for drilling a well and producing hydrocarbons may include equipment for drilling and producing hydrocarbons, living quarters for a crew, equipment storage, and a myriad of other structures, systems, and equipment. During operation, additional payload of drill pipes, drill mud, hydrocarbons, helicopters, and other items may be added. The combined weight of such superstructures and payload is typically measured in thousands of tons. The superstructure may be supported on a generally rigid structure fixed to the seafloor or on a floating structure. Fixed structures are typically viable in shallow waters, typically waters with depths less than 1,000 feet. Floating structures are generally viable in both shallow and deep waters.

There are several basic requirements for a floating structure employed to support a superstructure. The floating structure must provide sufficient buoyancy to support the weight of the superstructure and any payload. The floating structure must be stable in any condition while supporting the weight of the superstructure and payload above the water surface. The floating structure must be able to "keep station" about a fixed position within a limited range of lateral excursions throughout the duration of a given operation. The floating structure must have acceptable "seakeeping" characteristics relating to the oscillatory motions, velocities, and accelerations of the floating structure. The station keeping and seakeeping characteristic requirements are generally determined by operational concerns, such as crew comfort, equipment operability, riser safety, and station keeping system fatigue.

Floating structures generally provide buoyancy through means of a submerged hull employing Archimedes principle. Typically, a void portion of a hull extends below the water surface, displacing a volume of water to provide an uplifting force. Hull construction is typically reinforced steel plating, but other materials, most notably concrete, are also employed. The submerged portion of the hull is most commonly placed directly adjacent to the water surface, such as for a typical ship. Unlike a ship, however, placement of buoyancy is variable.

Floating structures are generally stabilized by one or more of several methods. The first and most common method provides stability through placement of buoyancy directly adjacent to the water surface to create waterplane area. Many configurations of waterplane area are utilized to stabilize the floating structure. Ships are one example wherein a single large waterplane area provides the required stability. A semi-submersible provides an example wherein multiple waterplane areas, spaced widely apart, are employed to reduce the size of the waterplane area required to provide stability. In both examples, as the floating structure pitches and rolls, the center of buoyancy of the submerged hull moves as the waterplane changes to provide a righting moment. While the center of gravity for the floating structure may be located above the center of buoyancy, the floating structure can nonetheless remain stable. Increasing the waterplane area or using multiple, widely spaced waterplanes is generally the cheapest and simplest method for providing stability. The seakeeping consequences of a large waterplane, however, are generally undesirable.

The second method provides stability by placement of the center of gravity of the floating structure below the center of buoyancy. The combined weight of the superstructure, hull, payload, ballast and other elements may be arranged to be below the center of buoyancy. The floating structure will pitch about the center of rotation with the reversed pendulum effect of the weight providing a righting force. Arrangement of the center of gravity below the center of buoyancy may be a difficult task. One method employed to lower the center of gravity requires the addition of fixed ballast below the center of buoyancy to counterbalance the weight of superstructure and payload. Fixed ballast, generally is a negatively buoyant hull structure or material added to the floating structure to lower the center of gravity. There are two main types of fixed ballast, structural weight and non-structural solid ballast. Examples of structural fixed ballast include permanent ballast tanks, flooded truss portions, and concrete oil storage tanks. Examples of solid ballast include metal filings, pig iron, iron ore, and concrete placed within or attached to the hull structure. The advantage of the weight arrangement is that it may be achieved such that seakeeping performance is unaffected while stability is increased. Another method is to move the center of buoyancy higher, generally by placing buoyancy adjacent to or near the water surface. The disadvantage of buoyancy rearrangement is that it may require an increasing waterplane area and a hull structure near the water surface, both generally having negative seakeeping consequences.

The third method provides stability by arrangement of station keeping elements attached between the seafloor and the floating structure. Typically, marine tendon systems are composed of sections of steel pipe arranged vertically. The tendons are attached in a widely dispersed pattern about the center of rotation of the floating structure. Pitching of the floating structure induces elongation in the tendons on one side of the center of rotation and contraction on the other side to produce a righting moment. The pretension on the tendons also act in a manner similar to solid ballast. The pretension functions as ballast weight lowering the effective center of gravity for the floating structure. Tendon-based platforms have heretofore generally been costly floating structures. This result is due to the large tendons required to provide adequate vertical stiffness and pretension along with complications associated with the installation of rigid tendons. The cost of tendon-based floating structures also tends to increase significantly with water depth, due to a reduction in tendon stiffness that occurs as tendon length increases. Tendon size must be increased to maintain the required vertical stiffness, resulting in costs which may geometrically increase with water depth. The advantage is that seakeeping performance for tendon-based structures is generally superior due to the extreme stiffness of a marine tendon system in the vertical, or heave, direction. Floating structures whose vertical stiffness is primarily controlled by the stiffness of attached station keeping elements, rather than the vertical stiffness of the waterplane, shall be referred to as tendon-based floating structures.

Floating structures may employ the aforementioned methods of stabilization, either alone or in combination. Those floating structures whose stability is satisfied upon an arrangement of waterplane area or placement of the centers of gravity and buoyancy may be referred to as self-stabilizing floating structures. Such floating structures have the advantage of being stable independent of the function of an external station keeping system. The seakeeping characteristics of self-stabilizing floating structures not employing tendons, however, is generally inferior to that of tendon-based floating structures employing station keeping elements to provide or augment stability. Marine tendon systems, however, have heretofore generally been seen as unfeasible for ultra deep water operations due to increasing costs and installation difficulties.

A floating structure is generally subject to excursion and motion in six degrees of freedom, as illustrated in FIG. 1. Displacements in the vertical direction, longitudinal, and transverse directions are generally referred to as heave, surge, and sway, respectively. Rotations about the heave, surge, and sway axes are generally referred to as yaw, roll, and pitch, respectively. However, since many offshore oil structures are symmetric in the surge and sway directions, the terms lateral excursion or surge shall be used as inclusive of displacements or motions in either direction. Further, the term tilt or pitch shall be used as inclusive of displacements or motions in either the pitch or roll directions.

A floating structure may also be subject to the environmental forces of wind, waves, and current. The magnitude of these forces is generally controlled by design and arrangement of the hull, superstructure, and other elements of a floating structure. These forces combine to induce the generally undesirable response of steady excursions and oscillatory motions in the aforementioned six degrees of freedom. It is frequently desirable for a floating structure to remain relatively stationary either in relation to a fixed point on the seafloor or relative to another body during an offshore operation. Holding a floating structure upon a fixed mean position, or station, and reducing lateral excursions about this station against the forces of the environment shall be referred to as station keeping.

Station keeping may be provided by a number of means. Short-term operations allow the use of dynamic positioning systems to provide some or all of the station keeping requirements. Dynamic positioning systems generally employ active means of monitoring position combined with thruster control to hold a fixed position. Most applications requiring fixed position operations, however, employ station keeping elements attached between the seafloor and the floating structure. The station keeping elements, typically steel pipe rigid tendons or steel wire and chain mooring lines, fix the mean position. Station keeping elements act directly to reduce the static lateral excursions of the floating structure about the mean position. Station keeping elements, however, are generally not directly effective to reduce dynamic motions. Instead, as previously mentioned, design and arrangement of the elements of the floating structure directly control dynamic motions by determining the magnitude of environmental forces applied to the floating structure. Station keeping elements do, however, have an indirect affect on dynamic motions by altering the natural periods of motion for a given floating structure design. Therefore, a combination of hull and station keeping system design may be employed to determine and reduce the dynamic response of a floating structure under environmental forces. The characteristic dynamic motion response of a floating structure, including any system of attached station keeping elements under environmental forces, shall be referred to as seakeeping.

The seakeeping characteristics of a floating structure are determined by a number of factors, importantly: size of the waterplane, submerged hull profile, and natural periods of motion of the floating structure. Several principles generally apply. As waterplane area increases, wave induced heave forces increase. As the size of the vertical cross-sectional hull shape, or hull profile, in a zone nearest the water surface increases, wave induced surge forces increase. This area near the water surface wherein the majority of the wave-induced hydrodynamic forces occur, shall be referred to as the wave zone. The manipulation and affect of floating structure natural periods of motion is a more complex subject explained in more detail below. In general, however, two principles may be mentioned. As the total mass, including added mass, of the floating structure increases, the natural periods of motion become longer. As the total stiffness of a floating structure against excursion in a particular direction increases, the natural period of motion in that direction decreases.

A floating structure may be modeled as a spring mass system having a natural period of vibration in the heave and surge directions described by the following formula:

$$T_n=2\pi\sqrt{M/K}$$

where for a given direction:

$T_n$=Natural Period of the Mooring System

M=Mass of the System including Added Mass

K=Stiffness of the System

In the vertical or heave direction, the stiffness of a floating structure is generally determined by the water plane area of the submerged hull and the vertical stiffness characteristics of any attached tensile attachments, such as mooring lines or tendons. The most common method of increasing vertical stiffness is through the use of a marine tendon system. The hull of the floating structure is submerged, generally such that the total buoyancy provided is in excess of floating structure and payload weight. The additional buoyancy acts as pretension on the tendons. Therefore, the heave motion of the floating structure induces elongation of the tendons. The total vertical stiffness for such a floating structure would be the total of the combined stiffness of all tendons and the stiffness added by the waterplane. The stiffness added by the waterplane, however, is generally small compared with the combined tendon stiffness. A tendon-based floating structure is generally characterized as having a vertical stiffness roughly an order of magnitude or more larger than the vertical stiffness supplied by the waterplane area alone.

The Mass (M) of a floating structure may be defined most simply as the mass of all matter that moves when the floating structure moves. For engineering purposes, Mass (M) has two components: displacement and added mass. Displacement includes all attached and captured mass, comprising attached items such as the superstructure, payload, hull structure, and solid ballast, and captured weight such as ballast water or hydrocarbons held in tanks. Added mass is a more foreign concept, generally including a portion of the water around the hull of the floating structure which is forced to move as the floating structure moves. The amount of added mass may be varied through hull design. Added mass may or may not be desirable depending upon the requirements of a particular floating structure. Added mass, however, is generally the cheapest method of increasing the mass of a floating structure for purposes of influencing the natural period of motion.

When a floating structure is stationed in an open sea environment, the floating structure is exposed to the forces of wind, current, and waves. Wind and current may be generally steady for time scales on the order of a natural period of an offshore structure, therefore generally inducing a non-oscillating, or static, offset with some relatively smaller amounts of slow drift oscillation. Wave patterns, however, are generally irregular on these time scales, and generally induce an offset having both a static portion and an oscillating portion. The oscillating portion comprises both dynamic motions occurring near the wave period and slow drift motions occurring near the natural period of motion of the floating structure.

An irregular wave surface is characterized by the presence of a large number of individual waves with different wave periods and wave heights. The statistical properties of such a surface may be described by means of a wave-energy spectrum or wave energy distribution such as illustrated in FIG. 2(*a*). The motion response of a floating structure may be characterized by means of a Response Amplitude Operator (RAO) such as illustrated in FIG. 2(*b*). The expected motion response spectrum of the floating structure may be derived by the product of the wave energy spectrum and the square of the RAO, as illustrated in FIG. 2(*c*). By way of example, the primary wave period for a one hundred year hurricane condition in the Gulf of Mexico is between fourteen and sixteen seconds. This environmental condition is often used as a design environmental condition for floating structures employed in the Gulf of Mexico. The surge natural period of a typical moored offshore structure employed in the Gulf of Mexico for production operations is on the order of 100–300 seconds. This is due to the relatively small lateral stiffness (K) provided by station keeping elements as compared with the mass (M) of the floating structure. As can be appreciated by reference to FIGS. 2(*a*) to 2(*c*), the surge motion response spectrum may be a double peaked curve. The first peak, representing the first order motions occurring near the primary wave period, may be significantly smaller than the second peak, representing the slow drift motions occurring near the surge natural period of the floating structure. A relatively small input of wave energy, generally corresponding to relatively small magnitude environmental forces, may induce large resonant response motions in a degree of freedom having a long natural period of motion, typically surge. In other degrees of freedom, the length of the natural period may be nearer to the primary wave period. Where a natural period of motion and a primary wave period coincide or nearly coincide, a motion amplification phenomenon referred to as resonance matching occurs. Extremely large amplitude motions may result from resonant matching. It is therefore desirable that a floating structure have no natural period of motion in any degree of freedom that falls near the primary wave period.

The vertical stiffness of a floating structure is generally much stiffer than its lateral stiffness. This is due to the stiffness provided by the waterplane, apart from the use of tendons. The result is that resonance matching may occur in heave. Therefore, floating structures are generally designed to have heave natural periods significantly above or below the primary wave period. This factor has divided floating structures into two basic categories. One category, comprises tendon-based floating structures, having heave natural periods ($T_n$) under the primary wave period, typically near five seconds. The other category, generally comprises non-tendon based, self-stabilizing floating structures, having heave natural periods ($T_n$) over the primary wave period, generally greater than twenty seconds. By way of example, a typical floating structure employing a marine tendon system, such as a tension leg platform, may have a heave natural period ($T_n$) of three to five seconds. A floating structure not employing a marine tendon system, such as a spar buoy platform or semi-submersible, generally has a heave natural period ($T_n$) above twenty seconds.

The result is that prior art tendon-based floating structures are sensitive to Mass (M), as increasing the mass (M) of the floating structure results in an increased tendon requirement. Vertical stiffness (K) must be increased in order to retain a low heave natural period ($T_n$). Conversely, non-tendon based structures are sensitive to vertical stiffness (K). Tradeoffs must generally be made between stability and seakeeping, as decreasing waterplane area decreases stability while increasing heave natural period ($T_n$).

Prior art floating structures have been developed which employ a variety of means for providing buoyancy, stability, station keeping, and seakeeping. As a means of illustration of the aforementioned floating structure design concerns, several exemplary floating structures are discussed.

Non-Tendon Based Floating Structures

Semi-submersible

A semi-submersible provides an example of a self-stabilizing floating structure employing an arrangement of waterplane area to provide stability. FIG. 3 illustrates an exemplary semi-submersible 300 comprising a drilling platform 302 positioned on the hull structure 304. The hull structure 304 comprises multiple columns 306 upon submerged pontoons 308 which provide the required buoyancy. The center of gravity (CG) of the semi-submersible 300 is above the center of buoyancy (CB). The required stability is therefore provided by wide spacing between the waterplane area of the columns 306. The relatively large vertical cross-sectional area of the hull, or hull profile, in the wave zone, induces relatively large environmental forces in the lateral direction. A semi-submersible, therefore, has relatively large requirements for a station keeping system. A spread pattern of conventional catenary mooring lines 310 may be employed to perform station keeping. The mooring lines 310 are run through fairleads 312 generally placed near the waterline, extending in a catenary shape to anchors 314 at the seafloor 320. The natural periods of motion in all six degrees of freedom are generally above twenty seconds. The size and spacing of the waterplane, however, result in relatively large heave and pitch seakeeping characteristics. When employed for drilling operations, as illustrated in FIG. 3, a single drilling riser 316 extends between the superstructure 302 and a drilling template 318 on the seafloor 320. The drilling riser 316 may be disconnected during periods of large motions. In production operation, top tensioned steel risers are generally not employed due to the relatively large motions experienced by a semi-submersible. Instead flexible risers are generally used whenever water depth permits. Otherwise, steel catenary risers might be feasible for greater depths.

Spar Buoy

A spar buoy provides an example of a self-stabilizing floating structure employing an arrangement wherein the center of buoyancy (CB) is above the center of gravity (CG) to provide stability. FIG. 4 illustrates an exemplary spar buoy 400 comprising a drilling and production superstructure 402 positioned on a single columnar hull 404 structure, typically extending more than six hundred feet below the water surface. The relatively large hull profile in the wave zone, induces relatively large environmental forces in the lateral direction. A spar buoy, therefore, has relatively large requirements for a station keeping system. A spread pattern of conventional catenary mooring lines 406 may be employed to perform station keeping. The mooring lines 406 are run through fairleads 408 generally placed near the center of buoyancy (CB), extending in a catenary shape to anchors or piles 410 at the seafloor 320. The size of the waterplane may be relatively small, as a spar buoy does not heavily rely on waterplane area for stability. Despite a small waterplane, the length of the hull 404 must be long enough to provide sufficient fixed ballast mass and added mass such that the heave natural period is more than twenty seconds to provide a relatively small heave seakeeping characteristic. Spar buoys are, however, subject to relatively large pitch seakeeping characteristics, in addition to relatively large lateral excursions. When employed for production and drilling operations, as illustrated in FIG. 4, risers 412 extend between the superstructure 402 and a template 414 on the seafloor 320. Riser weight may be supported by buoyancy tanks (not shown) along the length of the risers 412, in an open well in the center of the hull 404 protected from waves.

Tendon-Based Floating Structures

Tension Leg Platform

A Tension Leg Platform (TLP) provides an example of a floating structure employing a marine tendon system to augment stability. FIG. 5 illustrates an exemplary TLP 500 comprising a drilling and production superstructure 502 positioned on a hull structure 504. The hull structure 504 is a semi-submersible type, comprising multiple columns 506 upon submerged pontoons 508 which provide the required buoyancy. A configuration of rigid tendons 510 is attached between the base of the columns 506 and a tendon template 512 at the seafloor 320. The center of gravity (CG) of a TLP, like other semi-submersibles, is above the center of buoyancy (CB). The required stability may, therefore, be provided by wide spacing between the waterplane area of the columns 506. In a tow condition, a TLP may be self-stabilizing. In operation condition, however, a TLP is generally dependent upon tendons to augment stability. Pretension is applied to the rigid tendons 510 generally in the range of twenty to thirty-five percent of the TLP's 500 displacement. Pretension increases stability by lowering the effective center of gravity (CG) and greatly increasing the vertical stiffness. This reliance upon tendons to augment stability may, however, result in relatively large tension variations in the rigid tendons 510 during operation. The required vertical stiffness may be on the order of 2,000 tons per foot to provide a heave natural period of three to five seconds. The hull profile in the wave zone is still relatively large, inducing relatively large environmental forces in the lateral direction. Tendons alone may, nonetheless, be sufficient to perform station keeping. Despite having relatively large lateral excursions, unlike a semi-submersible, a TLP generally has very small heave and pitch seakeeping characteristics. When employed for production and drilling operations, as illustrated in FIG. 5, risers 514 extend between the superstructure 502 and a template 516 on the seafloor 320. Riser weight may be supported by conventional hydraulic or hydro-pneumatic tensioners, due to the small motions of a TLP. The performance of the TLP is generally superior to other options. The cost of construction and installation, however, have relegated its usage to large petroleum deposits. Further, the TLP has generally been seen as having a viable depth limit due to the increasing costs and complications associated with using rigid tendons.

Mini-Tension Leg Platform

A Mini-Tension Leg Platform (Mini-TLP) provides an example of floating structure employing a marine tendon system to provide stability without being self-stabilizing. Mini-TLP designs have been developed in an attempt to take advantage of the performance of a TLP at a lower cost. FIG. 6 illustrates an exemplary Mini-TLP 600 comprising a drilling and production superstructure 602 positioned on a hull structure 604. The hull structure 604 is a single column 606 upon a single submerged pontoon 608 which provides the required buoyancy. Outriggers 610 are attached about the column 606 and pontoon 608. Rigid tendons 612 are attached between the outriggers 610 and a template 614 at the seafloor 320. The center of gravity (CG) of a Mini-TLP, like a full-sized, semi-submersible type TLP, is above the center of buoyancy (CB). The waterplane area, however, may be insufficient to supply any significant amount of stability. Instead, stability is derived almost wholly from the tension in the rigid tendons 612 applied through the lever arm created by the outriggers 610. Again, this may result in relatively large tension variations in the rigid tendons 612 during operation. The size of the waterplane area is smaller than that of a conventional TLP, reducing the environmental forces in the heave direction. The hull profile in the wave zone is also smaller, reducing the environmental forces in the lateral direction. The heave natural period of a Mini-TLP may therefore be allowed to be longer than that of a TLP due to the reduced environmental loading. The heave natural period might be permitted to increase to slightly more than five seconds. Tendons 612 are generally sufficient to perform station keeping. A Mini-TLP is generally not as stable as a full-sized, semi-submersible type TLP. This has the consequence of reducing the allowable superstructure and payload weight to retain acceptable heave and pitch seakeeping characteristics, while simultaneously retaining acceptable tendon tensions. When employed for production and drilling operations, as illustrated in FIG. 6, it has also been claimed that due to the small relative motions between the base of the pontoon 608 and the risers 616, submerged linear spring tensioners 618 may be employed. Otherwise, steel catenary risers (not shown) attached at the base of the pontoon 608 and extending in a catenary shape to the seafloor 320, may be employed. The performance and economy of the Mini-TLP design has been demonstrated. The limitation on superstructure weight, however, has heretofore relegated its usage to relatively small petroleum deposits. Further, the Mini-TLP is also felt to have a viable depth limit due to the increasing costs associated with using rigid tendons.

Tension Buoyant Tower

A Tension Buoyant Tower (TBT) provides an example of a cross-over structure employing a marine tendon system. FIG. 7 illustrates an exemplary TBT 700 essentially comprising a production superstructure 702 having a work-over rig 704 positioned on hull structure 706. The hull structure 706 is basically a truss type spar buoy hull comprising a single column 708 upper portion above a submerged truss 710 portion with a bottom portion 712 filled with solid ballast. The column portion 708 provides the required buoyancy. The truss 710 and bottom portion 712 provide fixed ballast and added mass. One or more rigid tendons 714 are attached between the hull 706 and a template 716 at the seafloor 320. The center of buoyancy (CB) is above the center of gravity (CG), providing the required stability. The waterplane area and rigid tendon(s) 714 further augment stability. The hull profile in the wave zone is similar to that of a spar buoy; however, rigid tendon(s) 714, rather than mooring lines, are employed to perform station keeping. As a result of employing rigid tendon(s) 714, the heave natural period has been disclosed as less than five seconds, while all other natural periods of motion remain above twenty seconds. Like spar buoys, a TBT may be subject to relatively large lateral excursions and pitch seakeeping characteristics. The primary benefit claimed is the reduced complexity of the station keeping system over a conventional spar buoy. The allowable superstructure weight is also generally seen to be limited. The TBT is generally seen as most economical for small field production operations, functioning essentially as a single buoyancy tank used to support the weight of multiple risers. As illustrated in FIG. 7, risers 718 extend between the superstructure 702 and the template 716 at the seafloor 320. Riser weight is supported by the buoyancy of the hull 706.

Two important lessons may be appreciated from the above discussion of prior art structures. It is generally desirable for a floating structure to have minimal waterplane area to reduce wave induced heave and pitch motions and to reduce the magnitude of wave induced tensions in the tendons. It is also generally desirable for a floating structure to have a minimum vertical cross-sectional area, or hull profile, in the wave zone to reduce the magnitude of wave induced lateral excursion and reduce the requirements for station keeping systems. In response to these lessons, prior art floating structures have been developed having both minimal waterplane areas and relatively small hull profiles in the wave zone.

Minimal Waterplane and Hull Profile Floating Structures

Truss Mini-Tension Leg Platform

A Mini-Tension Leg Platform (Mini-TLP), such as that illustrated in FIG. 6, provides an example of a minimal waterplane and hull profile floating structure. Other designs have been developed employing truss rather than column structures in the wave zone. A truss structure is generally accepted as the preferred support structure for supporting weight while having minimal wave loading. The truss is the paradigmatic structure used for fixed platforms in shallow water. FIG. 8 illustrates an exemplary Truss Mini-TLP 800 comprising a production superstructure 802 supported by a cross-braced truss support structure 804 above a submerged pontoon 806. The pontoon 806 provides the required buoyancy. Rigid tendons 808 are attached between the outer edge of the pontoon 806 and a template 810 at the seafloor 320. The ceriter of gravity (CG) of a Truss Mini-TLP is generally well above the center of buoyancy (CB). Having virtually no waterplane area, stability is derived almost exclusively from the rigid tendons 110 and the lever arm created by the width of the pontoon 806. The heave natural period of a Truss Mini-TLP is similar to that of other Mini-TLP's. The profile of the hull in the wave zone is small, greatly reducing the size of environmental forces in the lateral direction. The distance below the water surface at which the pontoon 806 may be placed is, however, limited by the ability of the rigid tendons 808 to offset the decreased stability as the center of buoyancy (CB) and center of gravity (CG) diverge. The allowable weight of the superstructure and payload is likewise limited. When employed for production and drilling operations, as illustrated in FIG. 8, a riser configuration similar to that of other Mini-TLP designs may be employed. The Truss Mini-TLP also is generally felt to have a viable depth limit due to the increasing costs associated with using rigid tendons.

Floating Jacket

A design known as Floating Jacket provides an example of a non-tendon based, minimal waterplane and hull profile floating structure. FIG. 9 illustrates an exemplary Floating Jacket 900 comprising a production superstructure 902 having a work-over rig 904 supported by a cross-braced truss support structure 906 above a deeply submerged hull structure 908. The hull structure 908 provides the required buoyancy. Mooring lines 910 attached between the hull structure 908 and the seafloor 320 are run through fairleads 912 near the center of buoyancy (CB). The Floating Jacket is a self-stabilizing floating structure. Having virtually no waterplane area, stability is derived from placement of the center of gravity (CG). Given the wide separation of superstructure weight and the center of buoyancy (CB), significant fixed ballast weight is required. A portion of the hull located a distance below the center of buoyancy (CB) is filled with solid ballast such as concrete or other negatively buoyant material. The quantity of solid ballast weight and distance of placement below the center of buoyancy (CB) must be sufficient to counterbalance the superstructure, payload, and other weight above the center of buoyancy (CB). The natural periods of motion in all degrees of freedom is generally much longer than that of other prior art floating structures, most notably, the heave natural period is disclosed as being from eighty-five to over one hundred seconds. The profile of the hull in the wave zone is practically negligible, as the hull structure may be submerged completely beyond the wave zone, greatly reducing the size of environmental forces in the lateral direction. The allowable weight of the superstructure and payload is limited only by the cost of adding additional fixed and solid ballast. The seakeeping characteristics of the Floating Jacket are generally superior to other prior art structures. The Floating Jacket has very small dynamic motion seakeeping characteristics in surge and pitch. Only heave motions are significant, though still much less than that of other floating structures such as a semi-submersible.

While a promising concept, the Floating Jacket did not address three concerns which prevented industry acceptance. First, as a result of the minimal waterplane area, the vertical stiffness of the Floating Jacket is too small to be practical. The vertical stiffness is on the order of several tons per foot, making the Floating Jacket unsuitable for drilling. As a general rule, it is desirable to have a minimum of one hundred tons per foot vertical stiffness to allow drilling operations. Additionally, such a low vertical stiffness may allow severe draft changes when superstructure payload changes are made. A helicopter landing may cause the superstructure to rapidly submerge several feet. Rapid, large amplitude draft changes are generally unacceptable. Rapid draft changes are extremely detrimental to stability in structures dependent upon the reversed pendulum effect for stability. In addition, risers 914 connected between the superstructure 902 and at a template 916 at the seafloor 320 employ tensioning systems (not shown) to prevent riser buckling. The risers 904 must remain in tension at all times during operation. Tensioning systems are most sensitive to draft changes. Rapid, large amplitude draft changes greatly increase riser fatigue and could result in catastrophic riser buckling. Second, while dynamic pitch motions are small, the static pitch angle under strong wind may be excessive. The long distance between the superstructure 902 and center of buoyancy (CB) result in large pitch moments from wind forces on the superstructure. The righting moment to pitch is generally limited to the reversed pendulum effect of the center of gravity (CG) about the center of rotation. Mooring lines 910 provide insignificant righting moments, as they are located near the center of buoyancy (CB). This placement is required due to loop current concerns. Placement of the mooring lines at a location other than the center of buoyancy (CB) would have the mooring lines themselves inducing an overturning moment when the hull is subjected to current. Finally, installation of the Floating Jacket would be difficult and expensive. The Floating Jacket is stable in the installed condition, but stability may be a concern during installation operations; the length of the hull and truss may require their assembly in multiple pieces offshore; and the low vertical stiffness and deep submergence of buoyancy makes setting a heavy superstructure difficult.

As can be appreciated from the foregoing discussion of prior art structures, many attempts have been made to solve a basic conflict between stability and seakeeping where a floating platform is employed to support a superstructure above a water surface. It is convenient and desirable to place buoyancy at or near the water surface for stability reasons. Large waterplane area and hull profile, however, induce undesirable large amplitude wave forces to produce large motions and station keeping system requirements. One solution is to submerge the buoyancy, as the dynamic wave forces decrease exponentially with water depth. As much as three quarters of such hydrodynamic forces occur in the upper one hundred feet nearest the water surface. Prior attempts at floating structures employing submerged buoyancy have encountered various performance limitations. Prior tendon-based floating structures may be subject to depth and superstructure weight limitations generally incident to Mini-TLP configurations. Further, these floating structures may be subject to sensitivity to the addition of superstructure, payload, and hull weight in order to retain a heave natural period of motion below that of the primary wave period. Prior non-tendon based floating structures may be subject to operational limitations related to small vertical stiffness and the lack of available righting moments. Further, these floating structures also may encounter difficulty and high cost in installation.

SUMMARY

In general, in one aspect, the invention relates to a floating offshore structure comprising a buoyant hull which contains sufficient fixed ballast to place the center of gravity of the floating structure below the center of buoyancy of the hull. A support structure coupled to an upper end of the hull supports and elevates a superstructure above the water surface. A soft tendon has a first end attached to the hull and a second end attached to the seafloor. A vertical stiffness provided by the soft tendon results in the floating structure having a heave natural period of at least twenty seconds.

In general, in another aspect, the invention relates to a hull for a floating offshore structure comprising a positively buoyant upper portion connected to a negatively buoyant lower portion. The lower portion contains a sufficient amount of fixed ballast to place a center of gravity of the floating offshore structure below a center of buoyancy of the floating offshore structure. At least one soft tendon having a first end attached to the lower portion of the hull and a second end attached to the seafloor, wherein a vertical stiffness provided by the tendon results in the floating offshore structure having a heave natural period of at least twenty seconds.

In general, in another aspect, the invention relates to a station keeping arrangement for a floating offshore structure comprising a buoyant hull which contains sufficient ballast to place a center of gravity of the floating offshore structure below a center of buoyancy of the floating offshore structure. A tendon connector is attached to the hull. At least one soft tendon having a first end attached to the tendon connector and a second end attached to a seafloor provides a vertical stiffness which results in the floating offshore structure having a heave natural period of at least twenty seconds.

In general, in another aspect, the invention relates to a method of installing a floating offshore structure comprising providing a single caisson buoyant hull having a support structure coupled thereto, and towing the hull and support structure in a vertical orientation to a predetermined offshore location, the hull floating on or near a water surface during the towing and providing sufficient waterplane area to maintain stable floatation of the floating offshore structure. The method further comprises adding ballast to the hull to submerge the hull below a water surface such that a center of gravity of the floating offshore structure is below a center of buoyancy of the floating offshore structure.

In general, in another aspect, the invention relates to a method of station keeping for a floating offshore structure including a buoyant hull, a support structure, and a superstructure. The method comprises adding sufficient ballast to the hull to place a center of gravity of the floating offshore structure below a center of buoyancy of the floating offshore structure, and attaching a first end of a soft tendon to the hull and a second end of the tendon to a seafloor, wherein a vertical stiffness provided by the tendon results in the floating offshore structure having a heave natural period of at least twenty seconds.

Other aspects of the invention will be apparent from the following description and the appended claims.

DETAILED DESCRIPTION

The following embodiments are illustrative only and are not to be considered limiting in any respect.

Figure 1:
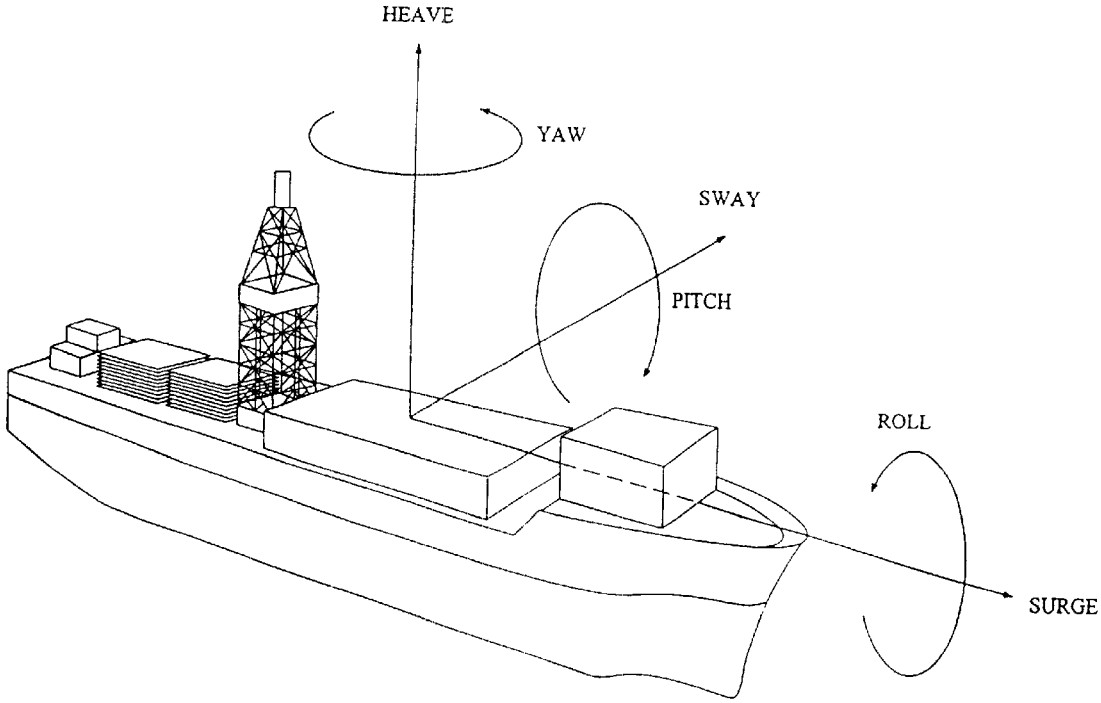
FIG. 1 (Prior Art)
FIG. 1 illustrates a coordinate convention used to denote motions and displacements for floating structures.
Figure 2A:
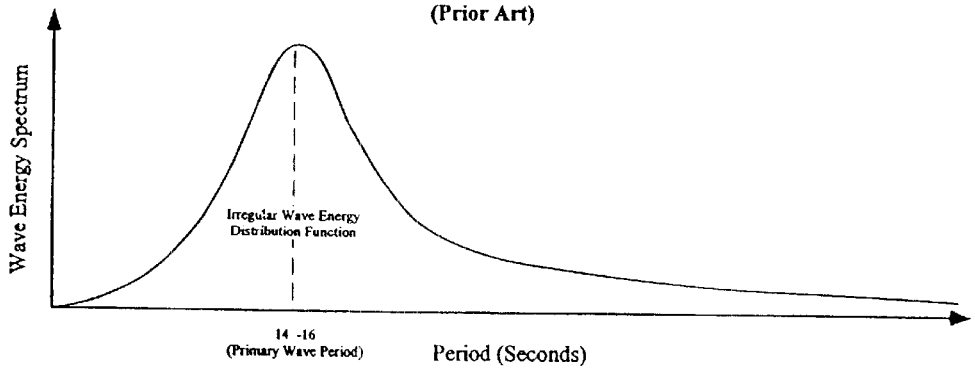
FIG. 2(a) (Prior Art)
FIGS. 2(*a*)–(*c*) illustrate a generalization of a frequency spectrum response analysis for a floating structure.
Figure 2B:
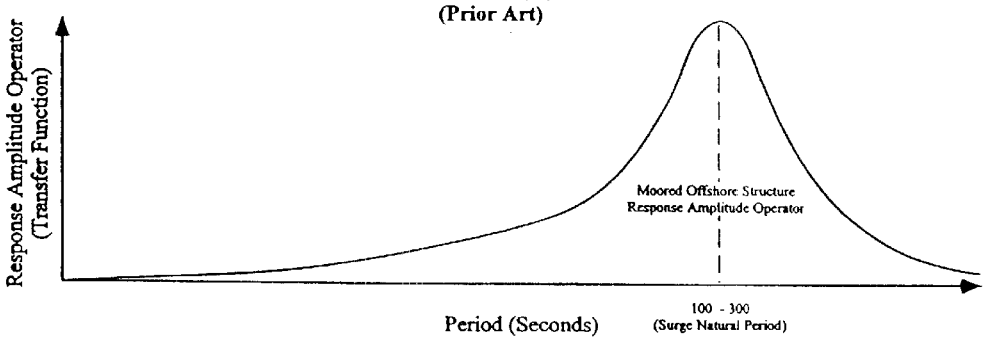
FIG. 2(b) (Prior Art)
Figure 2C:
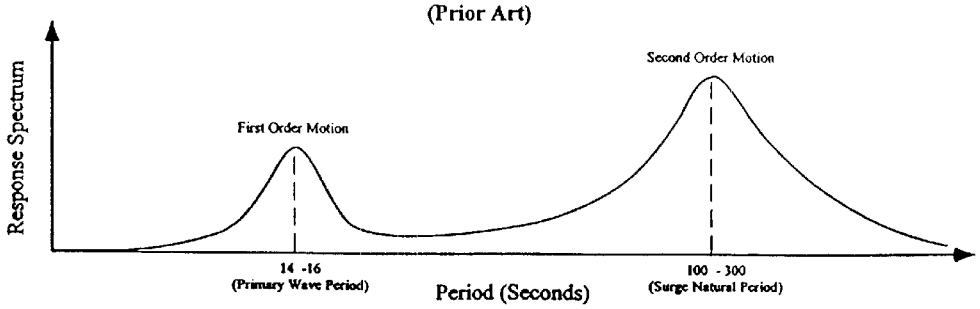
FIG. 2(c) (Prior Art)
Figure 3:
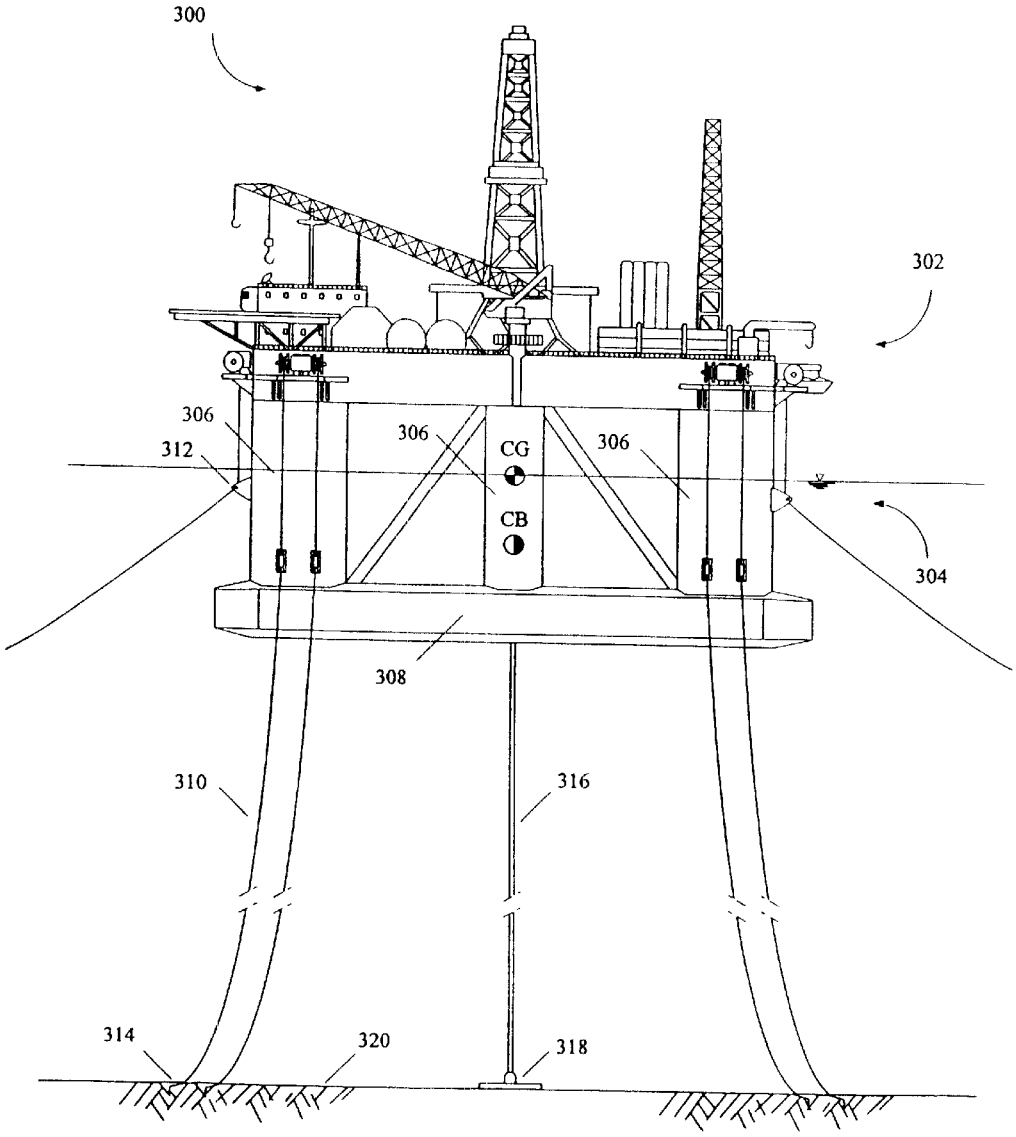
FIG. 3 (Prior Art)
FIG. 3 illustrates an outboard profile of a semi-submersible floating structure.
Figure 4:
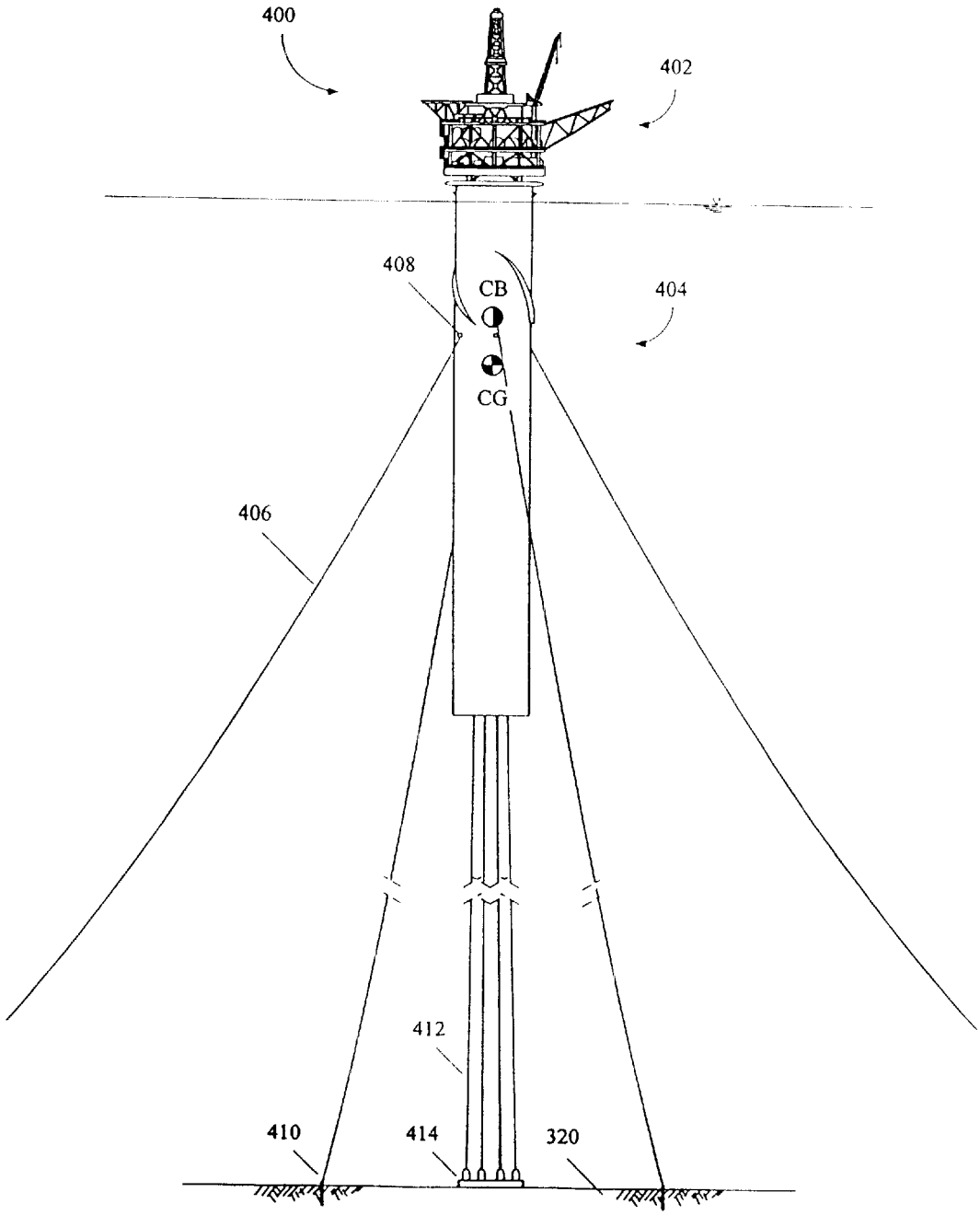
FIG. 4 (Prior Art)
FIG. 4 illustrates an outboard profile of a spar buoy floating structure.
Figure 5:
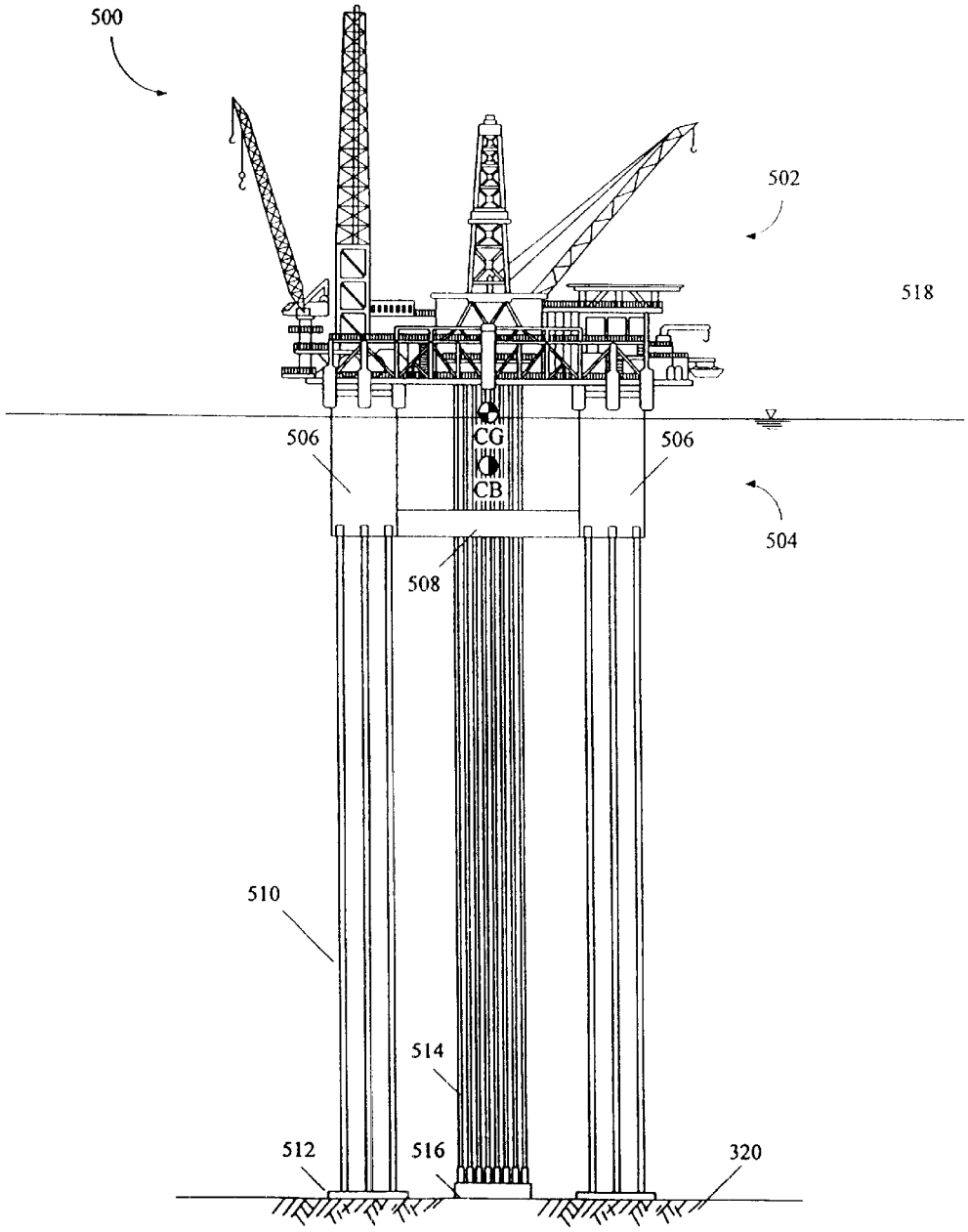
FIG. 5 (Prior Art)
FIG. 5 illustrates an outboard profile of a tension leg floating structure.
Figure 6:
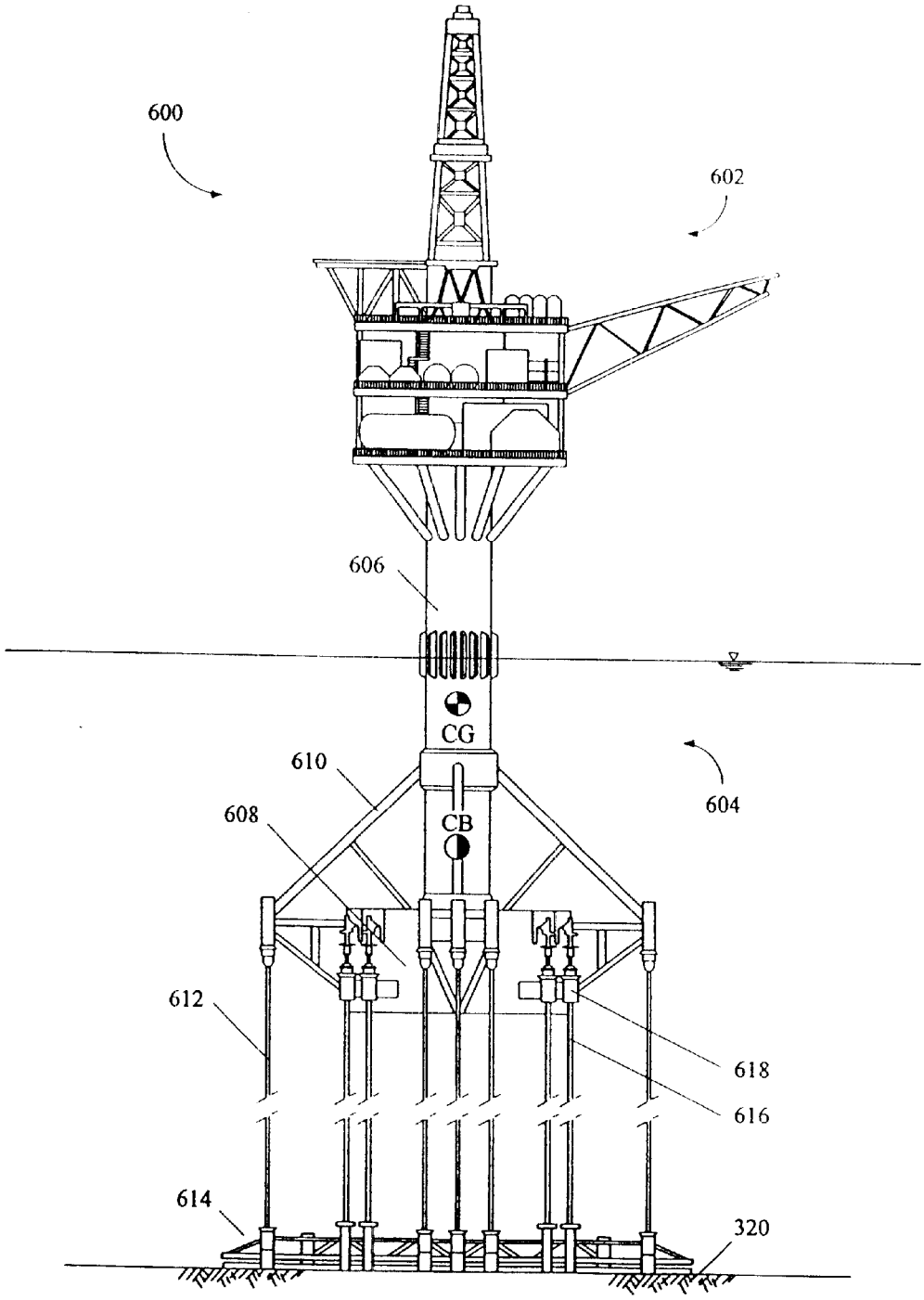
FIG. 6 (Prior Art)
FIG. 6 illustrates an outboard profile of a single column mini-tension leg floating structure.
Figure 7:
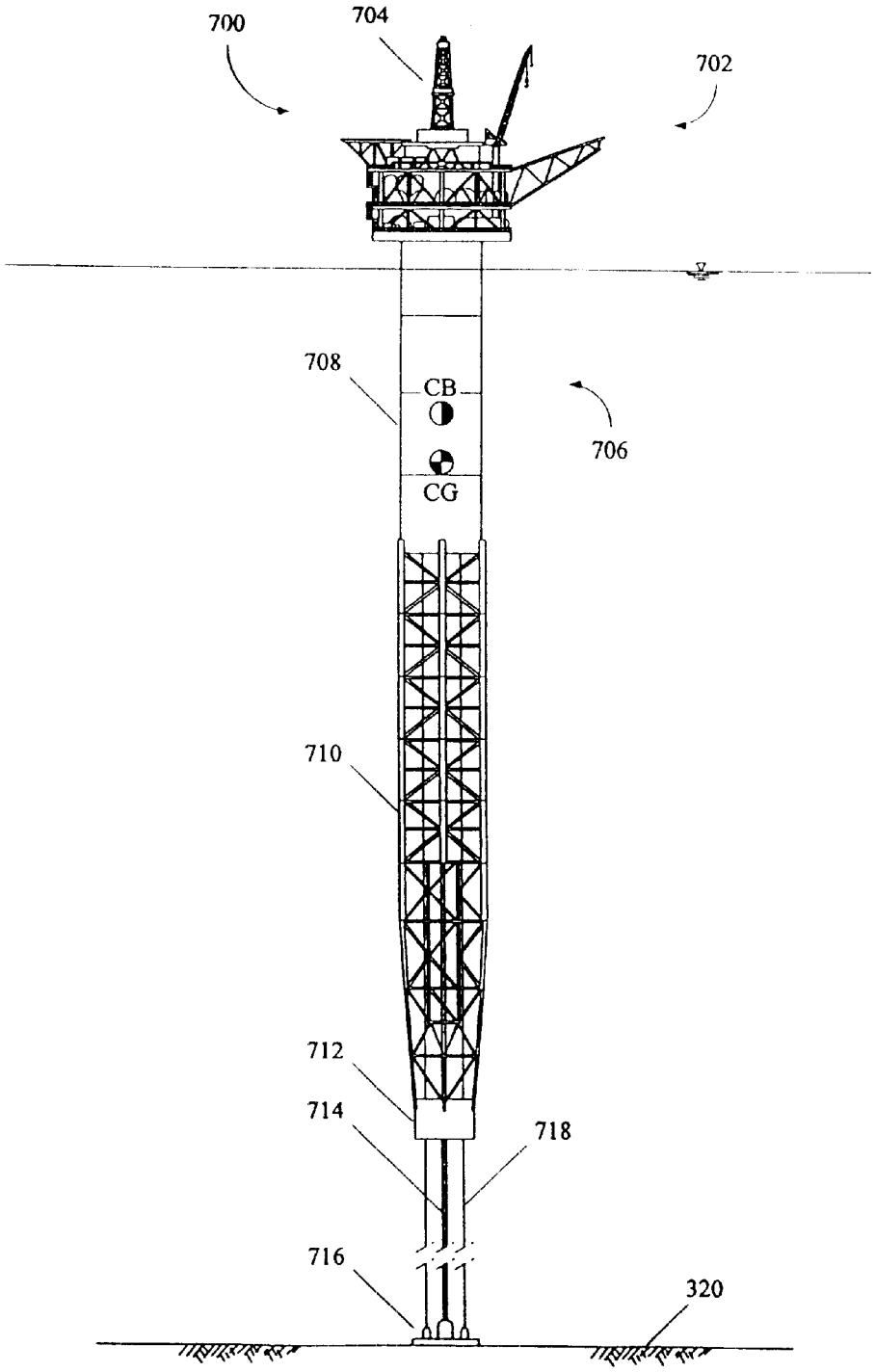
FIG. 7 (Prior Art)
FIG. 7 illustrates an outboard profile of a tension buoyant tower floating structure.
Figure 8:
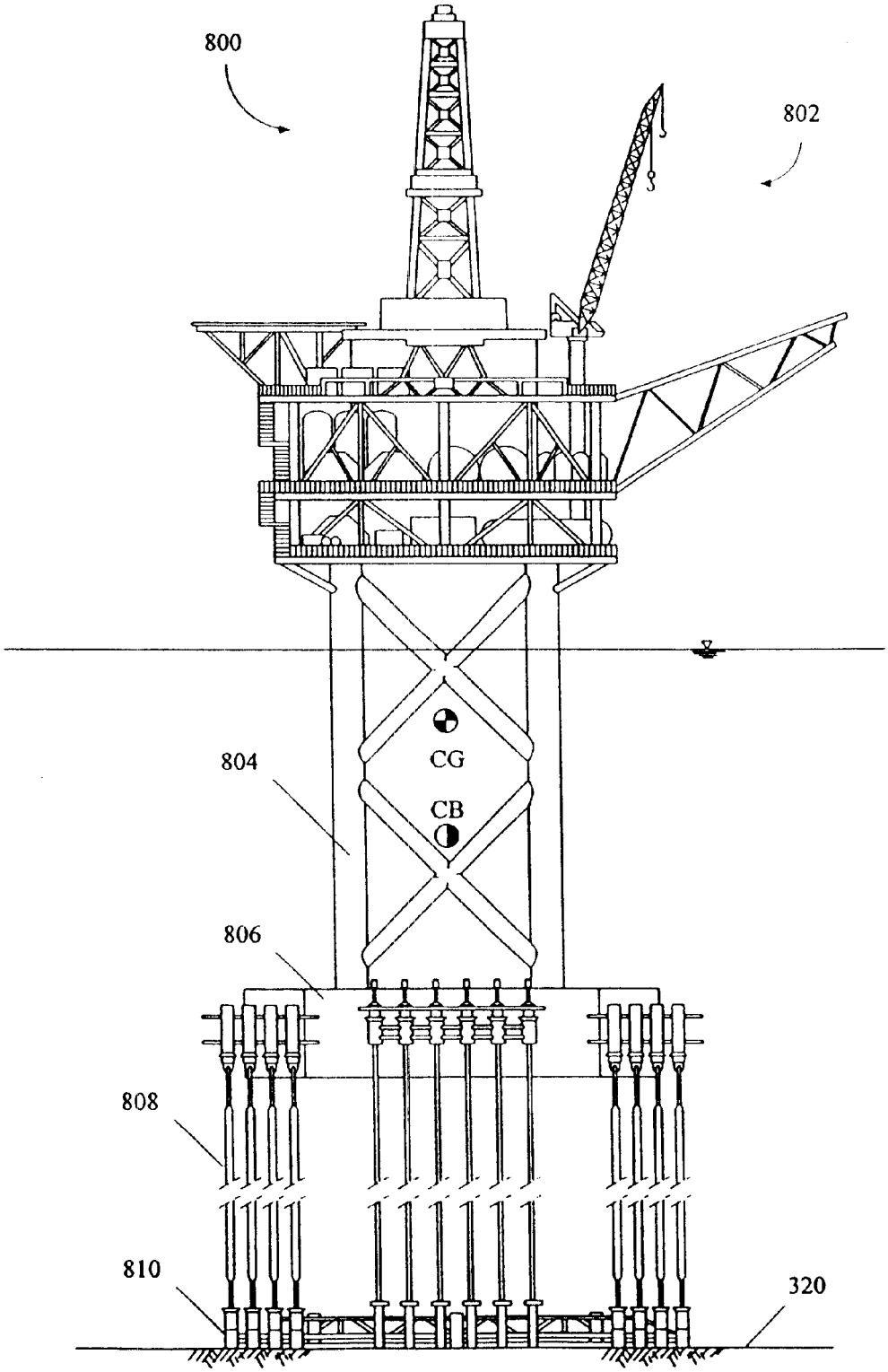
FIG. 8 (Prior Art)
FIG. 8 illustrates an outboard profile of a truss mini-tension leg floating structure.
Figure 9:
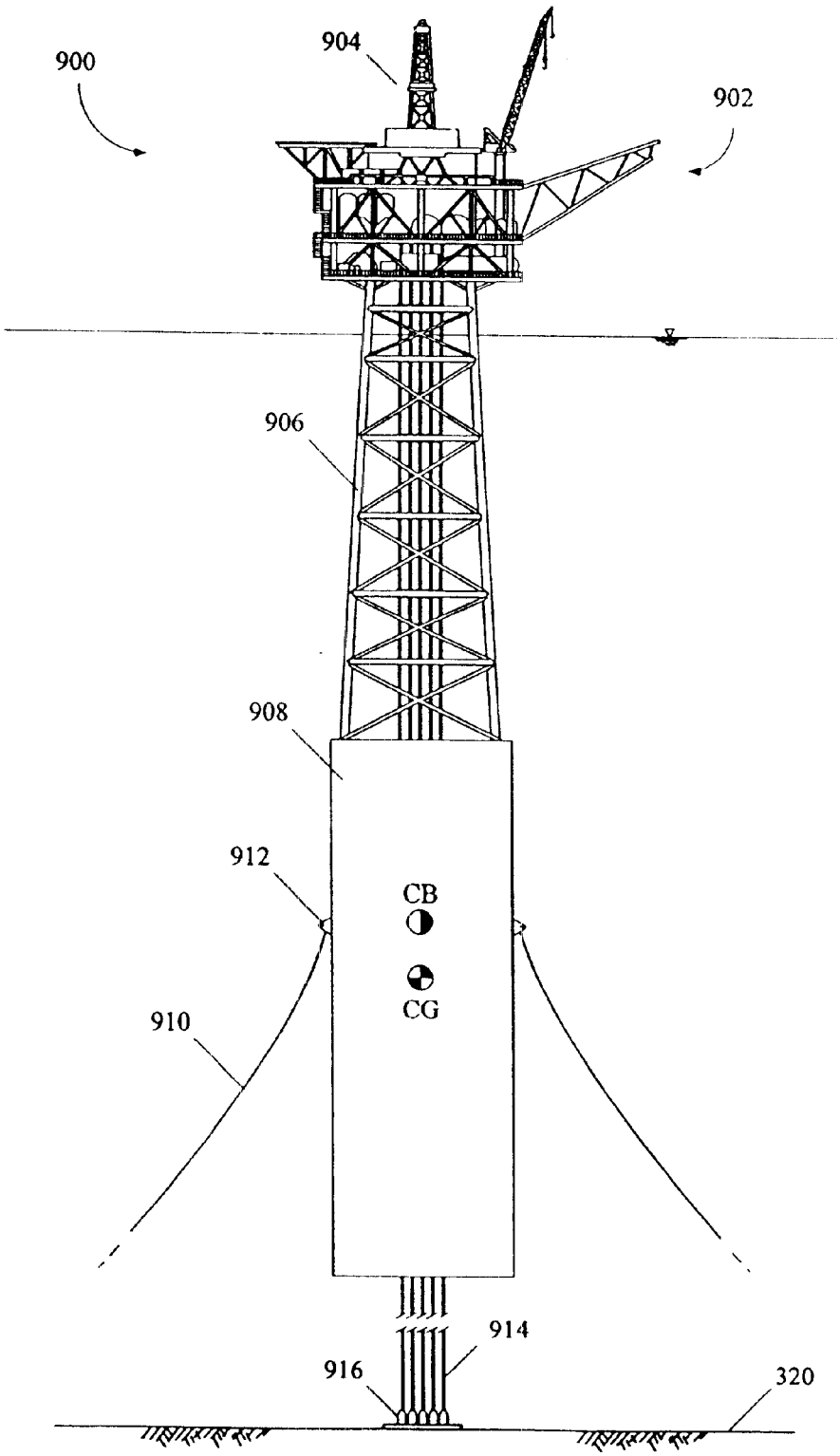
FIG. 9 (Prior Art)
FIG. 9 illustrates an outboard profile of a floating jacket type floating structure.
Figure 10:
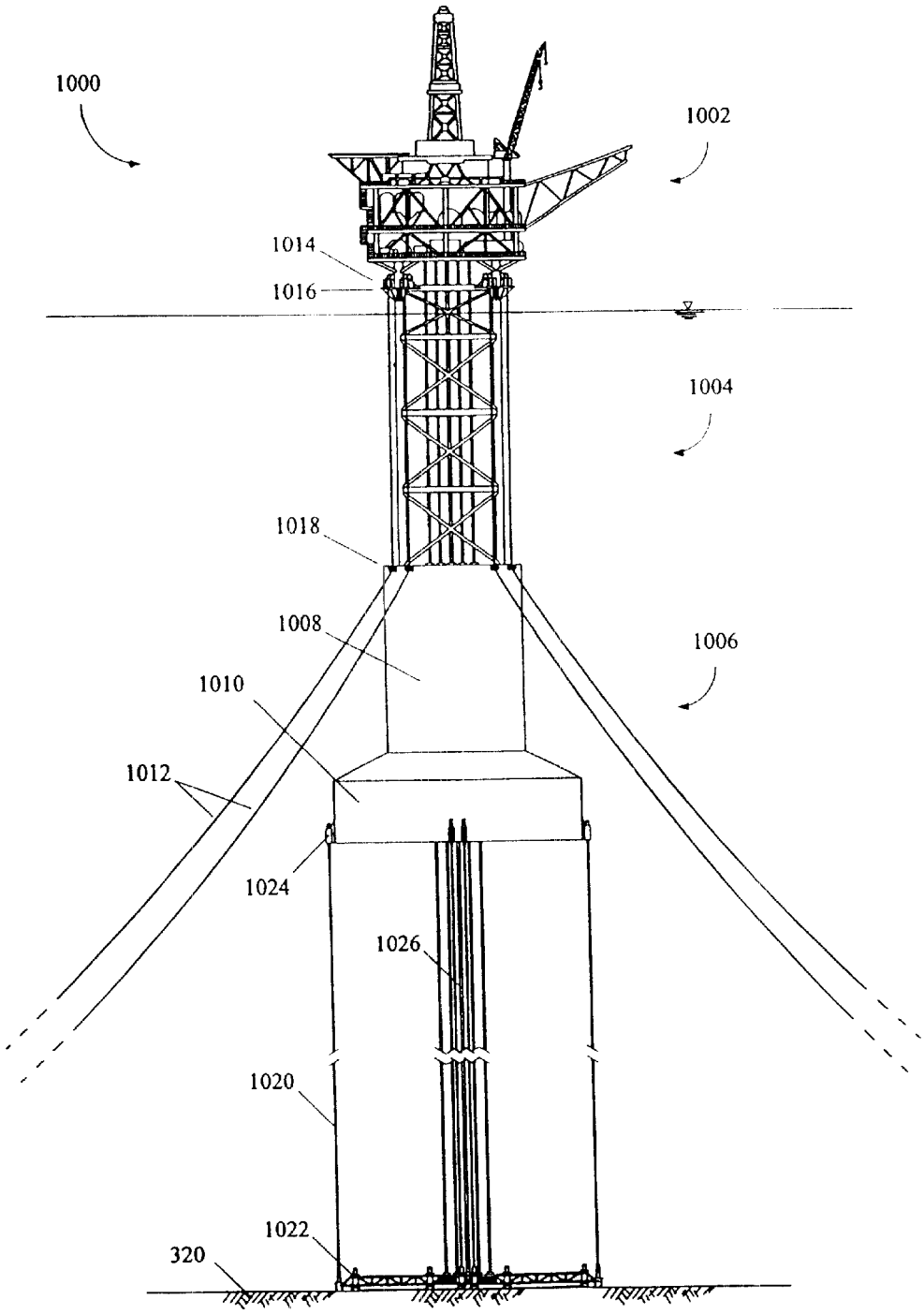
FIG. 10 illustrates an outboard profile of a floating structure in accordance with an embodiment of the invention employing a soft tendon system, mooring lines, and risers.

Referring to FIG. 10, a floating structure 1000 is illustrated in outboard profile in an installed operation condition. The floating structure 1000 comprises a superstructure 1002 elevated above the water surface upon a support structure 1004. The support structure 1004 extends a distance below the water surface and engages a submerged hull structure 1006. The hull structure 1006, as shown, is generally columnar, having a narrowed upper portion 1008 and an enlarged lower portion 1010. A spread mooring system is employed consisting of mooring lines 1012 connected between the superstructure 1002 and the seafloor 320. The mooring line handling equipment 1014 is located on a sub-cellar deck 1016 below the superstructure 1002. The mooring lines run from the sub-cellar deck 1016 down through fairleads 1018 located at an upper end of the hull structure 1004 in a catenary shape. A marine tendon-like system is employed consisting of soft tendons 1020 connected between the hull structure 1006 and a template 1022 on the seafloor 320. The soft tendons 1020 attach to the hull structure 1006 at tendon connectors 1024. As shown, the superstructure 1002 is equipped for petroleum drilling and production operations. Risers 1026 are attached between the superstructure 1002 and the template 1022 at the seafloor 320. The floating structure 1000 is selfstabilizing. The support structure 1004 provides a relatively small waterplane, adding only a small portion of the required stability. Instead, stability is primarily provided by location of the center of gravity (CG) below the center of buoyancy (CB).

Selection of a support structure design is primarily a function of providing structural strength, while retaining a relatively small waterplane area and profile. As shown, the support structure 1004 is a conventional cross-braced truss structure commonly employed for fixed offshore oil superstructures. This classic support structure design has long been employed to provide a small hydrodynamic signature for a given structural strength. In other words, waves and current pass through the truss, inducing only small hydrodynamic forces upon the truss structure. The truss profile is relatively small for reduced hydrodynamic forces in the surge direction. The waterplane area is also relatively small for reduced hydrodynamic forces in the heave direction. By way of example, the vertical stiffness provided by the waterplane area of such a support structure may be as low as five tons per foot for a truss support structure supporting the weight of a five thousand ton superstructure two hundred feet above a submerged hull structure. The arrangement and design of a support structure is subject to wide variation. As a guideline, however, it is desirable for hydrodynamic reasons that the horizontal cross-sectional area of the support structure 1004 be roughly an order of magnitude or more smaller than the horizontal cross-sectional area of the submerged hull structure 1006. For example, if a submerged hull structure has a cross-section area correlating to displacement of two hundred tons per foot, then it would be desirable to design a support structure having a cross-sectional area roughly correlating to a displacement of twenty tons per foot or less.

Selection and arrangement of a station keeping system for a given floating structure is generally based upon design environmental criteria for a given seakeeping performance of the floating structure. The axial stiffness of the soft tendon system for the present floating structure, however, substantially affects seakeeping performance. The tendon constructions are, therefore, primarily selected and arranged to provide the desired vertical stiffness. Vertical stiffness, as aforementioned, is increased to provide practical performance enhancements. The magnitude of the increase in vertical stiffness above that of the support structure waterplane, however, is limited such that the heave natural period of the floating structure remains above the peak wave period. It is generally desirable for the heave natural period to be in the range of thirty to forty seconds. As a general rule, the lower limit would be approximately twenty to twenty-five seconds for Gulf of Mexico operations. This lower limit might be acceptably exceeded, however, where means are provided to allow the floating structure to have multiple heave natural periods, such as that disclosed below in reference FIGS. 22(*a*)–(*b*) and FIGS. 23(*a*)–(*c*). There is no upper limit required on heave natural period. Once the desired heave natural period is selected, the required vertical stiffness may then be calculated in a manner such as previously discussed. Rather than conventional rigid tendon constructions employing large diameter steel pipe, the relatively small stiffness required allows a simplified and inexpensive construction. In one embodiment, conventional sheathed spiral strand wire rope of relatively small diameter is employed. The diameter required may be selected by first selecting the number of soft tendons desired; the diameter may then be calculated based upon the length of soft tendon required by water depth. Selection of soft tendon construction is subject to variation; other known constructions may provide the required stiffness. Other possibilities include synthetic rope or other elastic materials and conventional rigid tendons or other stiffer soft tendon constructions employed in combination with the elastomer tendon connection as disclosed below in reference to FIGS. 22(*a*)–(*b*) and FIGS. 23(*a*)–(*c*). A combination of wire and synthetic rope may also be employed. Synthetic rope is generally less stiff and capable of much greater elongation. The combined stiffness of wire and synthetic rope allows great flexibility to a designer, and the extended elongation of synthetic rope can permit safe operation in relatively shallow waters without over-stressing the tendons.

Having selected a soft tendon system, the seakeeping performance of the floating structure becomes calculable. Environmental criteria may now be examined to allow selection of any additional station keeping systems that may be required. By way of example, in the Gulf of Mexico, station keeping systems are generally selected and arranged based upon two design environmental conditions: a one hundred year hurricane condition and a one hundred year loop current condition. The hurricane condition involves large waves and strong winds. The majority of hydrodynamic forces on a floating structure from waves generally occur in the wave zone—the upper one hundred to one hundred fifty feet of water. The forces from wind generally apply on the superstructure. The loop current condition involves the lateral movement of water that may be generally constant from the surface on down to a depth exceeding the draft of the floating structure.

Under the hurricane condition, wind and waves combine to produce surge forces and overturning moments on the floating structure. Submergence of the hull structure 1006 partially through or completely below the wave zone and employing a support structure 1004 through this region greatly reduces the magnitude of wave induced forces. Wind forces acting on the superstructure 1002 above the water surface, however, may induce surge forces and overturning moments. Most significant is the overturning moment due to the large distance between the superstructure and center of buoyancy (CB). Under the loop current condition, water current primarily produces surge forces and overturning moments in the opposite direction of the wind induced overturning moments incident to hurricane conditions. Most significant is the surge force from the current generally applying near or below the center of buoyancy (CB). The dual environmental conditions may thereby provide two potentially competing requirements: reduce static pitch incident to the hurricane condition and reduce lateral excursions incident to the loop current condition.

As the superstructure undergoes lateral excursion, tendon tension provides increasing restoring forces to oppose environmental surge forces. Location of the soft tendons 1020 at the outer edge of the enlarged lower portion 1010 of the hull structure 1006 provides a lever arm of the diameter of the enlarged lower portion. The soft tendon system thereby augments stability and provides righting moments to counter environmental overturning moments. In certain applications, the reverse pendulum affect of the self-stabilizing hull and tendons may provide sufficient station keeping performance without the addition of other station keeping systems. Where required, however, supplemental station keeping systems may be employed. In one embodiment, a conventional catenaxy mooring system is also employed to reduce lateral excursions. In addition, the fairleads 1018 are placed above the center of buoyancy (CB) to provide a righting arm to oppose overturning moments. Where mooring systems are employed alone, the dual environmental condition generally prevents such placement. Higher fairlead placement may reduce static pitch under the hurricane condition, but this placement actually induces static pitch under loop current conditions. The combination of a soft tendon system in conjunction with a mooring system, however, can provide a coupling and balancing effect under both environmental conditions.

Further, the hurricane and loop current conditions are almost mutually exclusive, never occurring simultaneously. The soft tendon system can be employed to take advantage of this fact. Under the loop current conditions, wave loading is generally small resulting in relatively small heave motions and tendon strain. The hull structure can therefore be deballasted to increase tendon pretension closer to the maximum allowable tension. The increased tendon pretension acts to improve the station keeping performance against current forces. Under the hurricane condition, the tendon pretension may be decreased to reduce fatigue in the tendons during the relatively large heave motions incident to hurricane wave forces.

Figure 11:
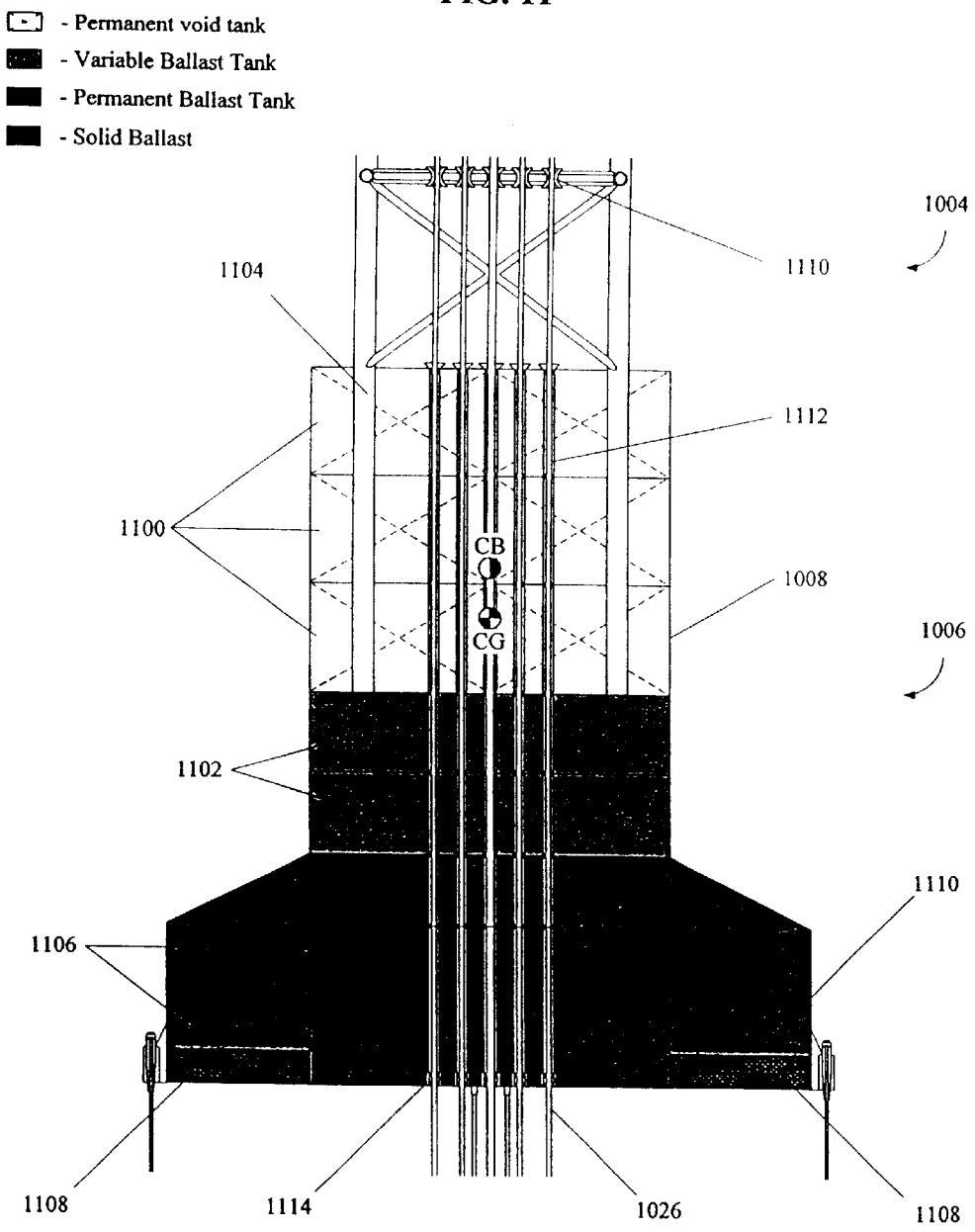
FIG. 11 illustrates an inboard profile of the hull structure of the floating structure of FIG. 10.

Selection of a hull structure design and choosing the depth at which it should be submerged is a function of several concerns. Referring now to FIG. 11, there is shown the floating structure of FIG. 10 in inboard profile. As shown, the hull structure 1006 is columnar, having a circular horizontal cross-sectional shape. This shape is primarily chosen for symmetry to hydrodynamic forces. The cross-sectional shape is subject to wide variation, such as prismatic, square, or other shapes. The hull profile illustrated is selected to provide several advantages. The narrow upper portion 1008 is selected based upon the required buoyancy, balanced against the generally desirable characteristic of a small horizontal cross-sectional area. As shown, the upper portion 1008, is composed of a plurality of permanent buoyancy tanks 1100, located above a plurality of variable ballast/oil storage tanks 1102. Legs 1104 of the support structure 1004 extend down through the permanent buoyancy tanks 1100 to provide access passage and structure strength. The enlarged lower portion 1010 is submerged deeper, generally below the wave zone, relaxing the concern over horizontal cross-sectional area. As shown, the lower portion 1010 is composed of various permanent ballast tanks 1106, and contains an amount of solid ballast 1108. In one embodiment, the solid ballast 1108 is composed of shredded steel scrap encased in concrete. The enlarged diameter acts to increase the added mass of the structure. Further, the enlarged diameter allows widened placement of the solid ballast, increasing stability. Still further, the enlarged diameter facilitates installation of the floating structure 1000 as a single piece, as disclosed below in reference to FIGS. 14–16 and FIGS. 19–21. As shown, risers 1026 extend through the support structure 1004 in guide sleeves 1110, and through the hull structure 1006 in riser sleeves 1112 down to keel sleeves 1114 located at a bottom end of the hull structure 1006. In other embodiments, riser sleeves 1112 may be replaced by the addition of a central well through the hull structure 1006 through which all risers 1022 would extend, and permitting a limited range of angular riser deflection.

It should be noted that the floating structure of FIG. 10 is adaptable to various riser configurations, including top tensioned riser configurations employing conventional hydraulic or pneumatic riser tensioners located at the superstructure level.

Figure 12:
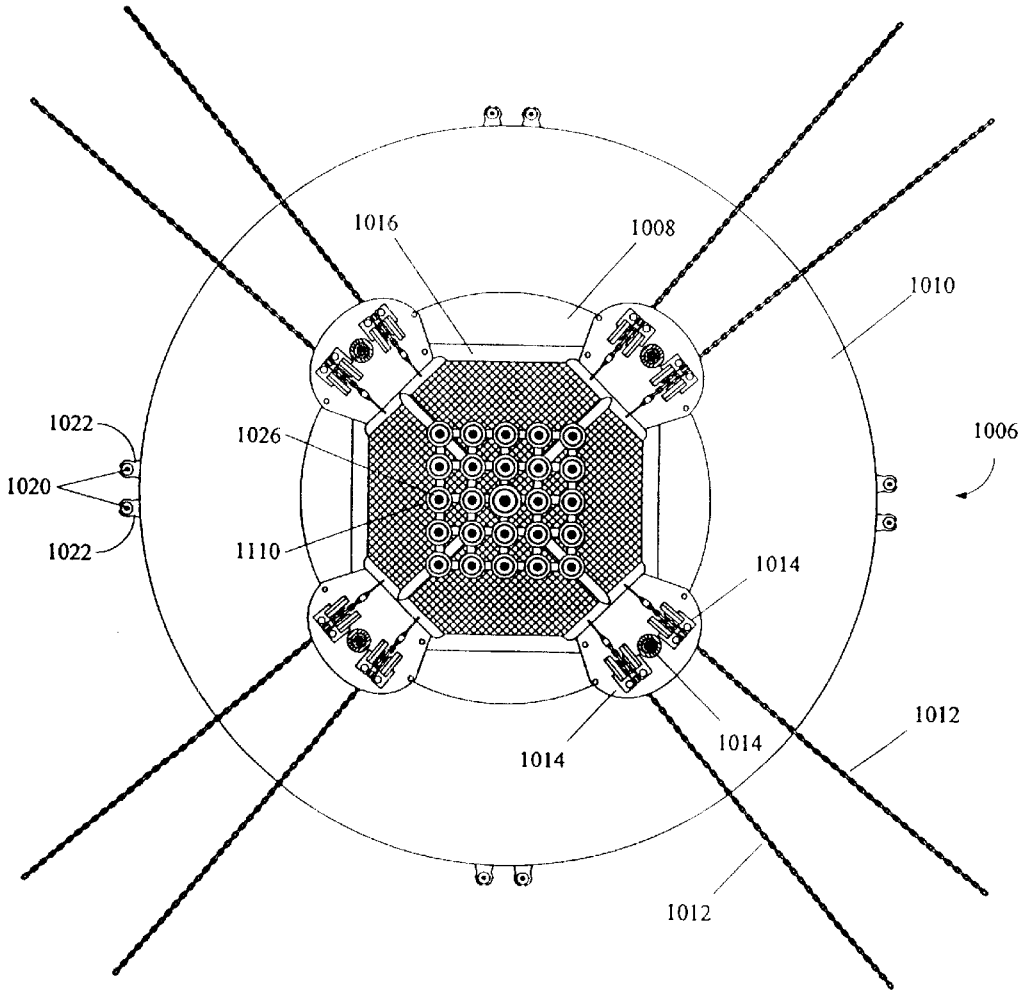
FIG. 12 illustrates a top view of the floating structure of FIG. 10 at a sub-cellar deck level.

Other configurations may also be employed. Referring now to FIG. 12, there is shown a top view of the floating structure of FIG. 10 at a sub-cellar deck level. Soft tendons 1020 can be seen disposed within tendon connectors 1022 attached in pairs about the circumference of the enlarged lower portion 1010 of the hull structure 1006. Mooring line handling equipment 1014 is arranged in pairs about the legs 1104 of the support structure 1004 upon the sub-cellar deck 1016. Mooring lines 1012 extend downward from the mooring line handling equipment 1014 to the narrowed upper portion 1008 of the hull structure 1006 and then outward in a radial pattern. Risers 1026 extend through the sub-cellar deck 1016 in a pattern of guide sleeves 1110.

Figure 13:
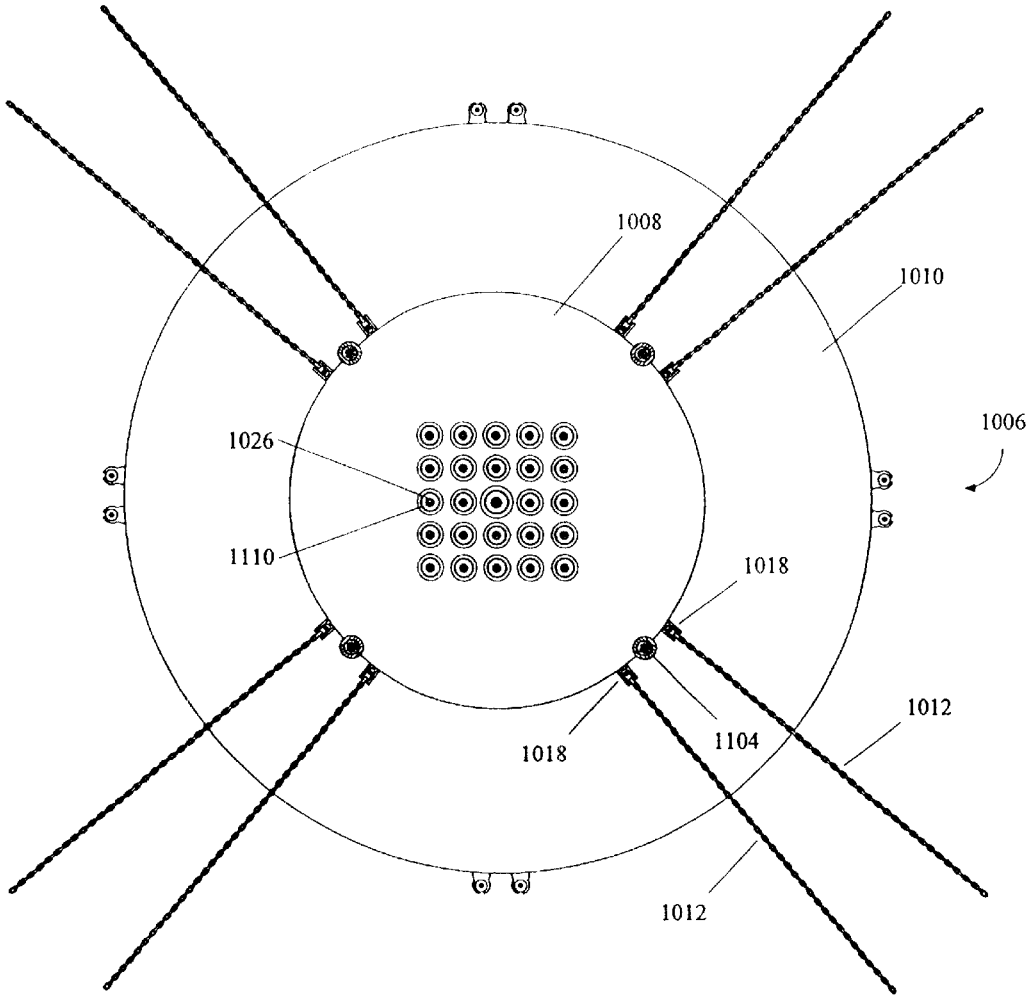
FIG. 13 illustrates a top view of the floating structure of FIG. 10 at a top of the hard tank level.

Referring now to FIG. 13, there is shown a top view of the floating structure of FIG. 10 at a hull structure top level. Fairleads 1018 are attached about the circumference of the narrowed upper portion 1008 of the hull structure 1006 to redirect the mooring lines 1012 outward. The legs 1104 of the support structure 1004 engage the hull structure 1006 between the fairleads 1018. Risers 1026 continued downward through the hull structure 1006 in a pattern of guide sleeves 1110.

Installation

Figure 14:
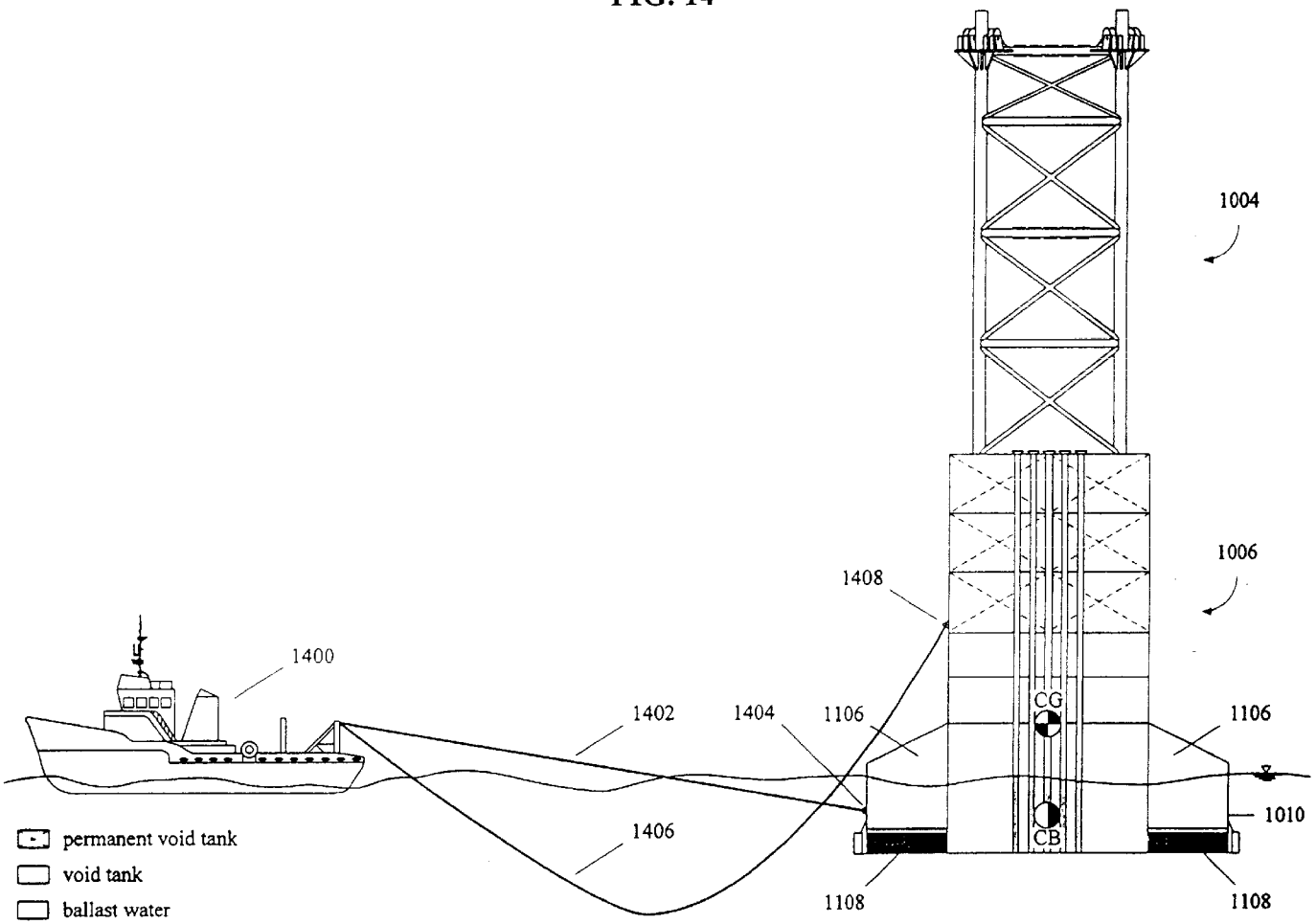
FIG. 14 illustrates an outboard profile of the floating structure of FIG. 10 in an inland shallow draft tow condition.
Figure 15:
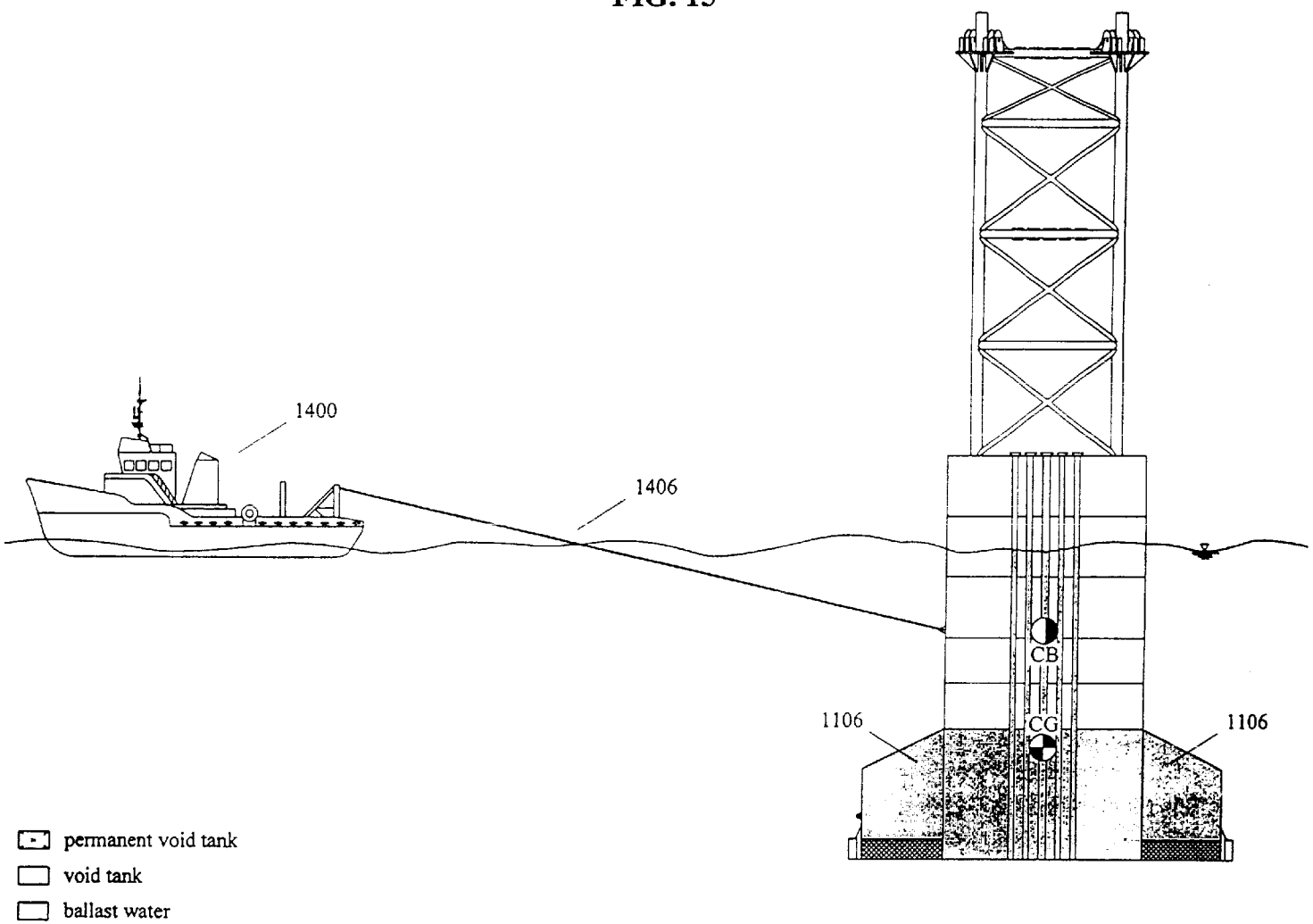
FIG. 15 illustrates an outboard profile of the floating structure of FIG. 10 in an offshore deep draft tow condition.
Figure 16:
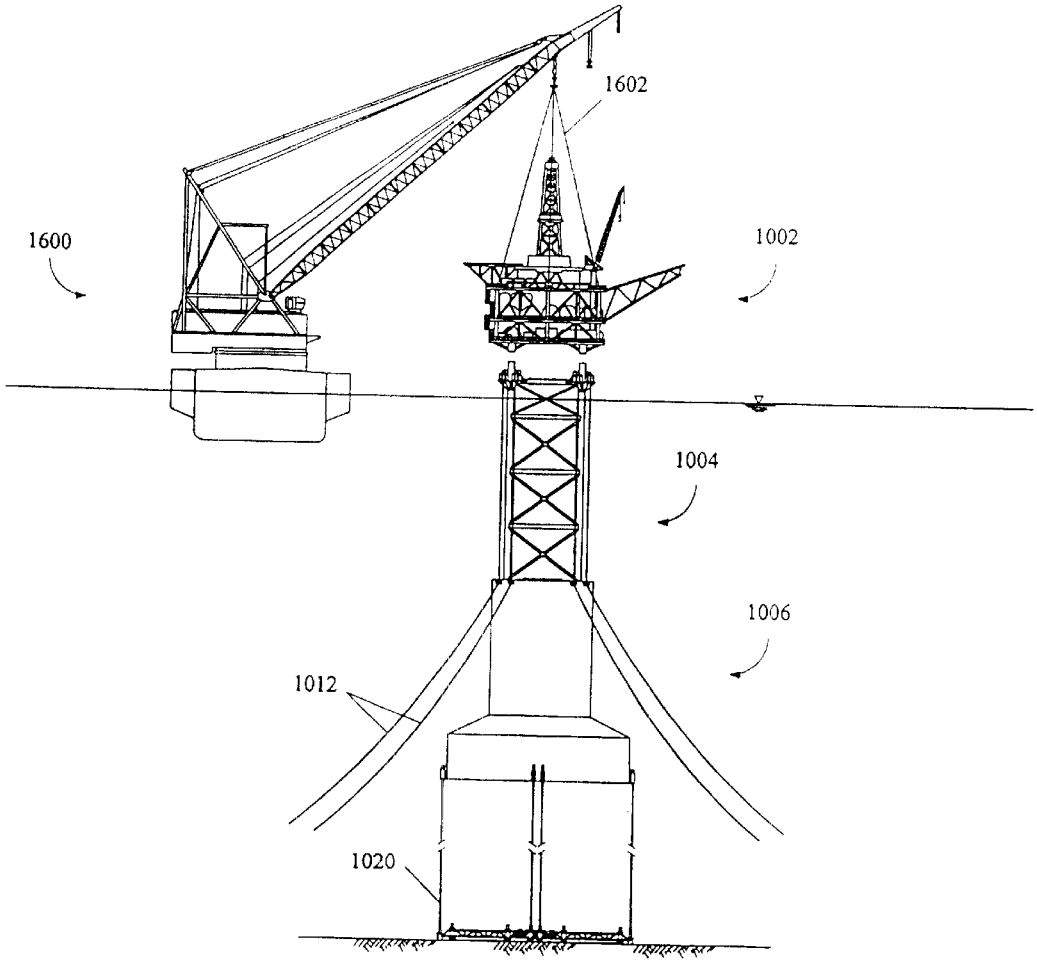
FIG. 16 illustrates an outboard profile of the floating structure of FIG. 10 during a superstructure setting installation procedure wherein the hull structure is deballasted to transfer weight from a derrick barge to the floating structure.

One feature provided by the enlarged bottom portion of the hull structure is to allow a simplified installation procedure. In one embodiment, as illustrated in FIG. 14, the hull structure 1006 and support structure 1004 may be towed vertically as a single unit in shallow draft. The permanent ballast tanks 1106 are voided. The diameter and depth of the enlarged bottom portion 1010 is arranged to permit tow at a draft less than the depth of the enlarged bottom portion 1010. The center of gravity (CG) may be significantly above the center of buoyancy (CB). Stability is, therefore, provided by the waterplane area of the enlarged bottom portion 1010. A tugboat 1400 attaches a lower towline 1402 at a lower tow connection 1404. A second slack upper towline 1406 attaches at an upper tow connection 1408. The shallow draft tow condition can permit the manufacture of the hull structure 1006 and support structure 1004 on land where limited draft inland tow is required to reach open waters. Once in open waters, as illustrated in FIG. 15, the hull structure 1006 and support structure 1004 can be submerged to a deeper draft by ballasting the permanent ballast tanks 1106 of the enlarged bottom portion 1010. As illustrated, the center of buoyancy (CB) is above the center of gravity (CG) to augment the stability provided by the waterplane area of the narrow top portion 1008 of the hull structure 1006. In this condition, sufficient stability can be achieved to allow offshore tow. The lower towline 1402 is removed and the tugboat 1400 employs the upper towline 1406. In one embodiment, as illustrated in FIG. 16, at the site of installation, mooring lines 1012 and soft tendons 1020 are installed. The superstructure 1002 may then be set upon the support structure 1004 by conventional means such as a lifting barge 1600. Load is transferred from the lifting slings 1602 of the lifting barge 1600 to the support 1004 and hull structure 1006. Due to the reduced waterplane area, load is transferred by a process of deballasting the hull structure 1006 while the lifting barge 1600 controls the elevation of the superstructure 1002.

Figures 17A, 17B:
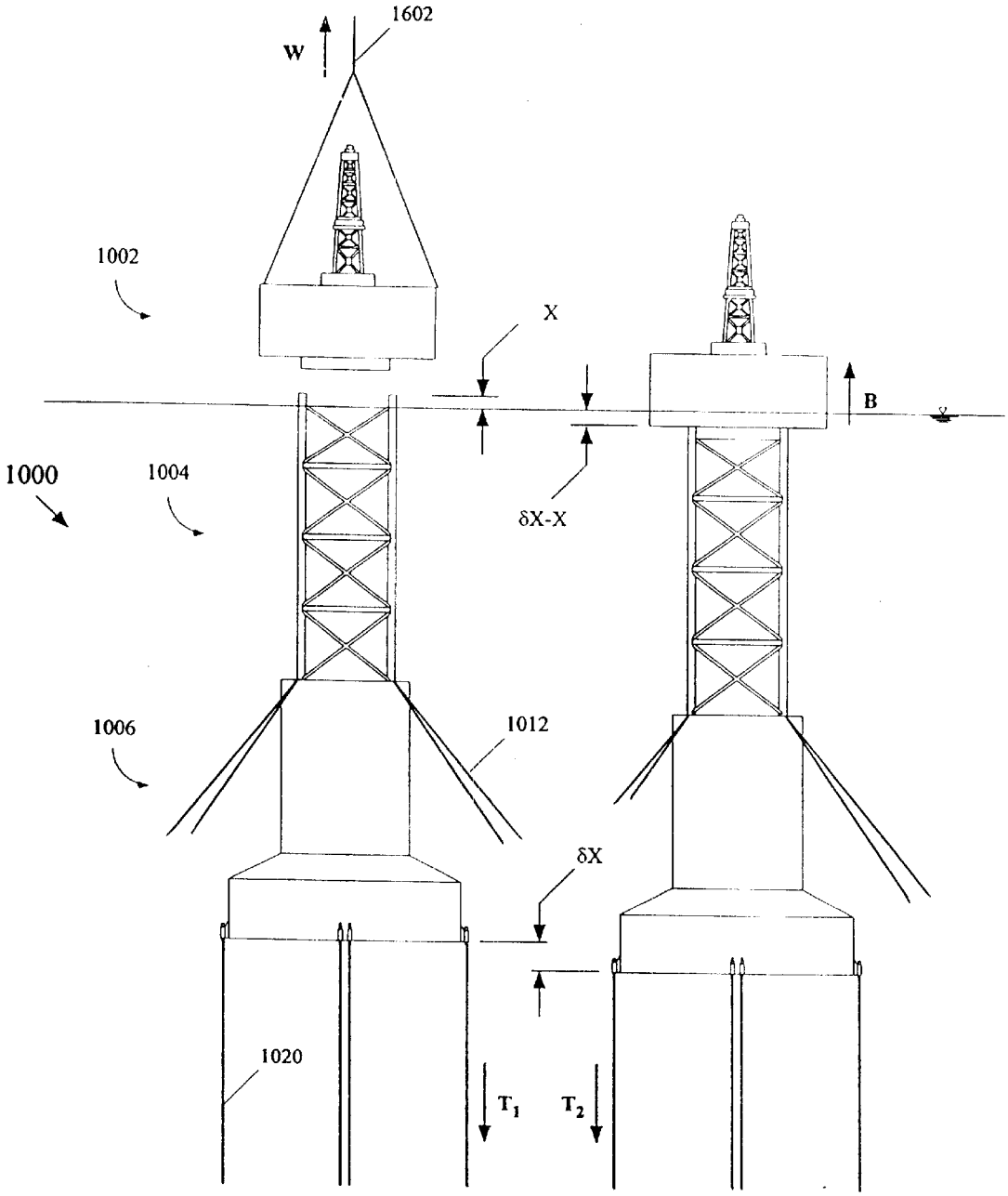
FIGS. 17(*a*)–(*b*) illustrate an outboard profile of the floating structure of FIG. 10 during a superstructure setting installation procedure wherein tendon pretension and the buoyancy of a watertight superstructure hull are employed to transfer deck weight from a derrick barge to the floating structure.

In another embodiment, as illustrated in FIGS. 17(*a*)–(*b*), the base portion of the superstructure is watertight to provide buoyant support. When the superstructure 1002 is set upon the support structure 1004, a portion of the superstructure's weight (W) is supported by tendon pretension with the remaining amount supported by buoyancy (B). Referring to FIG. 17(*a*), tendons 1020 are highly pretensioned ($T_1$) prior to setting the superstructure 1002. The elevation of the support structure 1004 is arranged to a distance (X) above the waterline with the weight (W) of the superstructure 1002 supported by the lifting slings 1602. Referring now to FIG. 17(*b*), as the superstructure 1002 is set upon the support structure 1004, the floating structure 1000 submerges a distance ($\delta X$)reducing the tension in the tendons ($T_2<T_1$). The watertight portion of the superstructure 1002 submerges to a draft of ($\delta X$–X) to provide buoyancy (B). The support structure elevation (X), the tendon pretension ($T_1$) and the buoyancy of the superstructure (B) can be arranged such that the reduction in tension ($T_1$–$T_2$) in combination with the superstructure buoyancy (B) supports the weight of the superstructure ($T_1$–$T_2$+B=W) with minimal ballasting. It is generally desirable that the tension in the tendons always remains positive to avoid compressive forces within the tendons 1020. After completion of the superstructure 1002 setting operation, the hull structure 1006 can be deballasted and the tendon 1020 length adjusted to achieve operation elevation for the superstructure 1002.

Figure 18B:
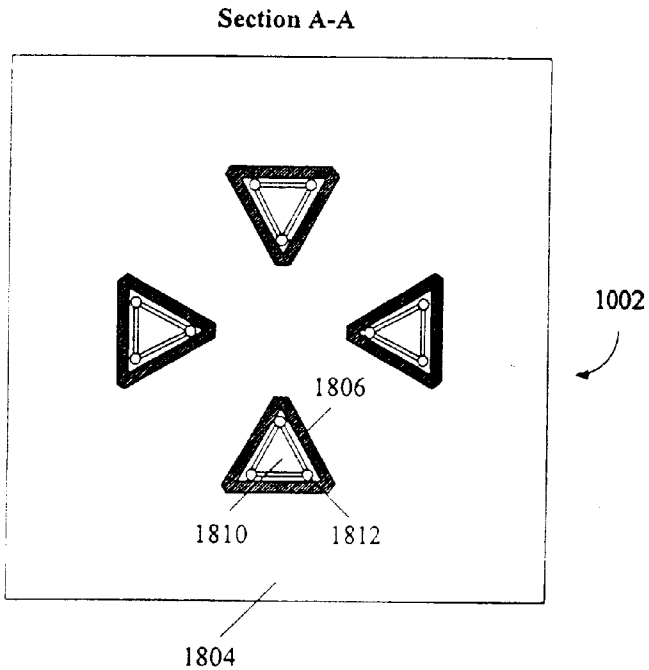
FIGS. 18(*a*)–(*b*) illustrate an outboard profile and top view of a floating structure in accordance with an embodiment of the invention wherein the superstructure and support structure comprise a vertically translatable jack-up type arrangement.
Figure 18A:
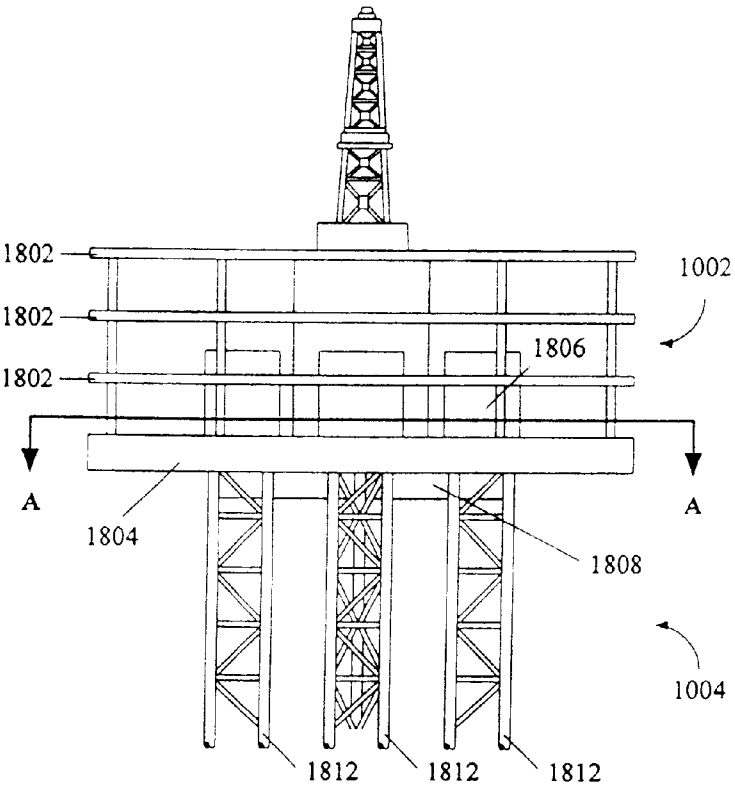
Figure 19:
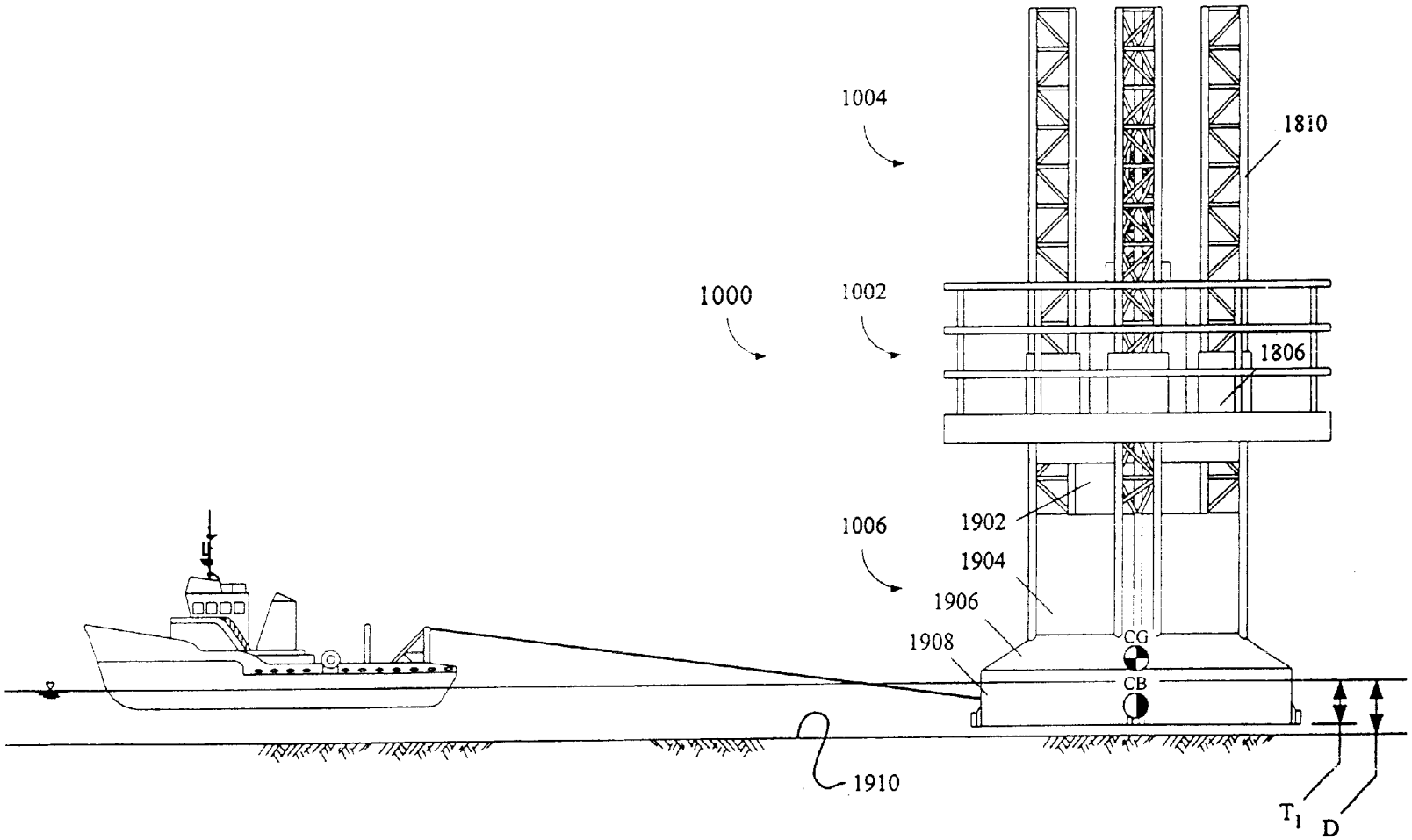
FIG. 19 illustrates an outboard profile of the floating structure of FIGS. 18(*a*)–(*b*) in an inland shallow draft tow condition wherein a vertically translatable superstructure rest atop the hull structure.
Figure 20:
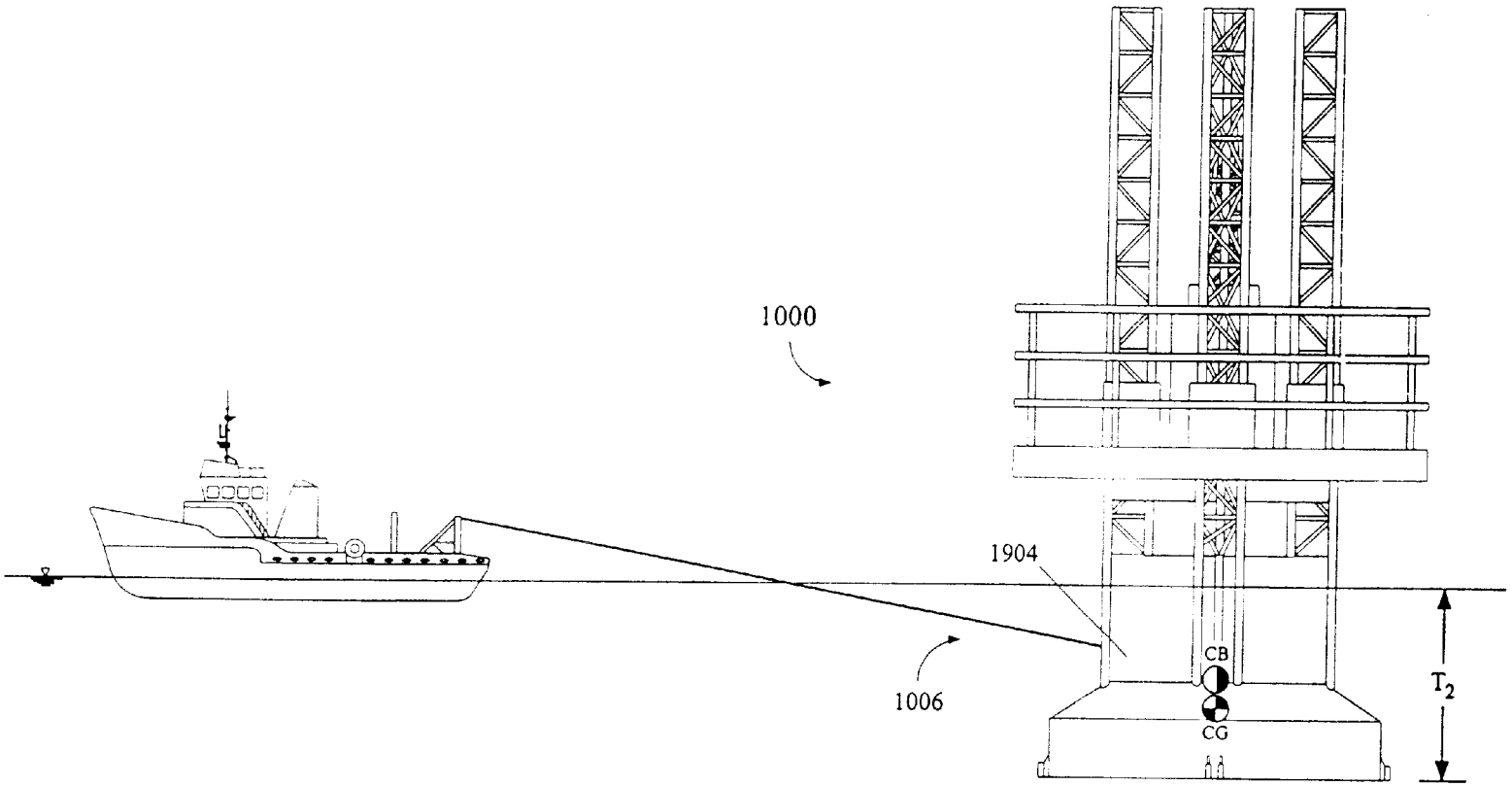
FIG. 20 illustrates an outboard profile of the floating structure of FIGS. 18(*a*)–(*b*) in an offshore deep draft tow condition.
Figures 21A, 21B, 21C:
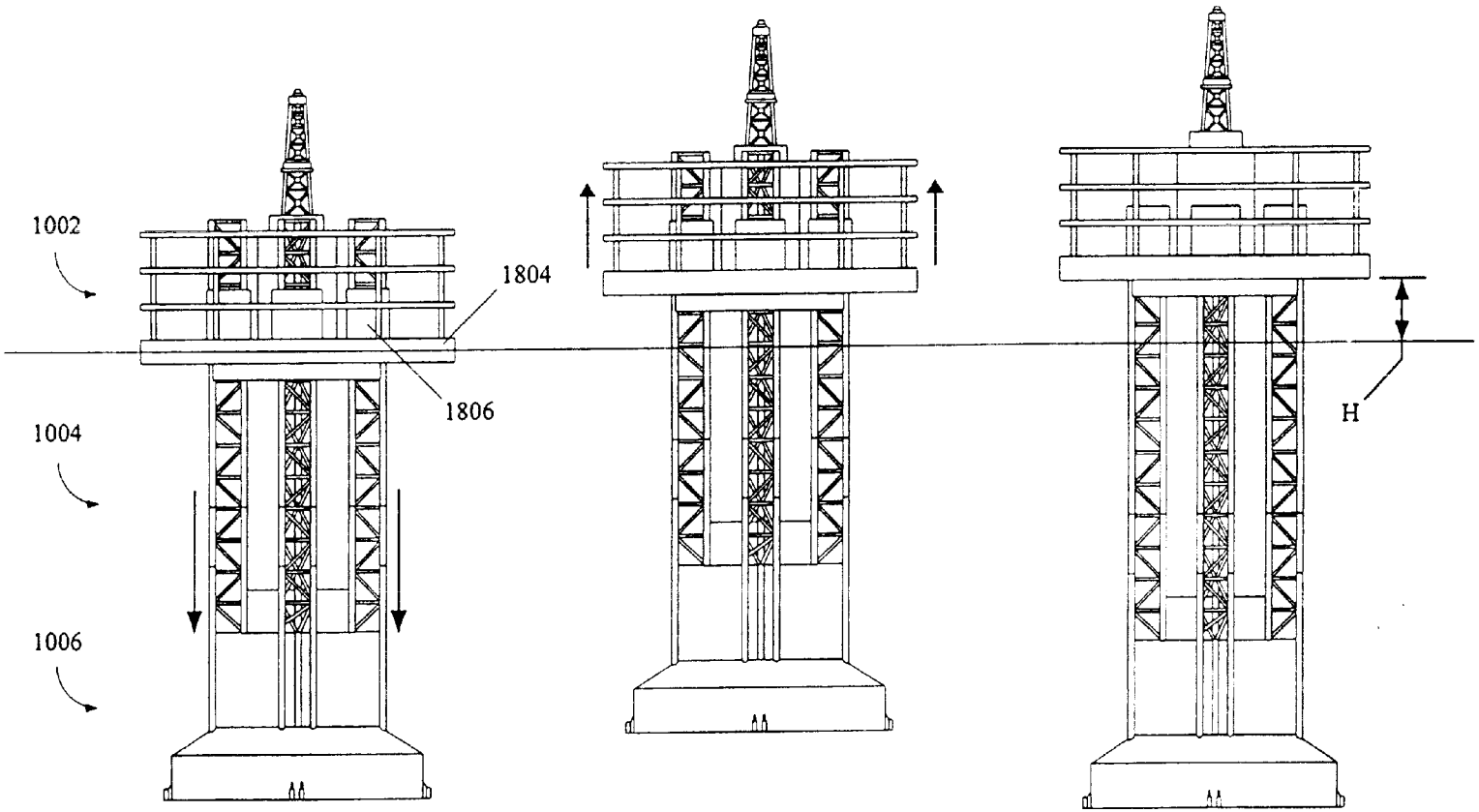
FIGS. 21(*a*)–(*c*) illustrate outboard profiles of the floating structure of FIGS. 18(*a*)–(*b*) wherein a vertically translatable superstructure is jacked-up and floated-up into an operation position.

In another embodiment, the superstructure, support structure, and hull structure may all be constructed and towed as a single floating unit to further simplify construction and installation. As illustrated in FIGS. 18(*a*)–(*b*), the superstructure 1002 and support structure 1004 are arranged in a fashion similar to a conventional jackup unit. The superstructure 1002 comprises multiple decks 1802, a base section 1804, guide sleeves 1806, and a subcellar deck 1808. The guide sleeves 1806 are arranged around apertures 1810 passing through the base section 1804 and decks 1802. The support structure 1004 comprises multiple truss type legs 1812 disposed within the guide sleeves 1806. Referring now to FIG. 19, a floating structure 1000, comprising the superstructure 1002 and support structure 1004 of FIGS. 18(*a*)–(*b*), and a hull structure 1006 is illustrated in a shallow draft tow condition. The hull structure comprises a narrowed upper portion 1902, a central portion 1904, a transition portion 1906, and an enlarged base portion 1908. The superstructure 1002 rests upon a top side of the narrowed upper portion 1902 of the hull structure 1006. The legs 1810 of the support structure 1004 extend up through apertures in the guide sleeves 1806 in the superstructure 1004. The floating structure 1000 has a draft ($T_1$) arranged less than the water depth (D) of the river bed 1910. In the shallow draft tow condition, the center of gravity (CG) is above the center of buoyancy (CB). The quantity, placement, and arrangement of solid ballast (not shown), the depth and diameter of the enlarged base portion 1908, and other structures are arranged such that the waterplane area provides sufficient stability to allow shallow draft tow. Again, upon reaching open waters, as illustrated in FIG. 20, the floating structure 1000 may be submerged to a deeper draft ($T_2$). As illustrated, the center of buoyancy (CB) is above the center of gravity (CG) to augment the stability provided by the waterplane area of the central portion 1904 of the hull structure 1006. In this condition, sufficient stability can be achieved to allow open water tow. Referring now to FIGS. 21(*a*)–(*c*), at the site of installation, the superstructure 1002 may be elevated to an operation position through various means. In one embodiment, illustrated in FIG. 21(*a*), the base section 1804 comprises a watertight hull so as to make the superstructure self-buoyant. Variable ballast tanks (not shown) in the hull structure 1006 are ballasted. The superstructure 1002 remains floating as the support structure 1004 slides downwards with the hull structure 1006 through the guide sleeves 1806 in the superstructure 1002. Once the operation position has been achieved, the superstructure 1002 is affixed to the support structure 1004. This may be achieved by locking mechanisms (not shown) within the guide sleeves 1806, welding, or various other means. The variable ballast tanks (not shown) may then be deballasted to elevate the superstructure to operational elevation, such as that illustrated in FIG. 21(*c*). In another embodiment, illustrated in FIG. 21(*b*), the superstructure 1002 is jacked upwards employing active jacking means (not shown) such as those generally employed in shallow water jack-up drilling structures. Once at operational height (H), such as that illustrated in FIG. 21(*c*), the jacking mechanism is locked into position. These configurations are one manner which may be employed to allow repeated tows of the floating structure 1000. Such a configuration is particularly suitable for drilling in smaller oil deposit applications where location changes are made.

Variable Heave Natural Period

Figure 22A:
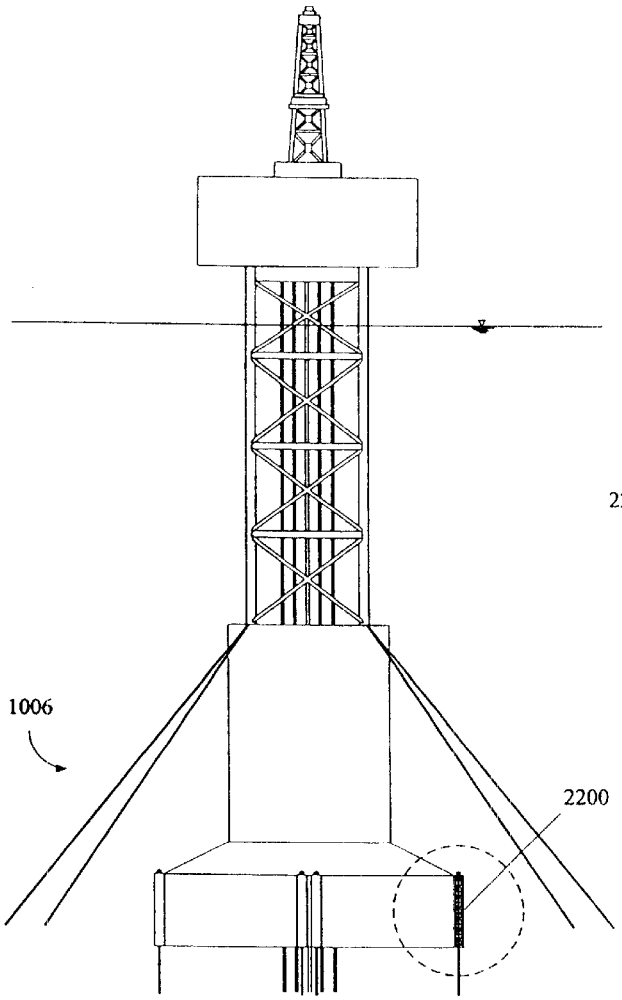
FIGS. 22(*a*)–(*b*) illustrate an outboard profile and partial cross-section of a floating structure in accordance with an embodiment of the invention employing buckling-column type elastomer tendon connections.
Figure 22B:
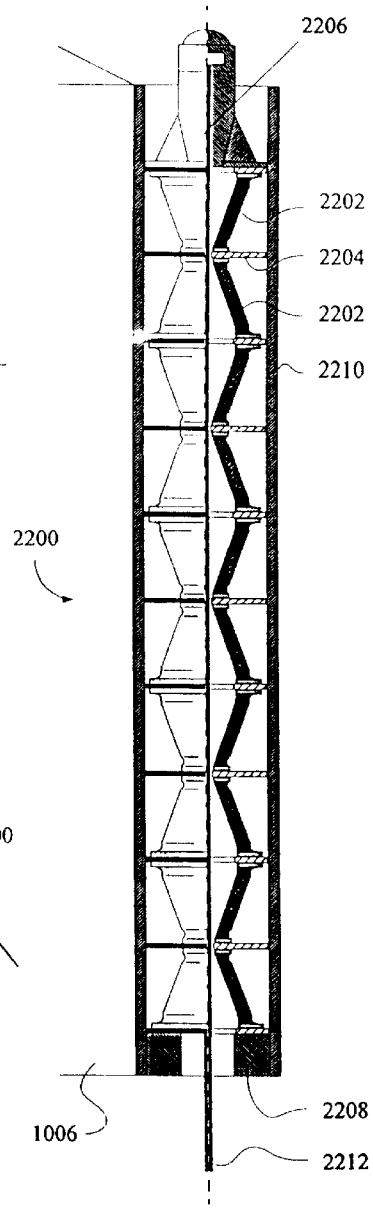
Figure 23C:
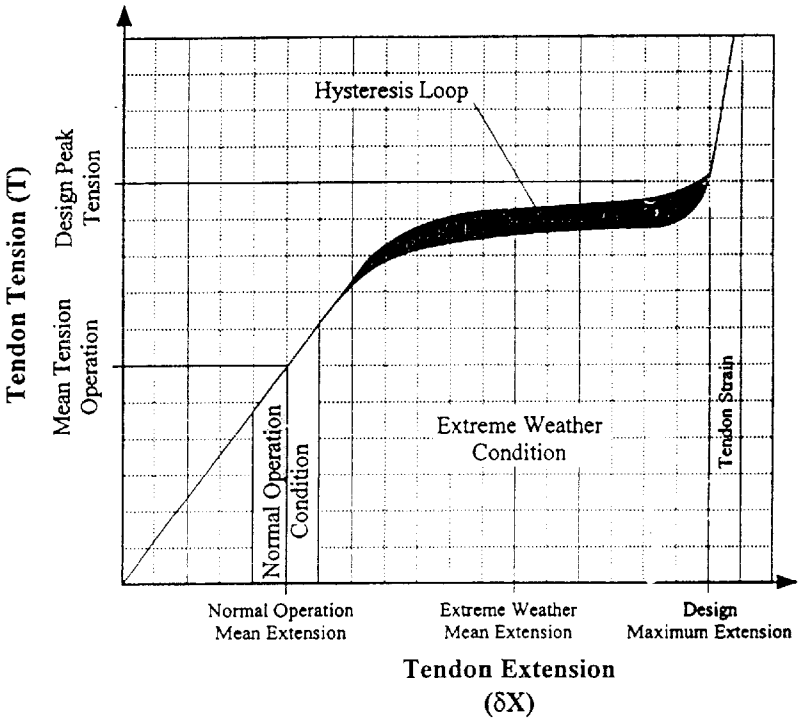
FIGS. 23(*a*)–(*c*) illustrates a cross-sectional view of the buckling-column type elastomer tendon connections of FIGS. 22(*a*)–(*b*) in an unextended and fully extended position, and a graphical representation of the tendon connection performance characteristics in various conditions of operation.
Figures 23A, 23B:
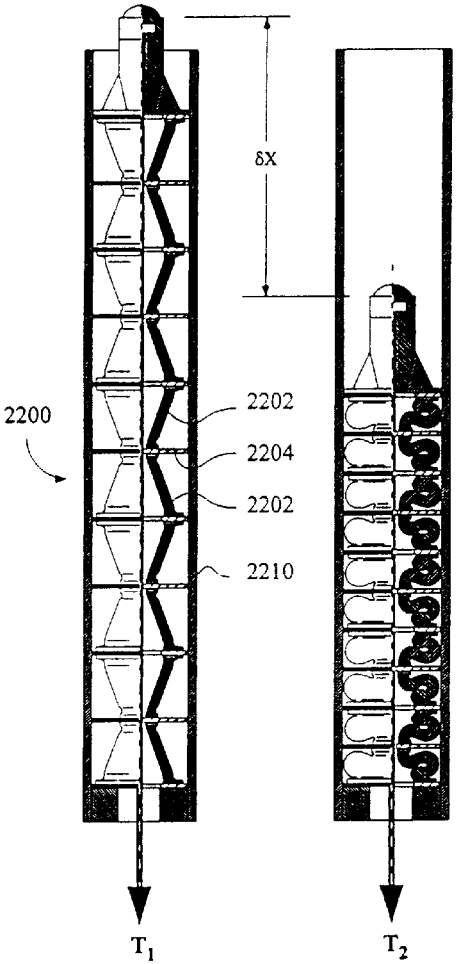

In one embodiment, a floating structure may be employed having more than one distinct heave natural period. The heave natural period may become a function of external loading and ballast condition. Such an application is especially well suited for lighter superstructures. As aforementioned, twenty to twenty-five seconds is a generally desirable lower limit for the heave natural period of the various embodiments. In applications where only a relatively light superstructure is desired while still requiring a larger vertical stiffness, such as one hundred tons per foot for drilling operations, the heave natural period may fall below twenty seconds. This may be remedied through the addition of added mass by means such as those illustrated below in FIGS. 26–28, or by increasing the mass of fixed ballast, such as additional hull structure or solid ballast. The addition of such mass might be seen as uneconomical. In relatively calm seas, however, the quantity of wave energy at the primary wave period may be sufficiently small to allow the lower limit to be exceeded while retaining acceptable seakeeping characteristics. During a hurricane or storm condition, acceptable seakeeping characteristics may still be retained by lengthening the heave natural period. In one embodiment, as illustrated in FIG. 22(*a*), multiple heave natural periods may be achieved by employing buckling-column type elastomer tendon connections 2200, such as those disclosed in copending U.S. patent application Ser. No. 60/056,982 by Steven M. Byle. Turning now to FIG. 22(*b*), there is shown the elastomer tendon connections 2200 of FIG. 22(*a*) in cross-sectional view. The elastomer tendon connection 2200 comprises a stacked series of buckling-column elastomer units 2202 and spacers 2204 disposed between a tendon connector 2206 and a tendon support base 2208 within a housing 2210. A tendon 2212 attaches to the tendon connector 2206 and passes through the elastomer units 2202 and support base 2208 affixed at a lower end of the housing 2210. Tendon tension (T) is transmitted from tendon connector 2206 to support base 2208 through the elastomer units 2202 and spacers 2204. As illustrated in FIGS. 23(*a*)–(*b*), increasing tendon tension ($T_1$>$T_2$) induces compression ($\delta X$) in the elastomer units 2202. The property of the elastomer units 2202 in different states of compression alters the vertical stiffness provided by the soft tendon system. As illustrated in FIGS. 23(*c*), in normal operation condition, the elastomer units 2202 may be pretensioned in a linear range of the tendon tension versus tendon extension curve. Under storm conditions, environmentally induced lateral offsets may induce tendon extension into the non-linear range of the tendon tension versus tendon extension curve. A floating structure may also be deballasted, elevating the structure and inducing tendon extension, to reach the same area of the curve. A static mean lateral offset and ballast condition may be designed and achieved such that the extreme weather mean extension falls within this non-linear range so as to permit oscillatory motions of heave, pitch, and surge to induce tendon extensions falling within this range. The effect of operation within the non-linear range of the tendon tension versus tendon extension curve is to provide an operation condition having a second heave natural period. As can be appreciated by reference to FIG. 23(*c*), the effective stiffness of the soft tendon system may be significantly reduced to lengthen the heave natural period away from the primary wave period. It should also be noted that a similar affect occurs regarding natural periods in other degrees of freedom, especially pitch natural period where soft tendons are widely spaced.

It should be noted that where multiple heave natural periods are not required, the invention is susceptible to various other elastomer tendon constructions having only a single stiffness characteristic. Such constructions shall be referred to as linear spring elastomer tendon connections. The primary purpose of linear spring elastomer tendon connection is to control the vertical stiffness of the floating structure rather than having the tendon stiffness be the controlling factor. A designer can employ tendon constructions having a stiffness above that required to provide the desired heave natural period. The tendon connection itself can be designed to provide the required stiffness, less than that provided by the tendons themselves. Configurations, such as a stack of rubber pads, can be arranged between the floating structure and tendons so that tension in the tendons induces compression in the pads. The number of pads, the elastomer mixture, and other elements of design can be designed to provide the extent of deflection required to compensate for the motions of the platform and to provide the required stiffness to control the heave natural period. Under such an arrangement, the motions of the floating structure induce compression of the elastomer tendon connection rather than tendon extension. Many elastomer configurations are commercially available to provide deflection and stiffness amenable to the present invention.

Various additional benefits may be realized by employing elastomer tendon connections, e.g., linear spring or buckling column type. The performance of the soft tendon system may be made significantly less water depth dependent. Tendon stiffness generally decreases with the length of tendon employed. Therefore, when a floating structure is moved to deeper or shallower water, the heave natural period will be affected for a given tendon construction and arrangement. By employing tendons having a stiffness significantly higher than that provided by the elastomer tendon connections 2200, lengthening or shortening the tendon length has a reduced effect on the stiffness of the tendon system. The elastomer tendon connections 2200 remains the softest link in the tendon system, and may thereby predominate vertical characteristics independent of water depth. This function may also be employed in shallower water, where tendon stiffness may cause vertical stiffness to increase above a desired level. Again, elastomer tendon connections 2200 may become the softest link in the soft tendon system to hold vertical stiffness to a desired limit in shallow water. This usage permits operations employing a wide variety of tendon constructions, including conventional rigid steel pipe tendons, chain, and other stiff constructions. Another potential benefit is the opportunity to add damping to the station keeping system to reduce the dynamic motions of a floating structure. Where buckling-column elastomer tendon connections are employed, the elastomer tendon connections themselves add some amount of damping due to the hysteresis characteristic, as illustrated in FIG. 23(*c*). The relative displacement, however, provided by any of the various possible elastomer tendon constructions between tendon and hull structure provides still further opportunity to add damping. Viscous damping devices may be disposed within the housing 2210, such as those disclosed in copending U.S. patent application Ser. No. 60/056,982 by Steven M. Byle. By restriction of water flow within the housing 2210 velocity dependent damping forces may be added. Other known active, semi-active, or passive devices may also be attached between the hull structure 1006 and tendon connector 2206 to exploit the relative displacement to add damping forces.

Exemplary Alternative Embodiments

Figure 24:
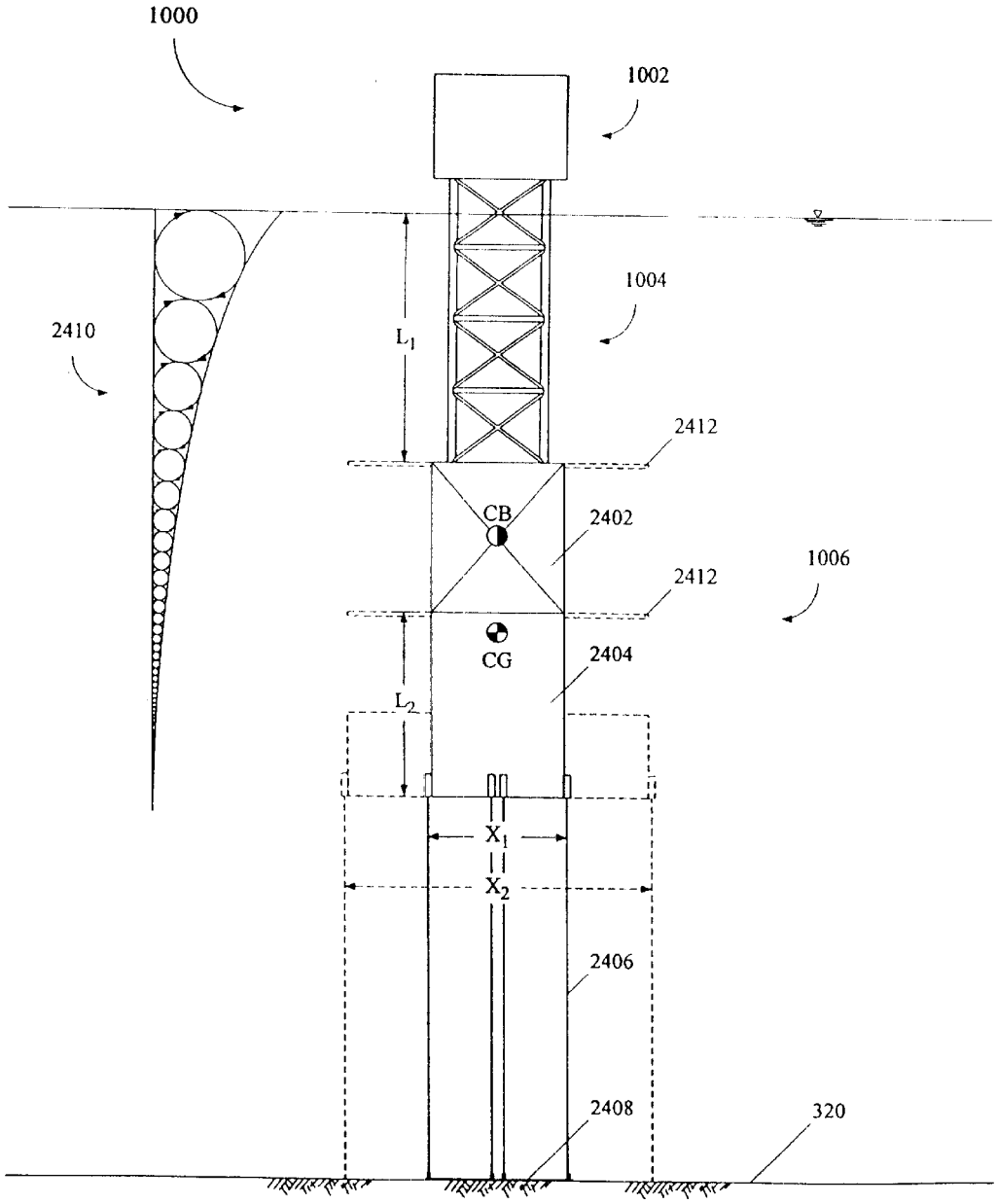
FIG. 24 illustrates an outboard profile view of a generalized arrangement of a floating structure in accordance with an embodiment of the invention demonstrating variability of various structural element configurations.

The design and arrangement of hull structure, support structure, station keeping systems and other elements are subject to variation and may give rise to a wide variety of embodiments. Certain aspects of this versatility may be appreciated by reference to FIGS. 24–25. There is shown a generalized floating structure 1000, comprising a superstructure 1002, a support structure 1004, and a hull structure 1006. The hull structure 1006 comprises an upper positively buoyant portion 2402 and a lower negatively buoyant portion 2404. Soft tendons 2406 attach between a template 2408 on the seafloor 320 and the hull structure 1006. As illustrated, the support structure 1004 has a submerged length ($L_1$) which may be varied to adjust the depth of submergence of the hull structure 1006 in a wave profile 2410. The wave profile 2410 comprises a vertical profile of exponentially decreasing wave related hydrodynamic forces represented by circular paths of water particle movement. The wave profile decreases non-linearly, with the largest magnitude occurring at the water surface and decreasing as you go further down in the wave zone. Increased support structure 1004 length ($L_1$) reduces the magnitude of the hydrodynamic forces acting upon the hull structure 1006, by increasing submergence in the wave zone. The size and shape of the upper positively buoyant portion 2402 of the hull structure 1006 is subject to wide variation, serving the primary purpose of providing the buoyancy. It is desirable, however, that the positively buoyant portion 2402 have a relatively small cross-sectional area upon which the hydrodynamic forces apply. Cross-sectional area is more amenable to increase, however, with increasing support structure 1004 length ($L_1$). Accordingly, because it is submerged more deeply in the wave profile 2410 than the positively buoyant portion 2402, the size and shape of the lower negatively buoyant portion 2404 of the hull structure 1006 may be varied even more widely, serving the primary purpose of supplying fixed ballast weight to lower the center of gravity (CG) below the center of buoyancy (CB). As previously disclosed, the diameter of the lower negatively buoyant portion 2404 may be expanded to provide for a shallow water tow. The increased diameter also has the effect of increasing tendon spacing ($X_1$ to $X_2$) and the added mass of the hull structure 1006. The added mass of the floating structure 1000 may be increased by other means. Optional heave plates 2412 may be added to the hull structure 1006 at various elevations. Heave plates 2412 may comprise various arrangements of thin horizontal steel plates arranged to trap additional water mass. The effectiveness of a given amount of solid or other fixed ballast in lowering the center of gravity (CG) may generally be increased by increasing the length ($L_2$) of the lower negatively buoyant portion 2404. Wide variability may also be achieved in the arrangement of the station keeping system.

Figure 25:
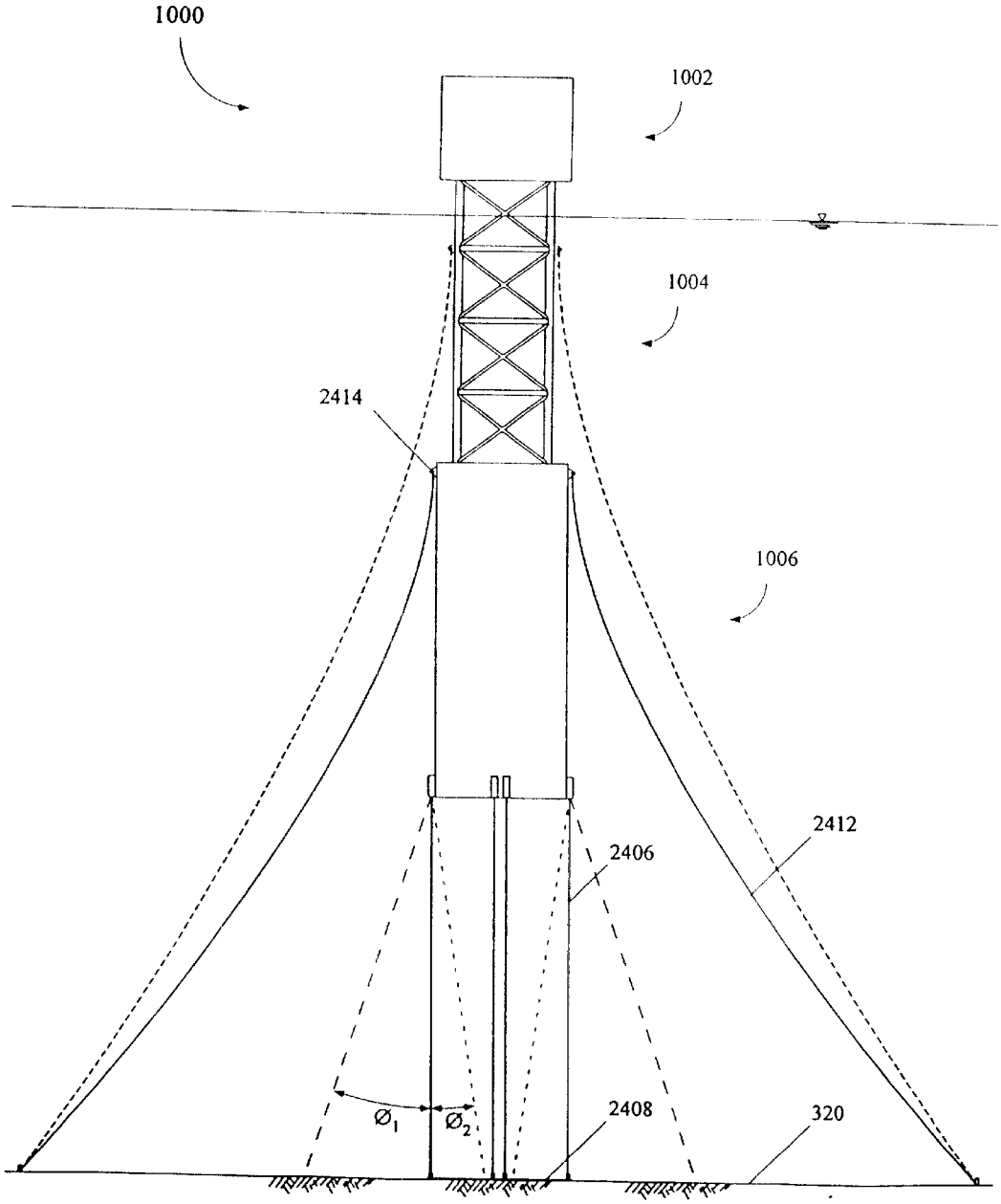
FIG. 25 illustrates an outboard profile view of a generalized arrangement of a floating structure in accordance with an embodiment of the invention demonstrating variability of various station keeping element configurations.

As illustrated in FIG. 25, the soft tendons 2406 are arranged vertically. The arrangement of soft tendons 2406 is also subject to variation, e.g., by arranging the tendons 2406 with an outward angle $Ø_1$ or an inward angle $Ø_2$. Arrangement of the tendons 2406 with an inward angle $Ø_2$ allows reduction in size of a template 2408 employed on the seafloor 320. A very small inward angle $Ø_2$ may greatly reduce template size with relatively insignificant change in performance of the soft tendons 2406. An outward angle $Ø_1$ increases the station keeping performance of the soft tendons 2406 to oppose surge forces, but decreases the vertical stiffness provided by the soft tendons 2406. It is generally desirable to limit the outward angle $Ø_1$ to approximately thirty degrees from vertical. In addition to soft tendons 2406, supplemental mooring lines 1012 may be employed. As illustrated, mooring lines 2412 pass through fairleads 2414 attached to the hull structure 1006 above the center of buoyancy (CB). The attachment and arrangement of mooring lines 2412, however, is subject to variation. Fairleads 2414 may be attached to the support structure 1004 and reach elevations near or even above the mean water line. For a given requirement of vertical stiffness, pitch stiffness, and surge stiffness, many configurations of soft tendons 2406 and mooring lines 2412 may be derived. In application, the aforementioned design and arrangement considerations provide for a diverse array of embodiments. Several exemplary embodiments follow.

Figure 26:
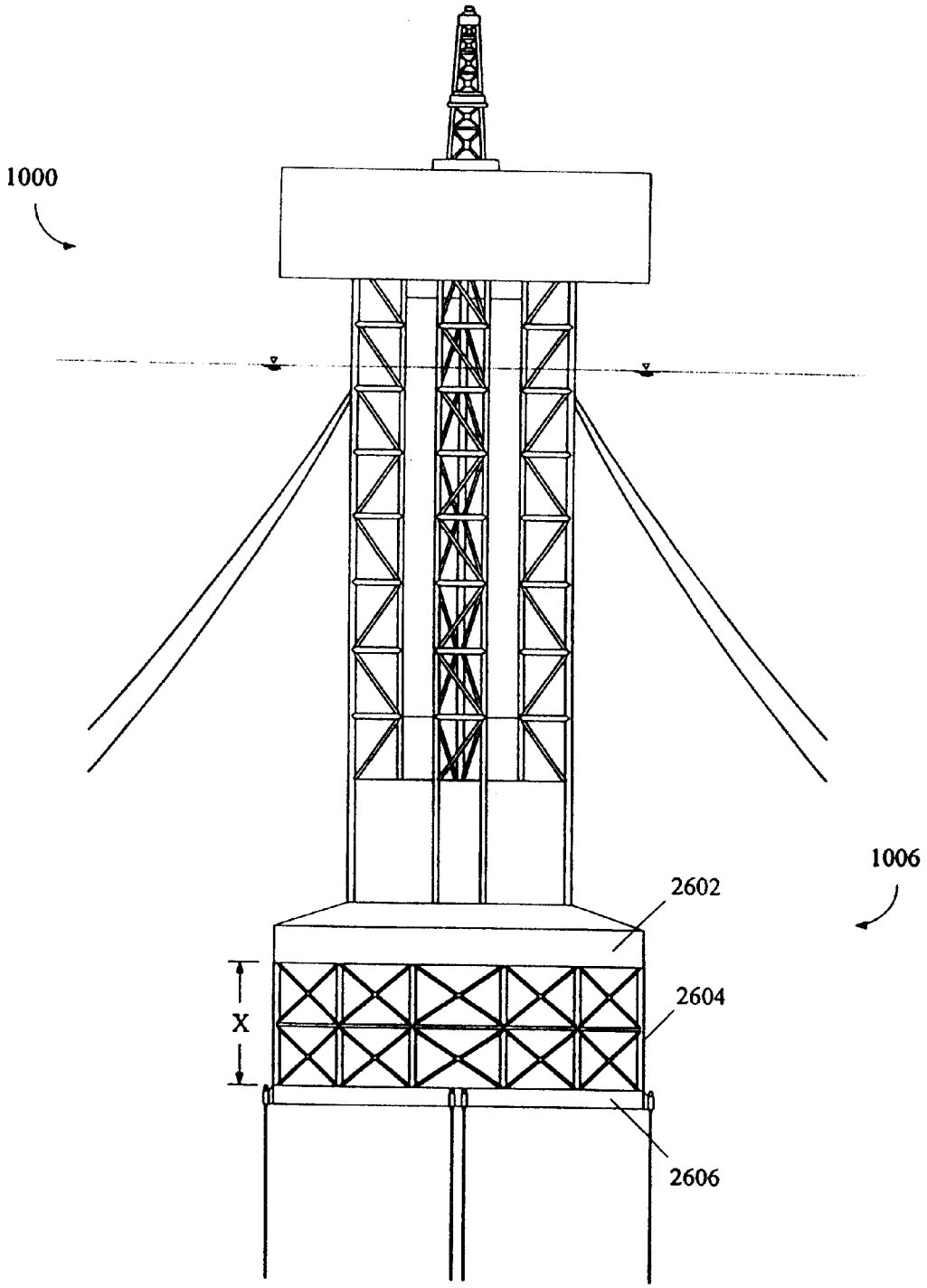
FIG. 26 illustrates an outboard profile of a floating structure in accordance with an embodiment of the invention having an extended base section below the hull structure to increase added mass.
Figure 27A:
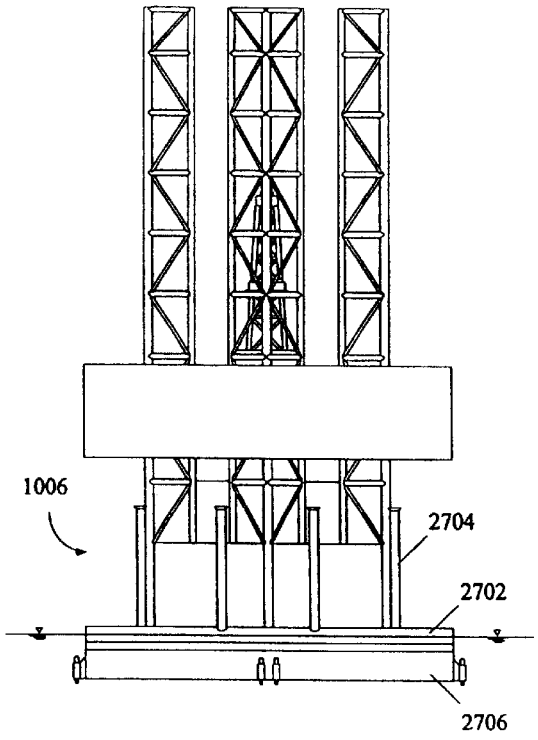
FIGS. 27(*a*)–(*b*) illustrate a outboard profiles of a floating structure in accordance with an embodiment of the invention having an extendable base section below the hull structure and a vertically translatable superstructure in an extended and retracted position.
Figure 27B:
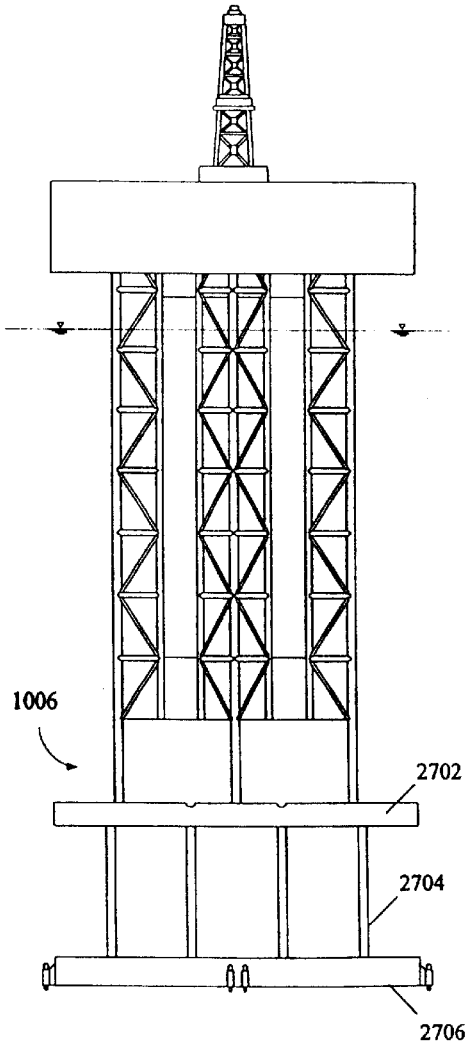

In one embodiment, illustrated in FIG. 26, added mass of the floating structure is increased by extending the enlarged base portion 2602 of the hull structure 1006. Truss members 2604 are disposed between the enlarged base portion 2602 and a base section 2606 to provide a structural connection. Solid ballast (not shown) may be placed in the base section 2606 to lower the center of gravity (CG). The depth of the base section 2606 may be sufficient to allow ballast capacity, which may be employed during hull structure 1006 submergence from shallow to deeper draft tow conditions in order to increase stability through the transition from waterplane stabilization to buoyancy stabilization. Water occupying the gap provided by the truss members 2604 moves with the floating structure 1000, increasing added mass. Single or multiple base sections may be employed. The most effective gap length (X) for a given hull structure configuration may be determined based upon hydrodynamic principles and experimentation. In an alternative embodiment, such as that illustrated in FIGS. 27(*a*)–(*b*), the base section may be vertically slidable. The enlarged base portion 2702 of the hull structure 1006 has apertures for support legs 2704. The support legs 2704 attach to a base section 2706. The base section 2706 is elevated and lowered by adjusting ballast in the base section 2706 and controlling the relative movement of the support legs 2704. The base section 2706 may be elevated for shallow draft floatation, as illustrate in FIG. 27(*a*). Once on location for installation, the base section 2706 can be lowered to provide increased stability and added mass, as illustrated in FIG. 27(*b*). Although the base section 2706 is shown to be below the base section 2702, in an alternative embodiment, the positions of the base section 2706 the base section 2702 may be swapped, and the base section 2702 may be elevated or lowered as needed.

Figure 28:
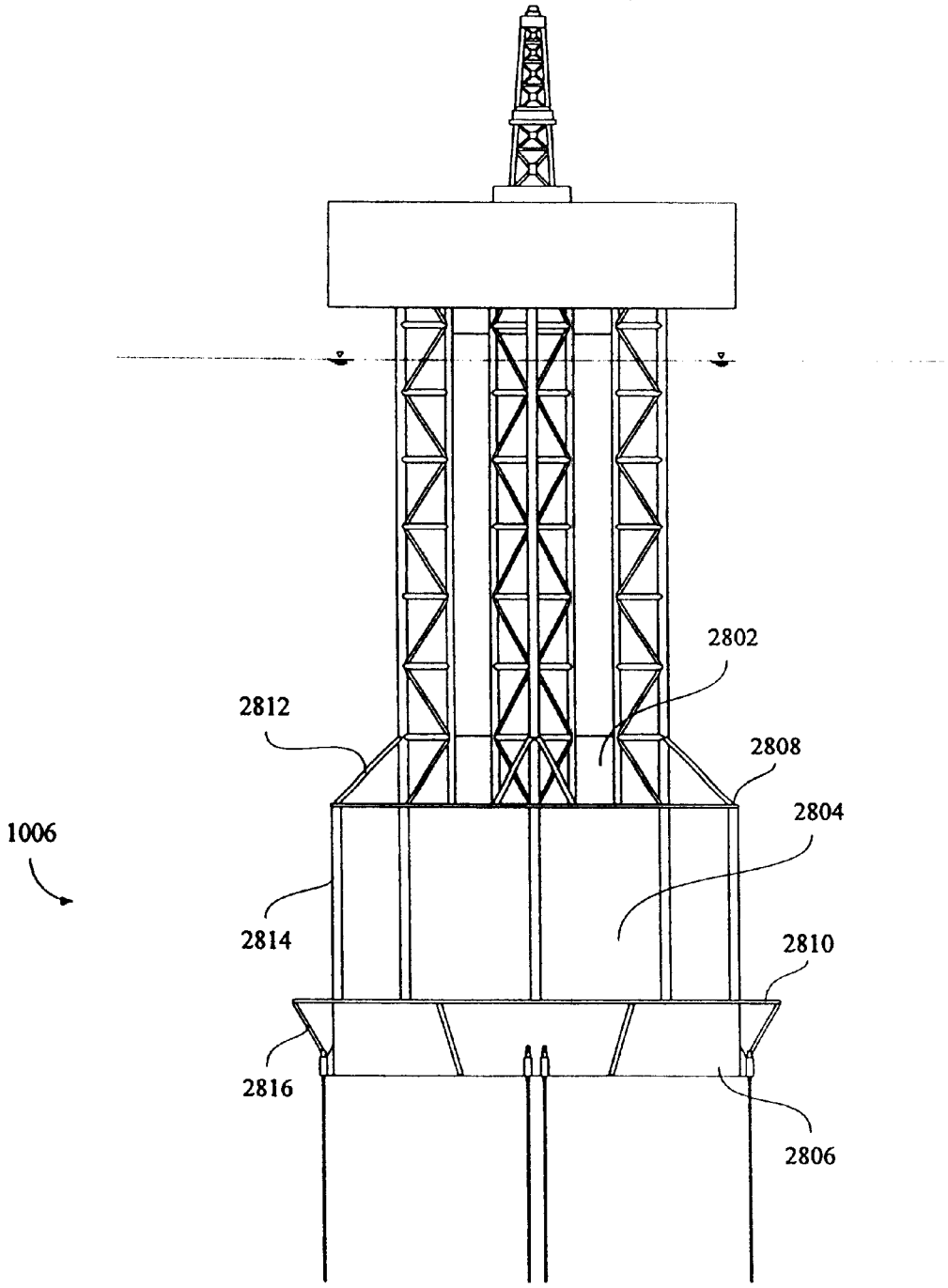
FIG. 28 illustrates an outboard profile of a floating structure in accordance with an embodiment of the invention having an arrangements of vertical heave plates to increase added mass.

In another embodiment, illustrated in FIG. 28, added mass of the floating structure is increased by an arrangement of heave plates attached to the hull structure. The hull structure 1006 comprises an narrowed upper portion 2802, a central portion 2804, and an enlarged base portion 2806. An upper heave plate 2808 comprising a circular steel plate is attached to an upper end of the central portion 2804 of the hull structure 1006. A lower heave plate 2810 is attached to an upper end of the enlarged base portion 2806 of the hull structure 1006. Upper 2812, central 2814, and lower 2816 bracing reinforces the upper 2808 and lower 2810 heave plates. The dimensions and spacing of the heave plates may be arranged based upon hydrodynamic principles and experimentation for optimal effectiveness. Heave plates may even be attached to or within the support structure for added versatility. Heave plate configurations such as those illustrated can provide significant difficulty in the construction and installation process. This is primarily true where the floating structure must be reoriented during the construction and installation process. Because many floating structures are transported horizontally and rotated to a vertical orientation on the site of installation, heave plates may not practically be allowed to extend outward from the hull structure. The size of the heave plates may therefore be limited or heave plates may be entirely unfeasible. The single vertical orientation construction and installation procedure disclosed in the present invention alleviates such difficulties experienced with heave plates. Heave plates may be attached to various embodiments of the present invention without interference during the construction and installation process. Limitations upon the design and use of heave plates is thereby greatly eased.

Figure 29:
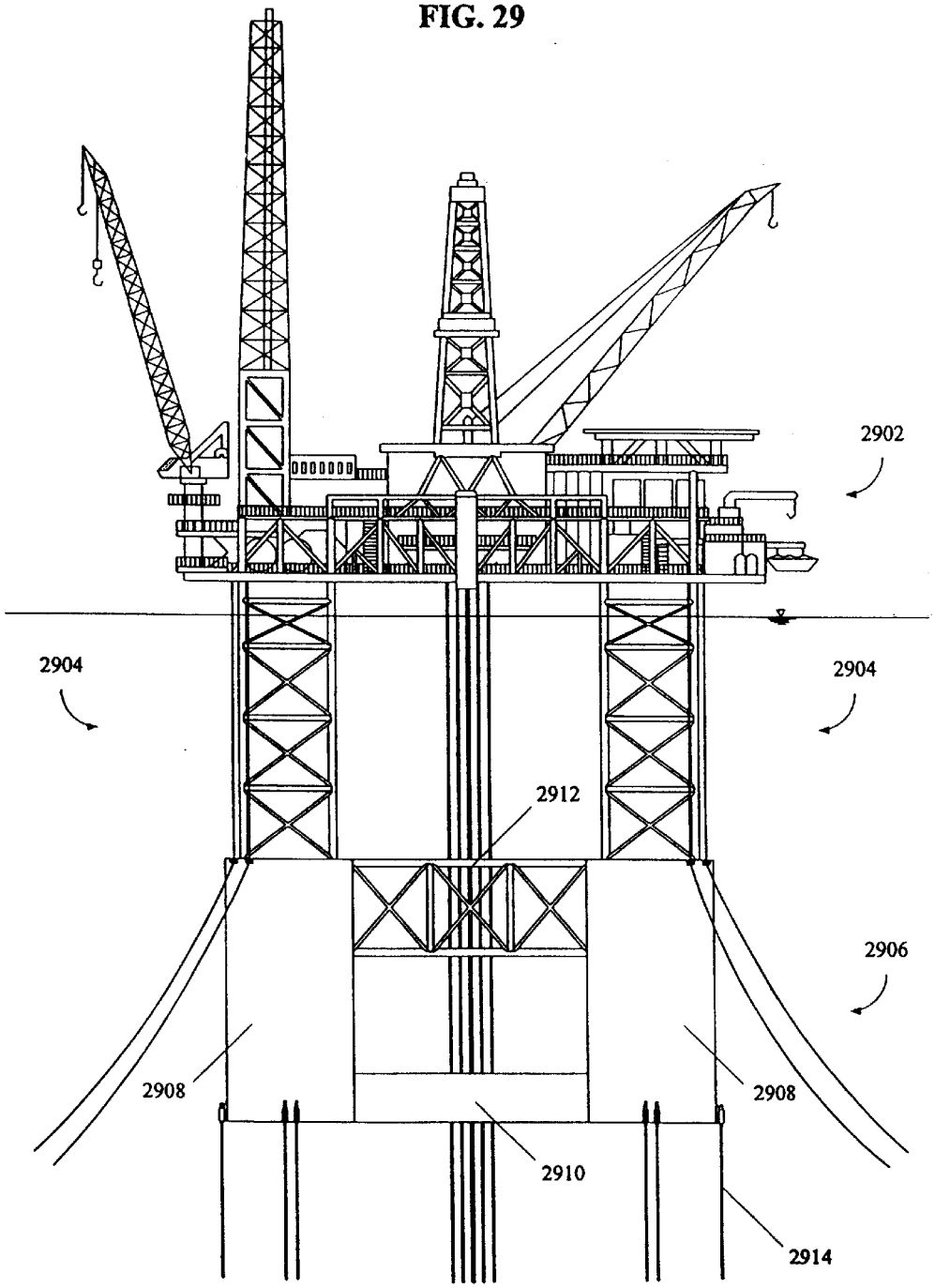
FIG. 29 illustrates an outboard profile of a floating structure in accordance with an embodiment of the invention having a multiple column semi-submersible type hull structure.

In another embodiment, illustrated in FIG. 29, a multiple column configuration is employed. A superstructure 2902 rests upon multiple support structures 2904 that engage a hull structure 2906 comprising multiple submerged buoyant column structures 2908 and a deeply submerged pontoon structure 2910. Cross bracing 2912 is disposed between the column structures. Solid ballast (not shown) may be located in the bases of the column structures 2908 and in the pontoon structure 2910. Soft tendons 2914 are disposed about the column structures 2908. A multiple column configuration may be well suited for applications requiring large superstructure area. The separation of multiple columns may also be employed to increase stability and increase available buoyancy.

Figure 30:
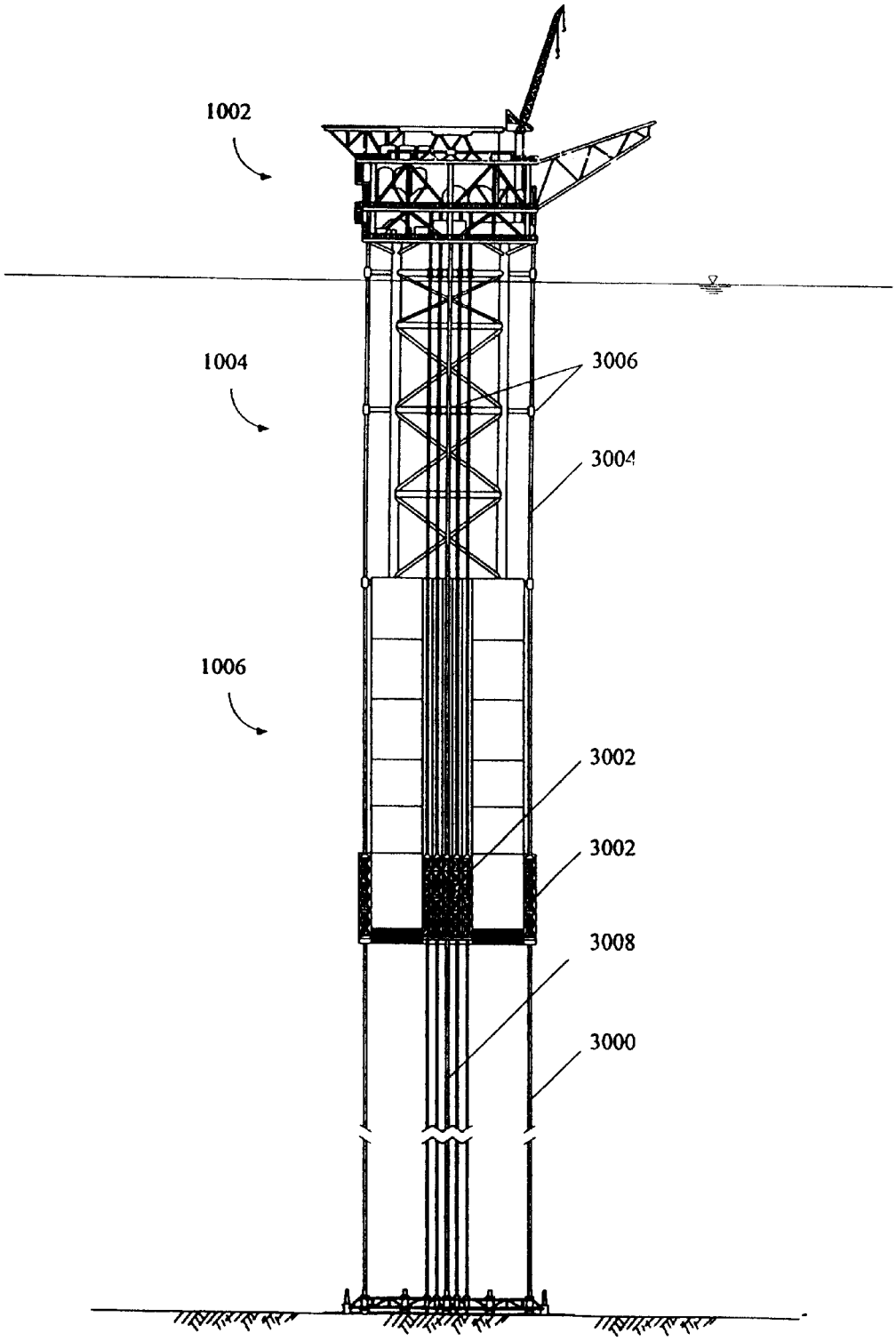
FIG. 30 illustrates an outboard profile of a floating structure in accordance with an embodiment of the invention employing production and import-export risers as tendons, without employing other external station keeping devices.

As a result of the reduced structure in the wave zone, dynamic forces upon the floating structure are reduced, reducing the dynamic motions. The principal motions of the floating structure may involve static offsets or slow drift motions, reducing fatigue in station keeping systems. The small waterplane area has the affect of inducing hull submergence under lateral offsets in response to increasing tendon tension, thus reducing the relative displacement between riser and floating structure, known as riser setdown. In certain applications, the addition of dedicated station keeping systems might be eliminated. Instead, risers may themselves be employed to provide sufficient station keeping performance. Referring now to FIG. 30, there is shown a minimal station keeping configuration in cross-sectional view, employing risers as station keeping devices. Larger diameter export risers 3000 are placed about the periphery of a hull structure 1006. The export risers 3000 employ buckling-column type elastomer tensioning units 3002 at the base of the hull structure 1006 as tendon connections. Above the elastomer tensioning units 3002, the export risers 3000 become self-supporting conductors 3004. Conductor bracing 3006 provides lateral support to the conductors 3004 along the length of the hull structure 1006 and support structure 1004. As illustrated, the superstructure 1002 is outfitted with limited processing equipment for well tender operations. Production risers 3008 also employ elastomer tensioning units 3002. The stiffness of the elastomer tensioning units 3002 combine to provide the desired vertical stiffness. The spacing of export risers 3000 augments stability. Where necessary, supplemental mooring lines (not shown) may be employed to improve station keeping performance.

Figure 31A:
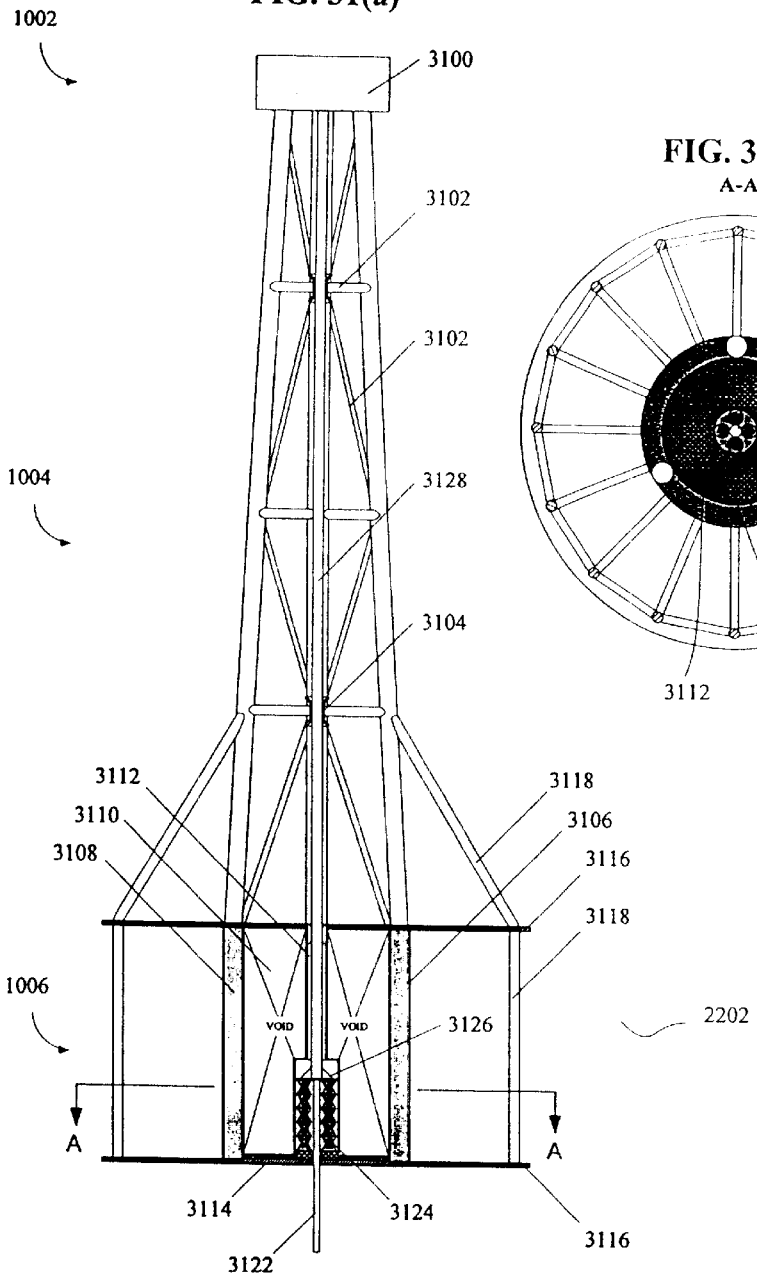
FIGS. 31(*a*)–(*b*) illustrate a partial cross-section profile and top view of a floating structure in accordance with an embodiment of the invention employing a single production riser as a tendon, without employing other external station keeping devices.
Figure 31B:
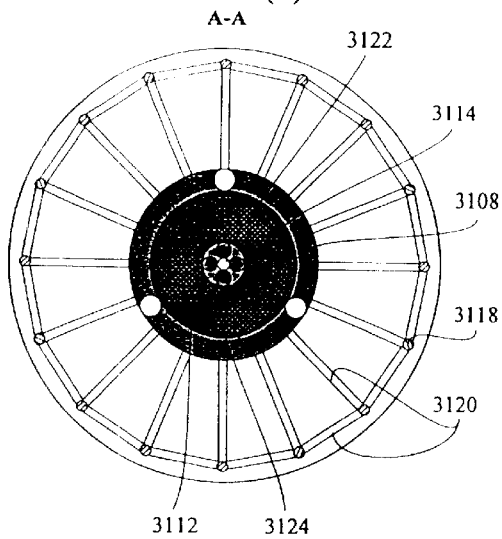

Referring now to FIGS. 31(*a*)–31(*b*), there is shown a minimal station keeping configuration in partial cross-sectional view, wherein a single riser alone is employed as a station keeping device. As illustrated, the superstructure 1002 comprises a minimal platform 3100 designed for offloading operations. The support structure 1004 comprises a jacket structure having cross-bracing 3102 with conductor guides 3104. The hull structure 1006 comprises a caisson hull 3106 having outer variable ballast tanks 3108, inner permanent void tanks 3110, and a central well 3112. Solid ballast 3114 is placed at a bottom end of the hull structure 1006 to lower the center of gravity of the floating structure 1000. Top and bottom ends of the hull structure 1006 have circular heave plates 3116 with cross-bracing 3118 and stiffeners 3120. A production riser 3122 passes through the central well 3112 where elastomer tensioning units 3124 engage the riser at a load spreader 3126 to provide riser tension. Above the elastomer tensioning units 3124, the risers 3122 become self-supporting conductors 3128 passing through the conductor guides 3104. The stiffness of the elastomer tensioning units 3124 in combination with the mass and added mass of the hull structure 1006, heave plates 3116, and other structures, provide the desired heave natural period. The riser tension provides the restoring force to hold the floating structure 1004 on station. As illustrated, the floating structure may be a relatively small and inexpensive design especially suited for minimal offloading functions from subsea wellheads and processing equipment.

Figure 32:
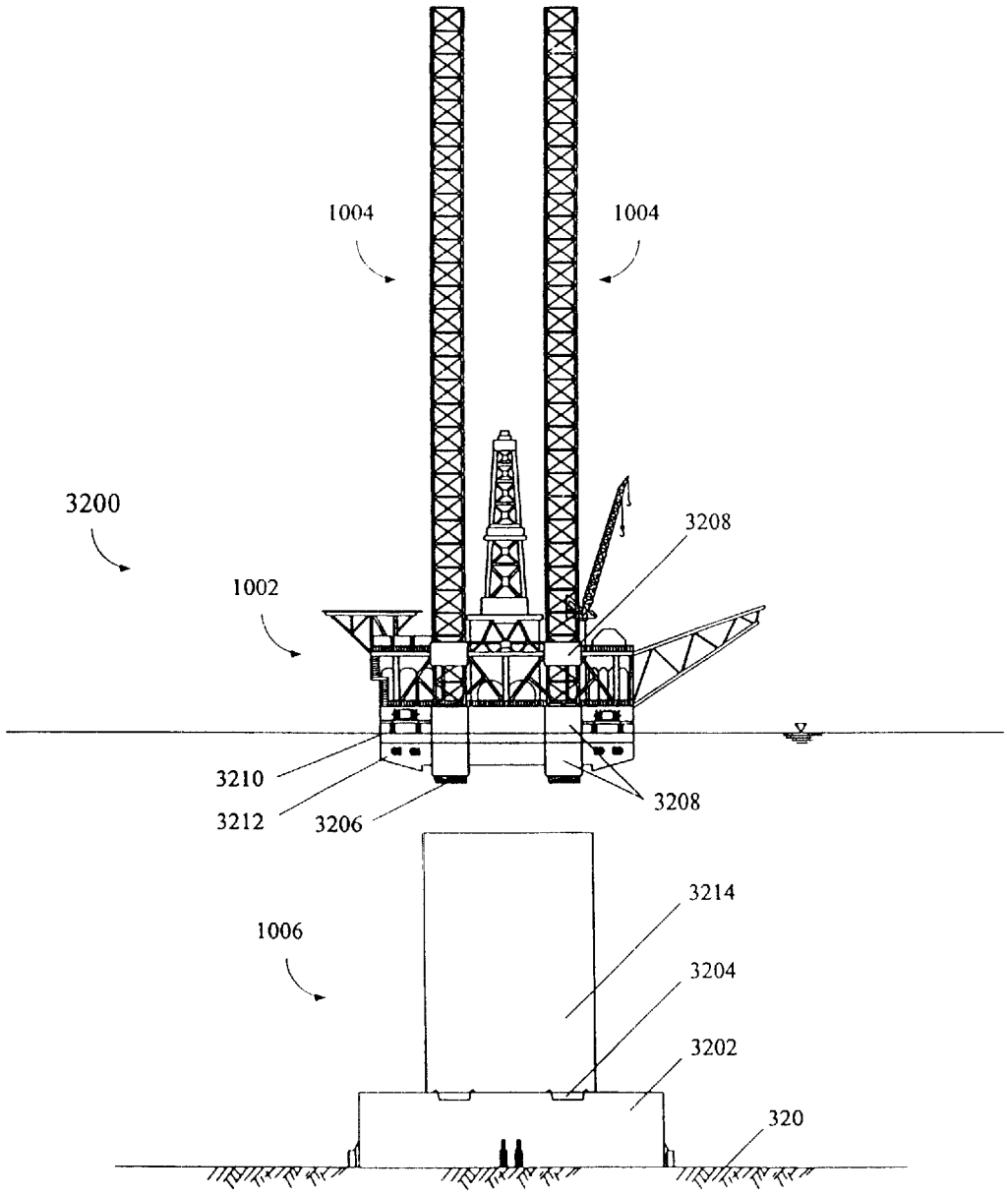
FIG. 32 illustrates an outboard profile of a floating structure having a submerged hull with a jack-up type support structure and superstructure configuration in accordance with an embodiment of the invention wherein the superstructure is afloat with the jack-up support structure in a fully retracted position and the submerged hull resting on the seafloor.
Figure 33:
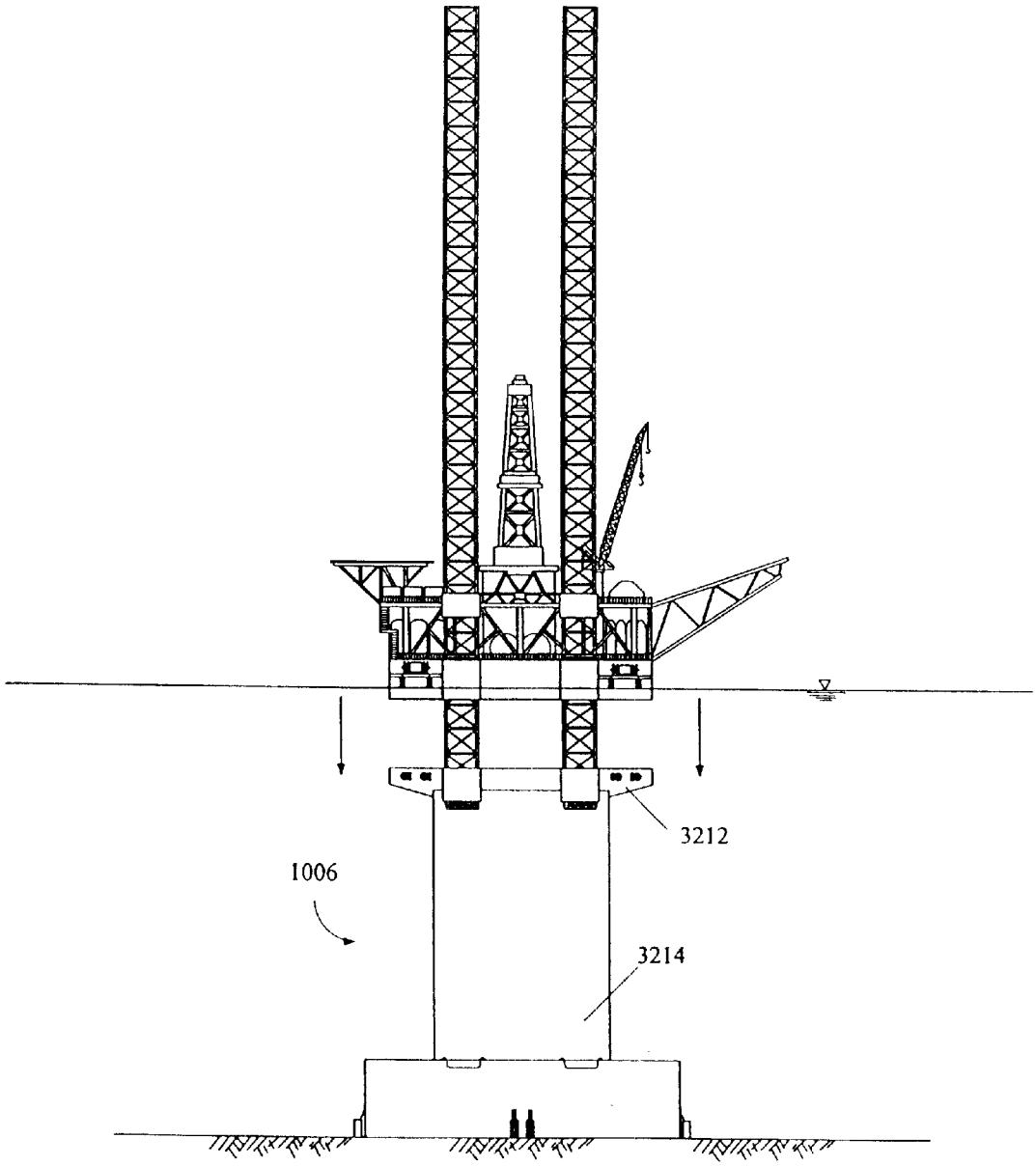
FIG. 33 illustrates an outboard of the floating structure of FIG. 32 wherein the superstructure is afloat and the jack-up hull template has engaged the top of the submerged hull resting on the seafloor.
Figure 34:
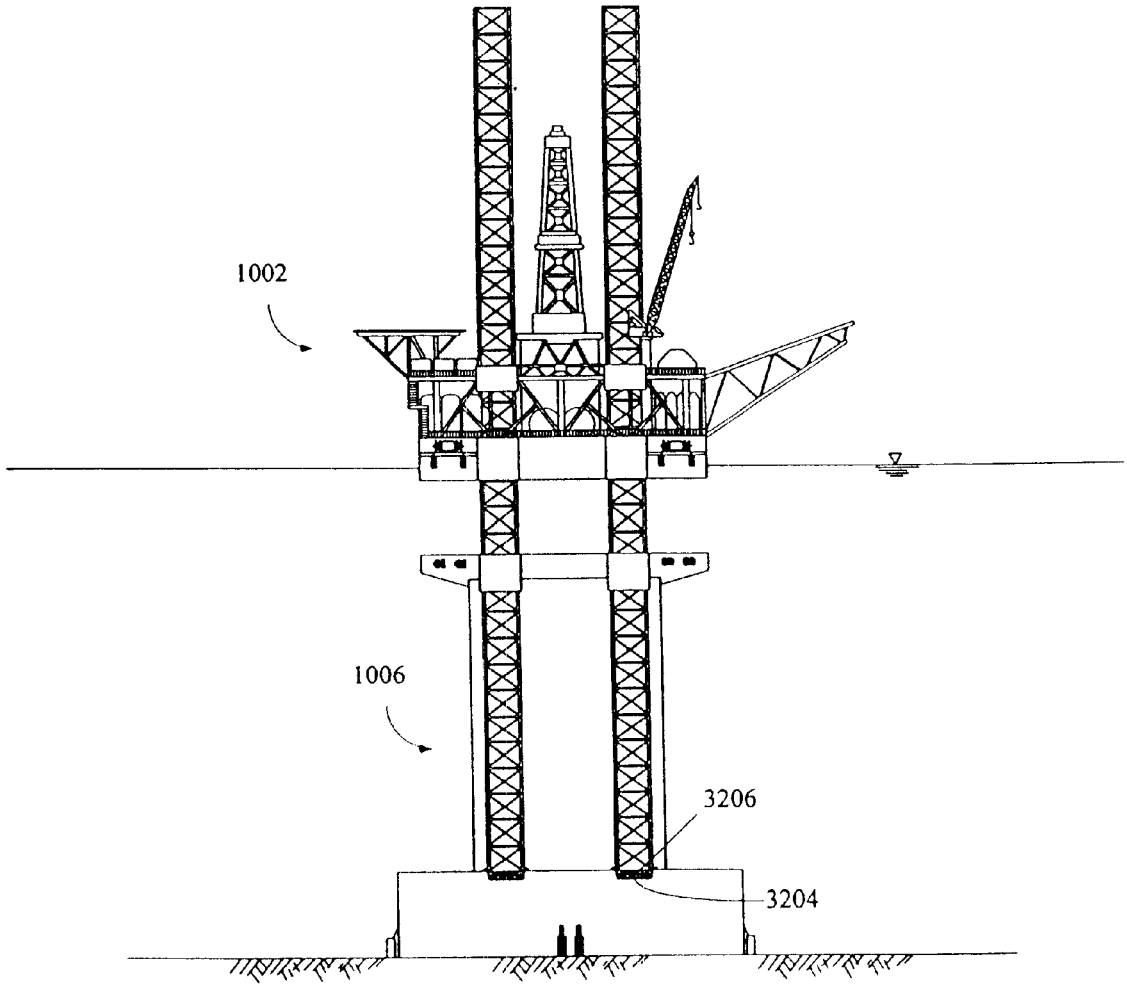
FIG. 34 illustrates an outboard of the floating structure of FIG. 32 wherein the superstructure is afloat and the jack-up support structure has fully engaged the submerged hull resting on the seafloor.
Figure 35:
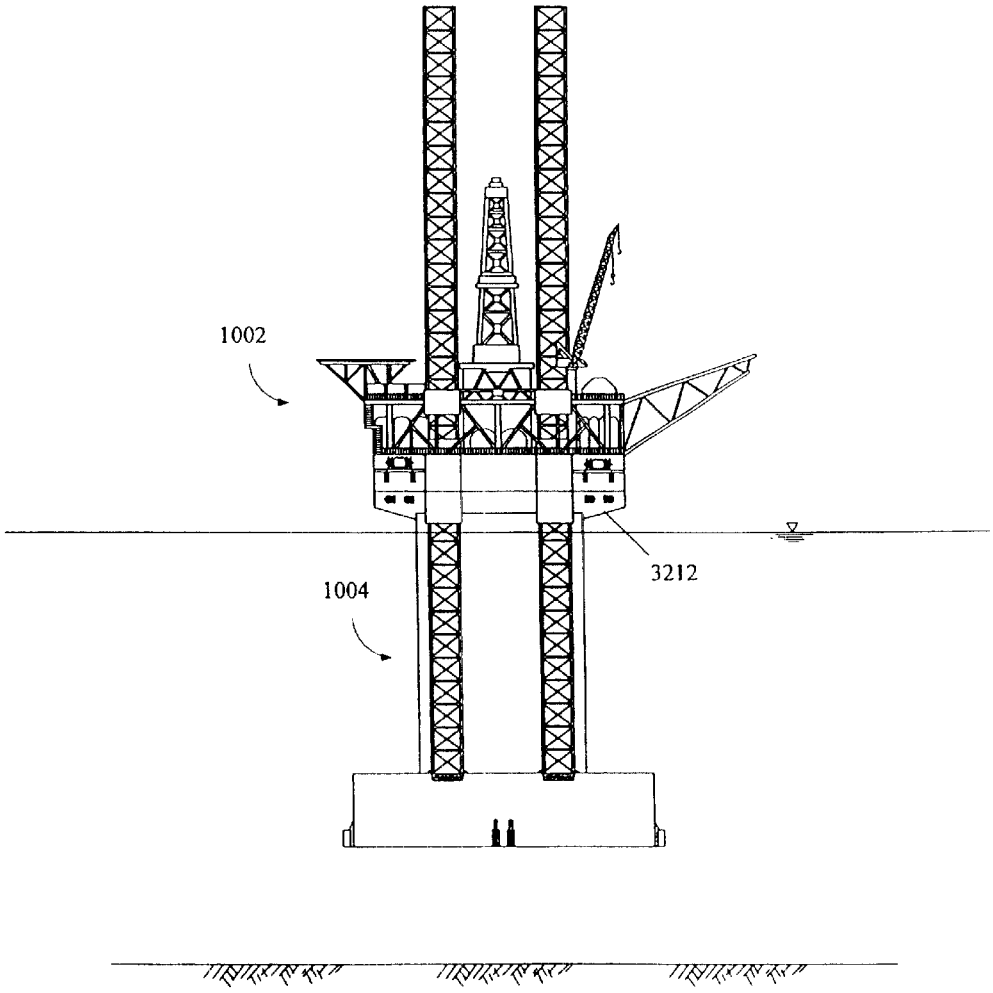
FIG. 35 illustrates an outboard profile of the floating structure of FIG. 32 in a tow condition.
Figure 36:
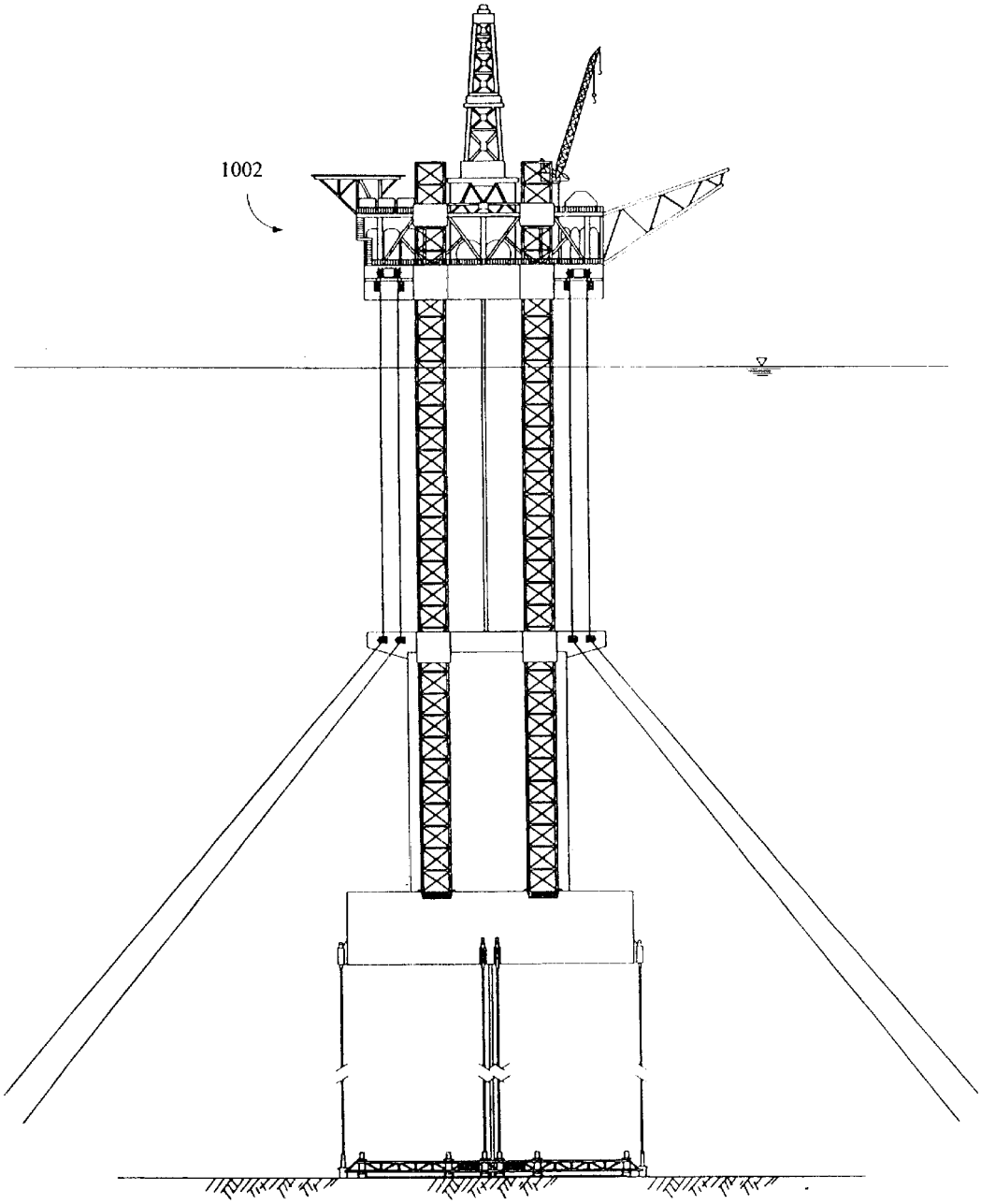
FIG. 36 illustrates an outboard profile of the floating structure of FIG. 32 wherein the superstructure is fully supported above the water surface upon the jack-up support and the submerged hull soft tendon system and mooring lines are fully installed.

In still another embodiment, as illustrated in FIG. 32, the superstructure 1002 and multiple support structures 1004 comprise a self-buoyant jack-up rig 3200 that is detachable from the hull structure 1006. An enlarged bottom portion 3202 of the hull structure 1006 has receptacles 3204 for receiving support feet 3206 on bottoms of the support structures 1004. The support structures 1004 are disposed within support guides 3208. The superstructure 1002 has a buoyant base 3210 and a hull template 3212. As illustrated, the hull structure 1006 rests upon the seafloor 330 in relatively shallow water. The jack-up rig 3200 is floating with the support structures 1004 in a fully retracted position. As illustrated in FIG. 33, the hull template 3212 can be lowered to engage a narrow top portion 3214 of the hull structure 1006 by extending the support structures 1004. As illustrated in FIG. 34, further extension of the support structures 1004 engages the support feet 3206 and receptacles 3204. With the support feet 3206 engaged, a portion of the weight of the superstructure 1002 may be applied to the enlarged bottom portion 3202 of the hull structure 1006. As illustrated in FIG. 35, the hull structure 1006 may be deballasted into a tow condition draft, and the superstructure 1002 may lowered onto the hull template 3212. The structure may then be towed to the site of installation. As illustrated in FIG. 36, the soft tendon and mooring systems may be installed at the site of installation and the superstructure 1002 may be jacked above the water surface to an operation position.

It can be appreciated by reference to the foregoing description of various embodiments of the invention that there are several advantages achieved by the present invention. For example, station keeping system requirements are substantially reduced. Submergence of buoyancy to a depth lower in the wave zone, reduces the magnitude of hydrodynamic forces acting to induce excursions. A support structure is disposed between the superstructure and submerged buoyancy provided by the hull structure. The support structure provides a small hull profile in the upper portion of the wave zone where the wave profile has the largest magnitude. The resulting decrease in magnitude of surge forces reduces the requirement on a station keeping system.

Another advantage is seakeeping characteristics are substantially improved. Submergence of buoyancy and use of a support structure through all or a portion of the wave zone substantially reduces the magnitude of wave induced hydrodynamic forces acting on the floating structure. As previously mentioned, the support structure has a small profile to reduce the magnitude of wave induced oscillatory surge and pitch forces. The support structure also has a relatively small water plane area reducing the magnitude of wave induced oscillatory heave forces. Also, selection and arrangement of tendons constructions and elastomer tendon connections allow flexible manipulation of the natural periods of motion of the floating structure to further improve seakeeping performance. A designer may vary elements such as the configuration of mooring lines and tendons, the stiffness of the tendon system, the spacing of the tendons, the added mass of the floating structure to produce desirable natural periods of motion for a given application. Multiple natural periods may be employed through the use of elastomer tendon connections to adjust natural periods in various environmental conditions. While wind and current may induce some measure of oscillatory motions, most oscillatory motions are induced through the action of waves. The result is a floating structure with reduced dynamic motions to permit comfortable operation in more severe environments. The reduction in dynamic motions also acts to reduce cyclic fatigue, especially for elements such as risers and station keeping elements whose design is largely affected by fatigue concerns.

Yet another advantage is sensitivity to increases in water depth is substantially reduced. Unlike mooring lines, tendon performance does not generally degrade significantly with water depth. By employing a soft tendon construction, tendon pretension need not increase significantly with depth, as soft tendon weight per foot is relatively small and tendon failure through buckling is not a concern. Tendon pretension may generally be held below five percent of displacement, reducing the size and number of tendons required and reducing tendon peak tensions. The desired vertical stiffness, such as one hundred tons per foot or less, may be supplied even to extreme water depths, such as ten thousand feet, by a relatively small number of commercially available constructions such as sheathed spiral strand wire rope or synthetic rope. Increasing water depth actually decreases the percent strain experienced by tendons, thereby increasing tendon safety and reducing tendon fatigue.

An additional advantage is the floating structure is generally insensitive to increases in superstructure and payload weight. Increasing superstructure and payload weight increase the natural periods of motion for a given stiffness. Arrangement of the natural periods of motion above the primary wave period means that superstructure or payload weight moves the floating structure's natural period farther away from the primary wave period and resonance matching. A designer has flexibility to employ a combination of soft tendon system construction and arrangement, added mass, fixed ballast, hull structure design and submergence to achieve desirable natural periods of motion. Extremely large superstructure and payload weights may be accommodated in this manner.

Another additional advantage is the floating structure is self-stabilizing. While a soft tendon system may augment stability, the floating structure need not be dependent upon the function of external station keeping systems to provide stability. Stability is provided by placement of the center of gravity below the center of buoyancy in the installed condition. In an otherwise catastrophic event, resulting in the loss of station keeping systems, the floating structure can still maintain stable floatation.

A further advantage is the floating structure is simple and inexpensive to construct, transport, and install. In one embodiment, the support structure and hull structure are fabricated as a single piece on land. An enlarged bottom portion of the hull structure permits shallow draft tow. In another embodiment, the superstructure is set upon the top of the hull structure at the construction yard. An enlarged bottom section of the hull permits shallow draft tow of the entire floating structure as a single unit. At the site of installation, the superstructure is floated-up or jacked-up into and fixed in an operation condition. In one embodiment, the soft tendon system comprises non-rigid tendon constructions. The non-rigid construction alleviates buckling concerns during the installation process and simplifies tendon handling and installation.

A still further advantage is the floating structure is versatile and mobile. In one embodiment, the superstructure and support structure comprise a jack-up type rig that is detachable from the hull structure. Jack-up rigs allow superstructures to be changed during different states of development of a hydrocarbon reservoir. During initial drilling operations, a dedicated drilling jack-up rig may be employed. Subsequently, other jack-up rigs may replace the drilling rig. A drilling and production, production only, or other rig may be used. In this and other embodiments, the deck may be floated or jacked up and down along the support structure repeatedly to allow frequent location changes for applications such as dedicated drilling platforms or for use with multiple smaller hydrocarbon deposits during the floating structure's service life.

It is to be understood that the embodiments described herein are illustrative only, and that other embodiments may be derived by one of ordinary skill in the art without departing from the scope of the invention.

What is claimed is:

1. A floating offshore structure, comprising:

a buoyant hull adapted to be fully submerged below a water surface in substantially all operating conditions of the floating offshore structure, the buoyant hull having a sufficient amount of fixed ballast to place a center of gravity of the floating offshore structure below a center of buoyancy of the floating offshore structure;

a support structure coupled to the hull, the support structure having a waterplane area which contributes a first vertical stiffness to the floating offshore structure;

a superstructure mounted on the support structure; and at least one soft tendon which has a first end attached to the hull and a second end attached to a seafloor, the soft tendon contributing a second vertical stiffness which exceeds the first vertical stiffness, wherein a combination of the first vertical stiffness and the second vertical stiffness provides a heave natural period to the floating offshore structure of at least twenty seconds, the second vertical stiffness being between 100 and 1,000 tons per foot.

2. The floating offshore structure of claim 1, wherein a horizontal cross-sectional area of the support structure is significantly smaller than a horizontal cross-sectional area of the hull.

3. The floating offshore structure of claim 1, wherein the support structure comprises one or more cross-braced truss.

4. The floating offshore structure of claim 1, wherein the support structure and the superstructure form a single unit which is detachable from the hull.

5. The floating offshore structure of claim 1, wherein the superstructure is self-buoyant.

6. The floating offshore structure of claim 1, wherein the horizontal cross-sectional area of the support structure provides between 5 and 100 tons per foot of vertical stiffness.

7. A floating offshore structure, comprising:

a buoyant hull having a sufficient amount of fixed ballast to place a center of gravity of the floating offshore structure below a center of buoyancy of the floating offshore structure;

a support structure coupled to the hull;

a superstructure mounted on the support structure, the superstructure being vertically movable along the support structure; and at least one soft tendon having a first end attached to the hull and a second end attached to a seafloor, wherein a heave natural period of the floating offshore structure is at least twenty seconds.

8. A floating offshore structure, comprising:

a buoyant hull having a sufficient amount of fixed ballast to place a center of gravity of the floating offshore structure below a center of buoyancy of the floating offshore structure, wherein a weight of the fixed ballast is of approximately the same order of magnitude as a weight of the superstructure;

a support structure coupled to the hull;

a superstructure mounted on the support structure; and at least one soft tendon having a first end attached to the hull and a second end attached to a seafloor, wherein a heave natural period of the floating offshore structure is at least twenty seconds.

9. A hull for a floating offshore structure, comprising:

a positively buoyant upper portion connected to a negatively buoyant lower portion, the lower portion comprising an expanded section slidably disposed a disance apart from a main section, the lower portion containing a sufficient amount of fixed ballast to place a center of gravity of the floating offshore structure below a center of buoyancy of the floating offshore structure; and at least one soft tendon having a first end attached to the lower portion of the hull and a second end attached to the seafloor, wherein a natural heave period of the offshore floating structure is at least twenty seconds.

10. A station keeping arrangement for a floating offshore structure, comprising:

a buoyant hull containing sufficient ballast to place a center of gravity of the floating offshore structure below a center of buoyancy of the floating offshore structure;

at least one tendon connector attached to the hull; and at least one soft tendon having a first end attached to the tendon connector and a second end attached to the seafloor, the vertical stiffness provided by the soft tendon being of approximately an order of magnitude greater than a vertical stiffness provided by a waterplane area of the floating offshore structure, wherein a heave natural period of the floating offshore structure is at least twenty seconds.

11. The station keeping arrangement of claim 10, wherein the soft tendon is pretensioned with a predetermined amount of tension.

12. The station keeping arrangement of claim 10, wherein the soft tendon comprises a sheathed spiral stand wire rope.

13. The station keeping arrangement of claim 10, wherein the soft tendon comprises a synthetic rope.

14. The station keeping arrangement of claim 10, wherein the tendon connector comprises a tension control means for controlling a vertical stiffness of the floating offshore structure.

15. The station keeping arrangement of claim 14, wherein the tendon connector comprises an elastomer tendon connector having at least two distinct stiffness characteristics in compression to achieve multiple heave natural periods for the floating offshore structure.

16. The station keeping arrangement of claim 14, wherein the tendon comprises a riser pipe.

17. The station keeping arrangement of claim 10, wherein the tendon is connected to the seafloor at a predetermined angle off of vertical.

18. The station keeping arrangement of claim 10, further comprising at least one mooring line.

19. The station keeping arrangement of claim 18, wherein the mooring line passes through a mooring line connector attached to the hull at a point above the center of buoyancy of the floating offshore structure.

20. The station keeping arrangement of claim 10, wherein each natural period of the floating offshore structure in all six degrees of freedom is above twenty seconds.

21. A method of installing a floating offshore structure, comprising:

towing a single caisson buoyant hull having a support structure coupled thereto in a vertical orientation to a predetermined offshore location, the hull floating on or near a water surface during the towing and providing sufficient waterplane area to maintain stable floatation of the floating offshore structure, a superstructure coupled to the support structure prior to arriving at the predetermined offshore location, the superstructure in a retracted position along the support structure relative to the hull prior to arriving at the predetermined offshore location;

adding ballast to the hull to submerge the hull below a water surface such that a center of gravity of the floating offshore structure is below a center of buoyancy of the floating offshore structure; and attaching a first end of at least one soft tendon to the hull and a second end of the tendon to a seafloor and pretensioning the soft tendon to a predetermined level such that a vertical stiffness provided by the soft tendon exceeds a vertical stiffness provided by a waterplane area of the support structure, wherein a combination of the vertical stiffness provided by the soft tendon with the vertical stiffness provided by the waterplane area of the support structure provides a heave natural period to the floating offshore structure of at least twenty seconds.

22. The method of claim 21, wherein towing begins from an inland location.

23. The method of claim 21 further comprising raising the superstructure into an extended position after arriving at the predetermined offshore location.

* * * * *

UNITED STATES PATENT AND TRADEMARK OFFICE

CERTIFICATE OF CORRECTION

PATENT NO. : 6,431,107 B1
DATED : August 13, 2002
INVENTOR(S) : Steven M. Byle

It is certified that error appears in the above-identified patent and that said Letters Patent is hereby corrected as shown below:

Title page,
Item [73], Assignee's name is changed from "Novellant Technologies, L.L.C." to -- Novellent Technologies, L.L.C. --

Column 9,
Line 54, the word "ceriter" is replaced with -- center --

Column 16,
Line 56, the word "catenaxy" is replaced with -- catenary --

Column 28,
Line 33, the word "disance" is replaced with -- distance --

Signed and Sealed this

Eighth Day of April, 2003

JAMES E. ROGAN
*Director of the United States Patent and Trademark Office*